US012504215B2

(12) United States Patent
Park et al.

(10) Patent No.: US 12,504,215 B2
(45) Date of Patent: Dec. 23, 2025

(54) REFRIGERATOR

(71) Applicant: LG ELECTRONICS INC., Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 181 days.

(21) Appl. No.: 18/019,642

(22) PCT Filed: Jul. 19, 2021

(86) PCT No.: PCT/KR2021/009259
§ 371 (c)(1),
(2) Date: Feb. 3, 2023

(87) PCT Pub. No.: WO2022/030810
PCT Pub. Date: Feb. 10, 2022

(65) Prior Publication Data

US 2023/0288123 A1 Sep. 14, 2023

(30) Foreign Application Priority Data

Aug. 6, 2020 (KR) ..... 10-2020-0098360
Aug. 6, 2020 (KR) ..... 10-2020-0098361
Aug. 6, 2020 (KR) ..... 10-2020-0098365

(51) Int. Cl.
*F25D 21/02* (2006.01)

(52) U.S. Cl.
CPC ..... *F25D 21/02* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS 3,355,904 A * 12/1967 Sutton, Jr. ..... G05D 11/13 73/196
3,872,683 A * 3/1975 Blanton ..... F25D 21/02 62/140
5,934,088 A * 8/1999 Takeda ..... F25B 49/005 62/127
9,127,875 B2 * 9/2015 Hall ..... F25D 21/006
9,557,091 B1 * 1/2017 Zardo ..... F25D 23/061
2005/0281669 A1 * 12/2005 Sohn ..... F04D 29/422 415/204

(Continued)

FOREIGN PATENT DOCUMENTS

KR 1536284 B1 * 7/2015
WO 2019/190113 A1 3/2019

*Primary Examiner* — Joel M Attey
*Assistant Examiner* — Meraj A Shaikh
(74) *Attorney, Agent, or Firm* — Bryan Cave Leighton Paisner LLP

(57) ABSTRACT

A fluid inlet part of a frosting detection duct protrudes toward a flow path of a fluid to provide flow path resistance. Accordingly, a material property detected by a frosting detecting device may secure the discrimination sufficient to additionally recognize frosting-related information in addition to detecting frosting.

13 Claims, 51 Drawing Sheets

(56) References Cited

U.S. PATENT DOCUMENTS

| | | | | |
|---|---|---|---|---|
| 2009/0113923 | A1* | 5/2009 | Young | F25D 17/065<br>700/282 |
| 2018/0031298 | A1* | 2/2018 | Kim | F25D 25/025 |
| 2018/0347871 | A1* | 12/2018 | Park | F25D 23/087 |

* cited by examiner

【Figure 1】
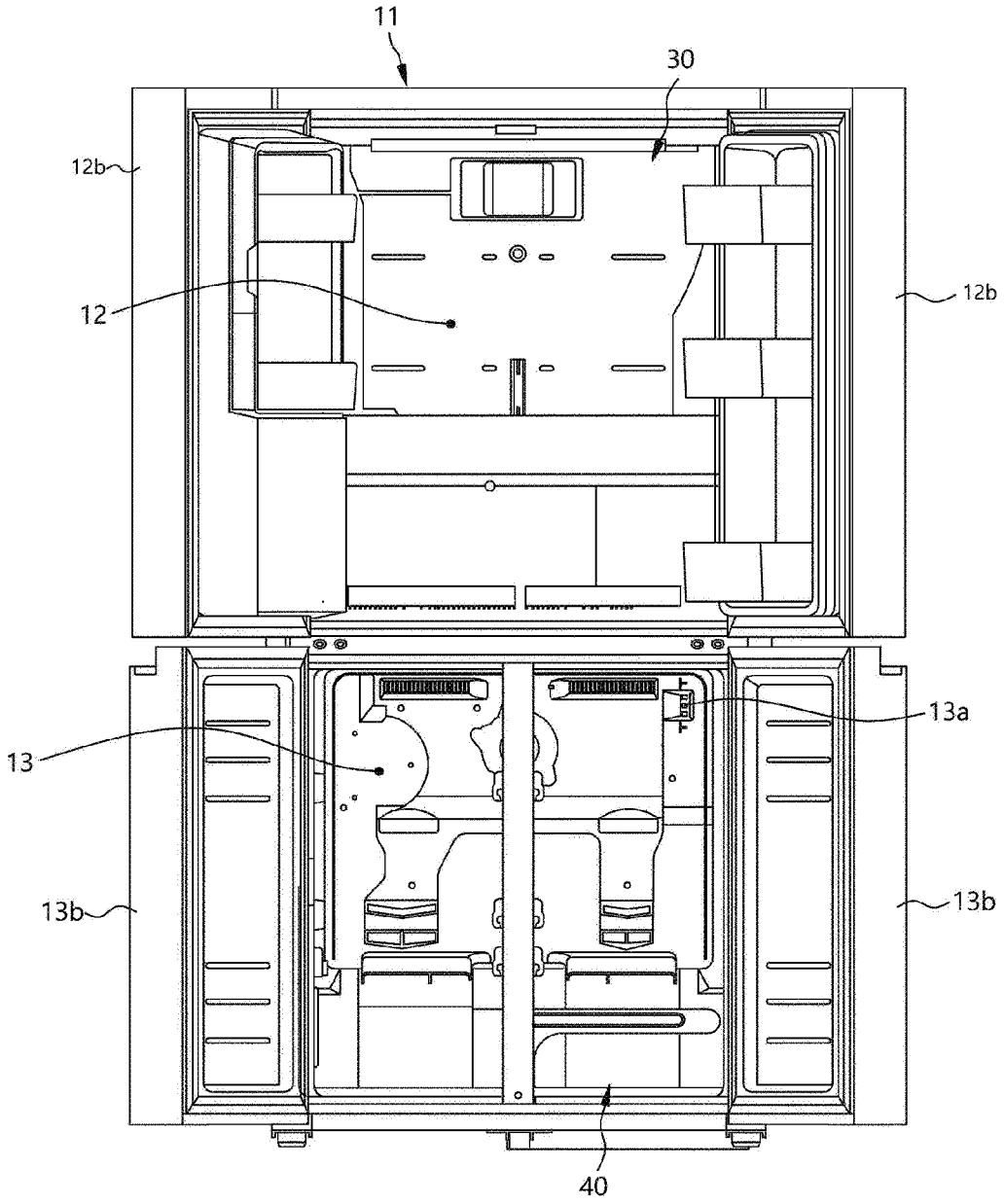

【Figure 2】
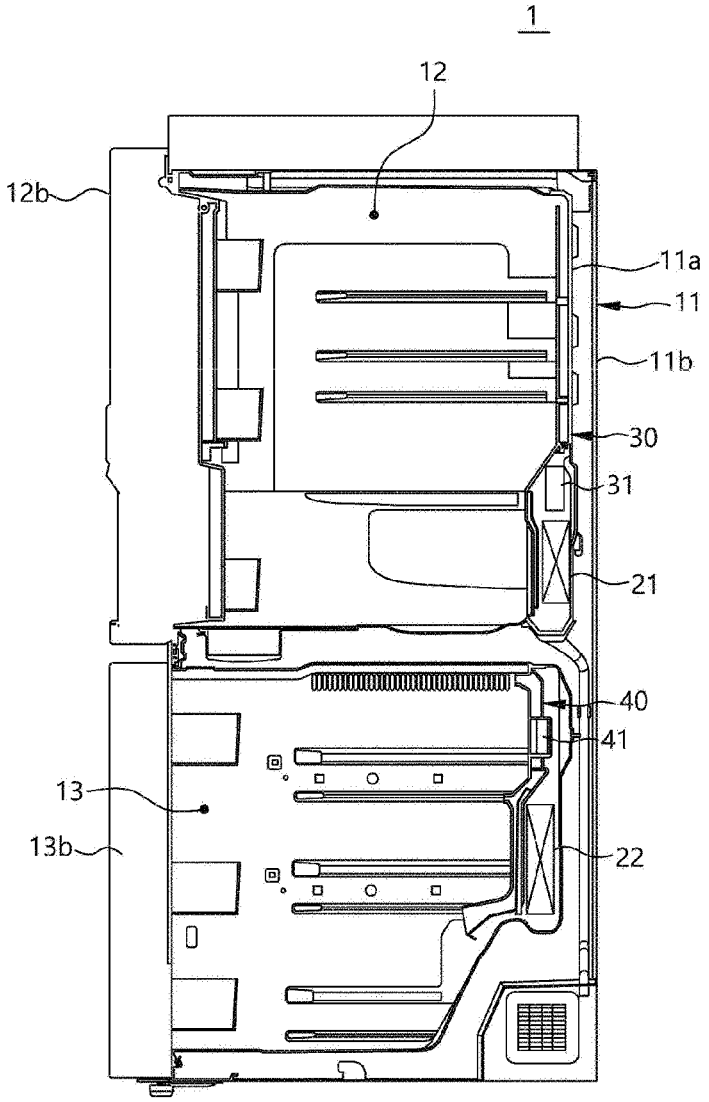

【Figure 3】
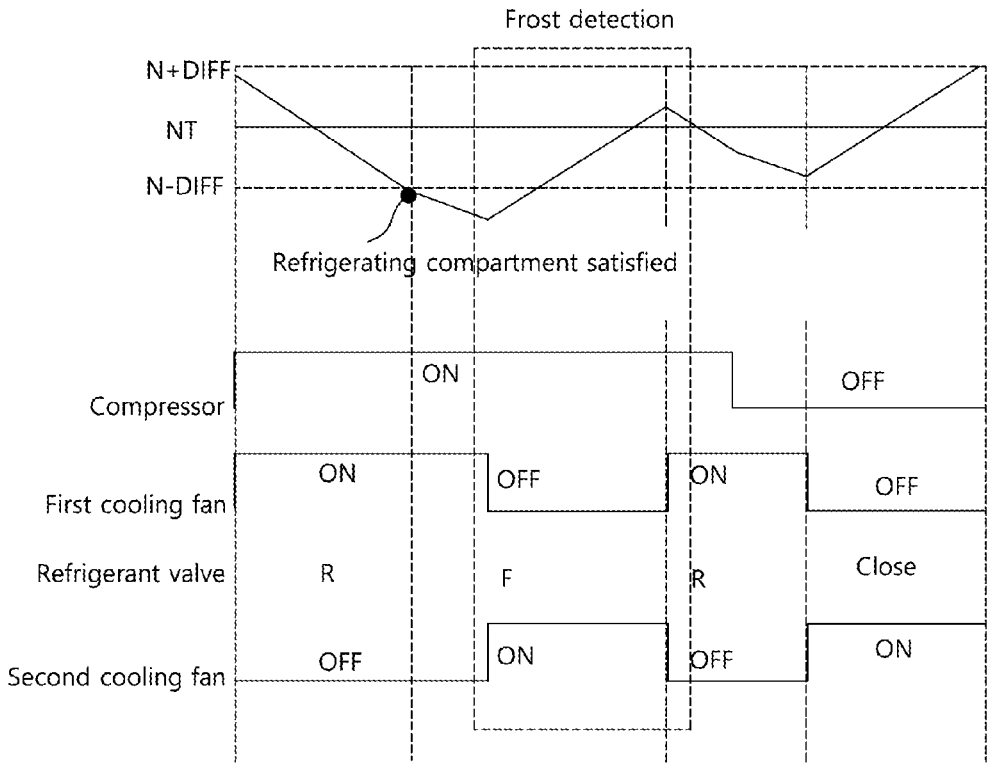

【Figure 4】
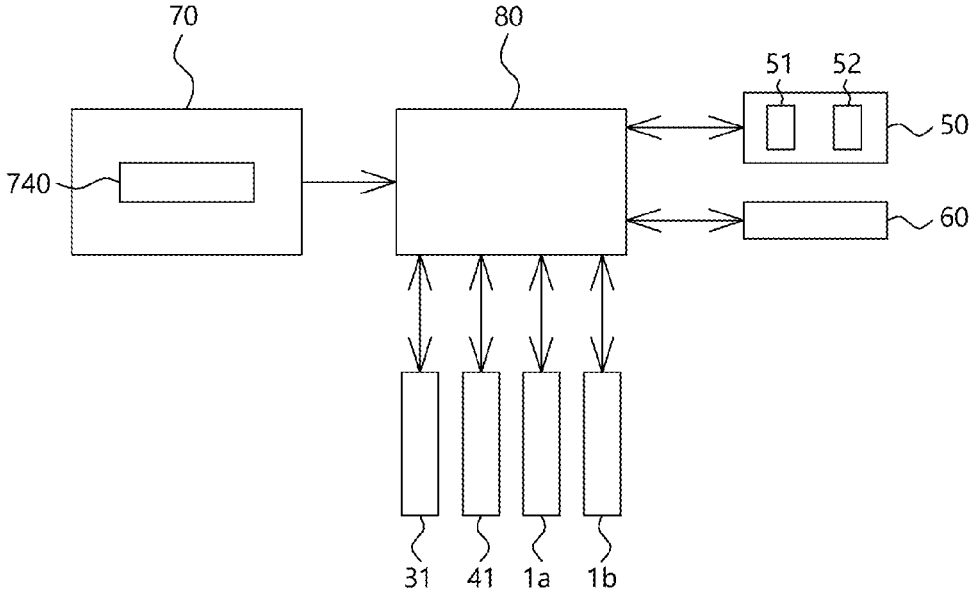
【Figure 5】
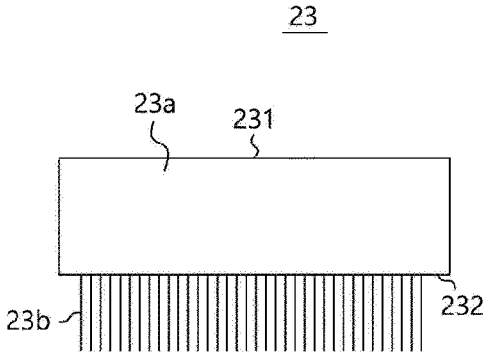

【Figure 6】
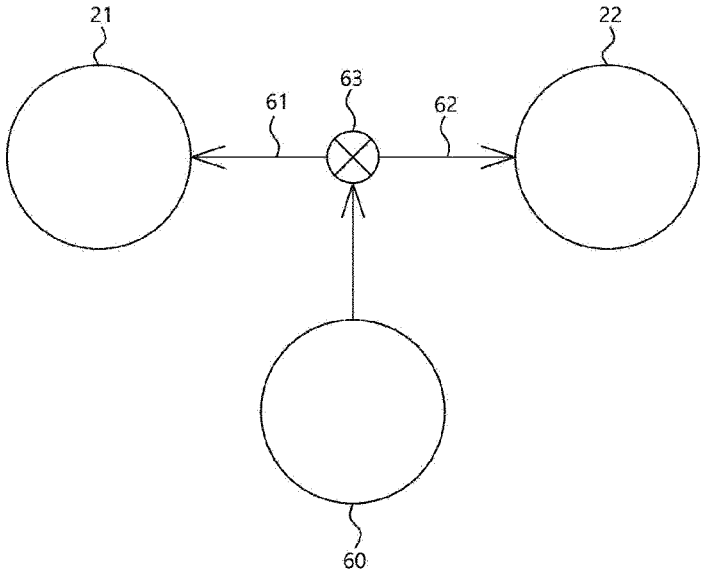

【Figure 7】
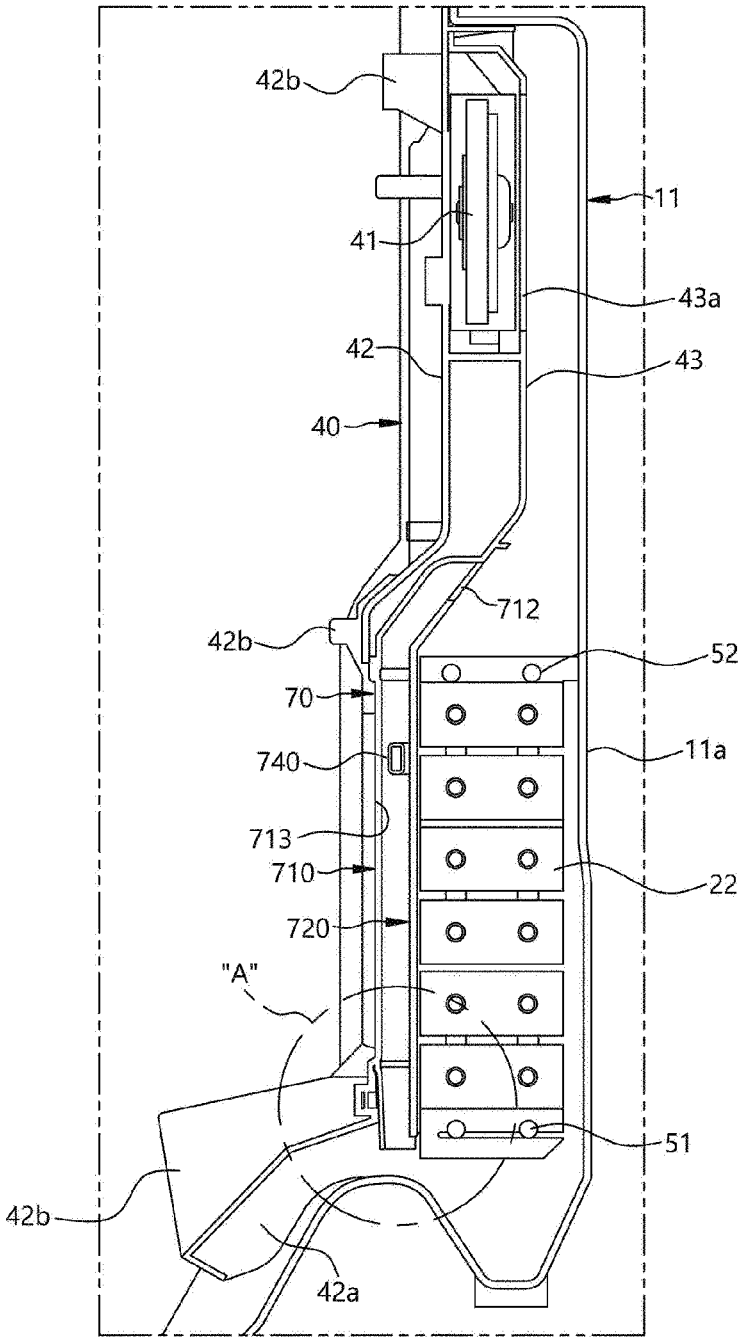

【Figure 8】
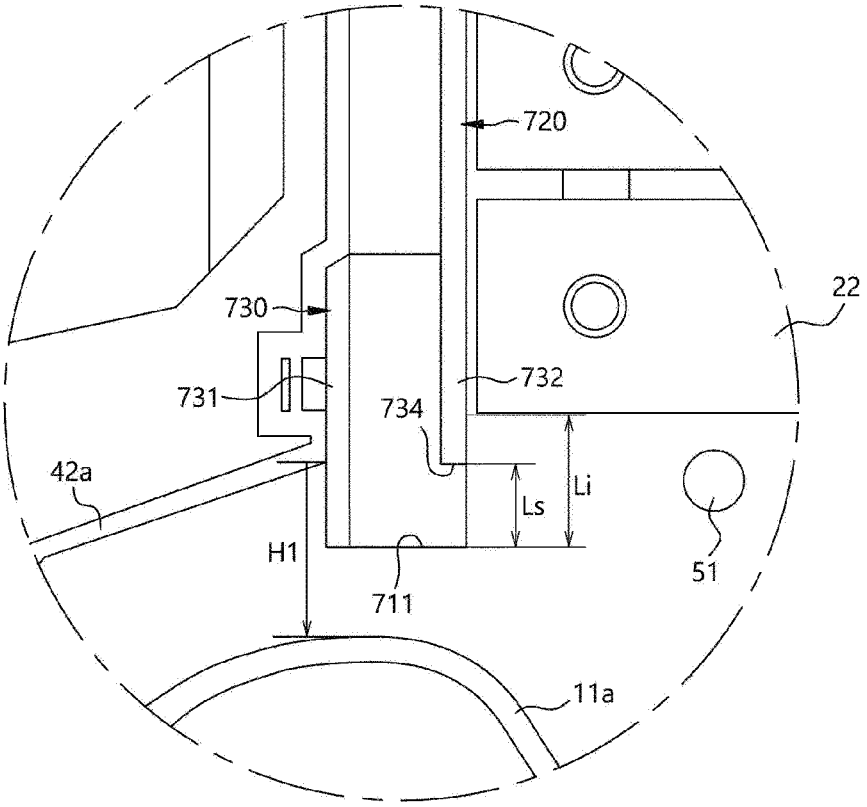

【Figure 9】
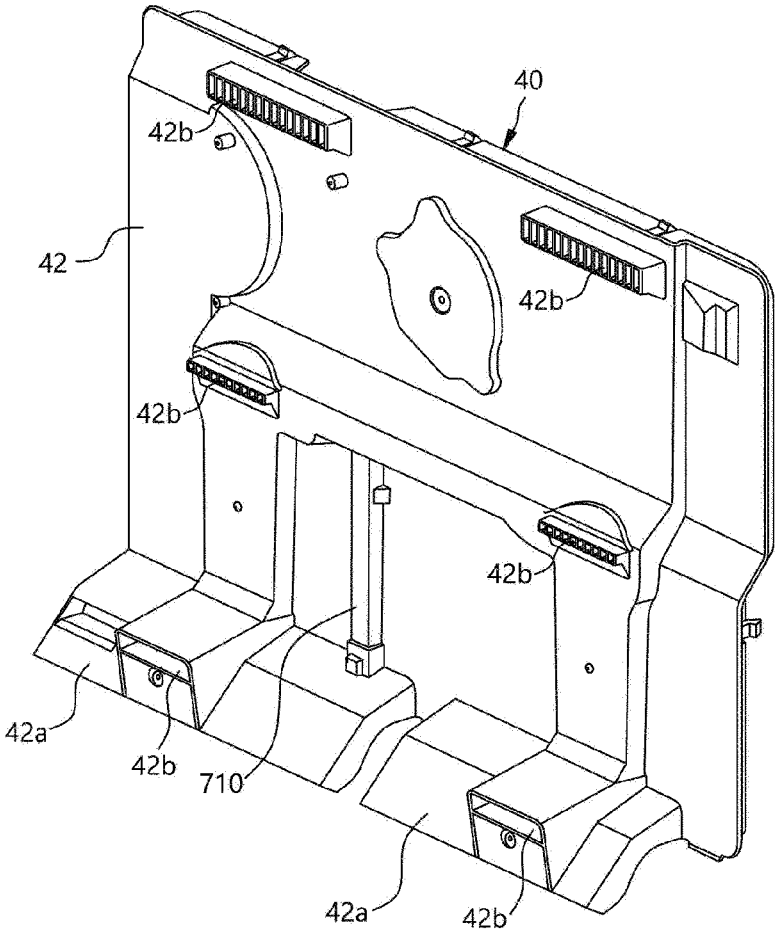

【Figure 10】
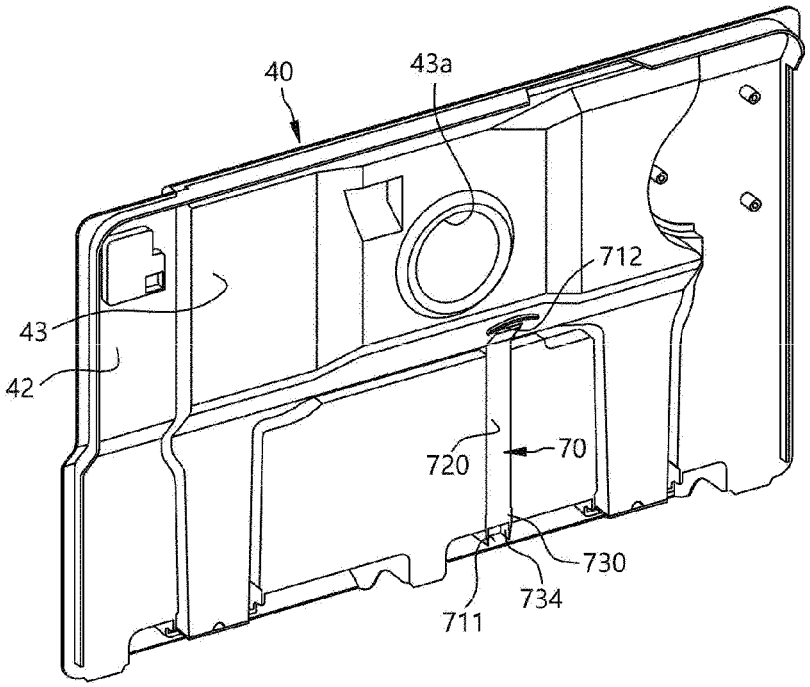

【Figure 11】
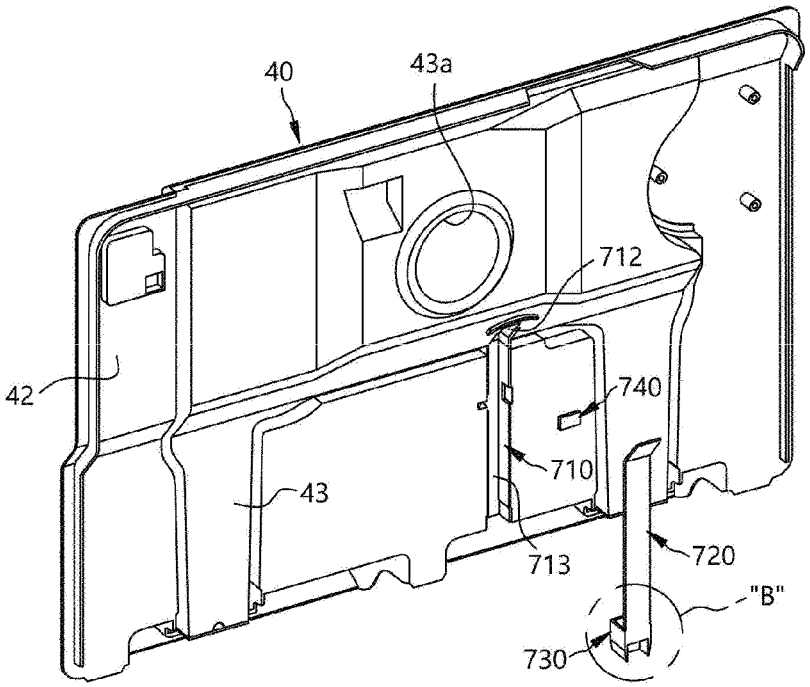

【Figure 12】
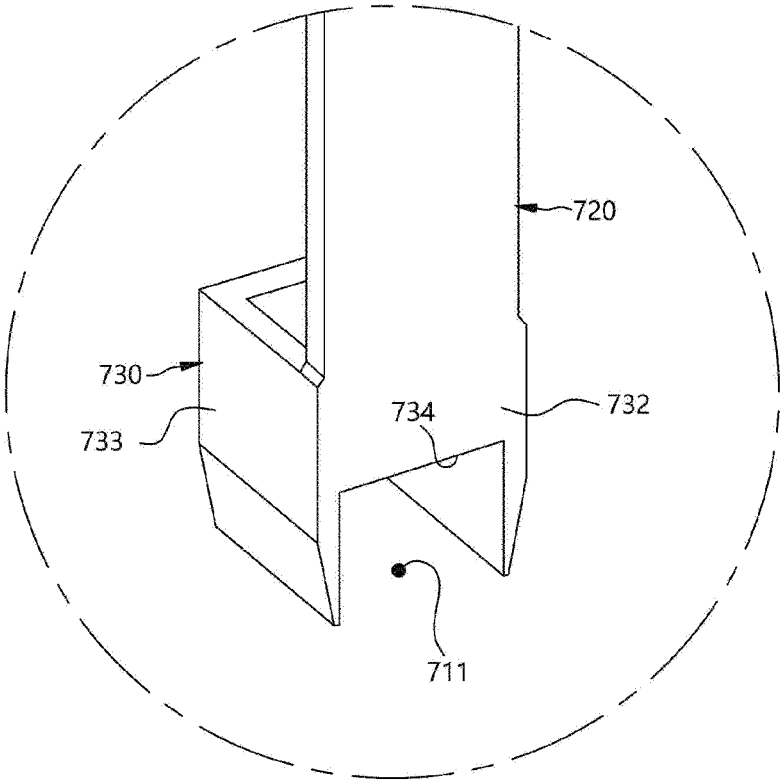

【Figure 13】
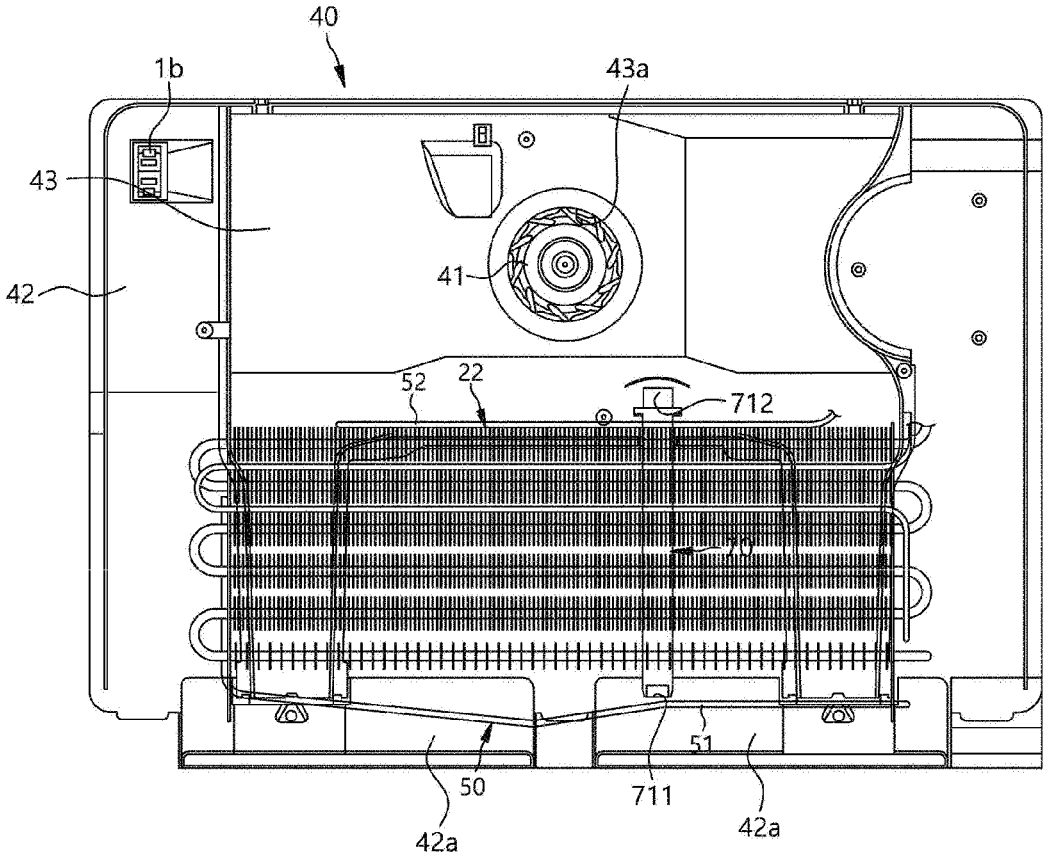

【Figure 14】
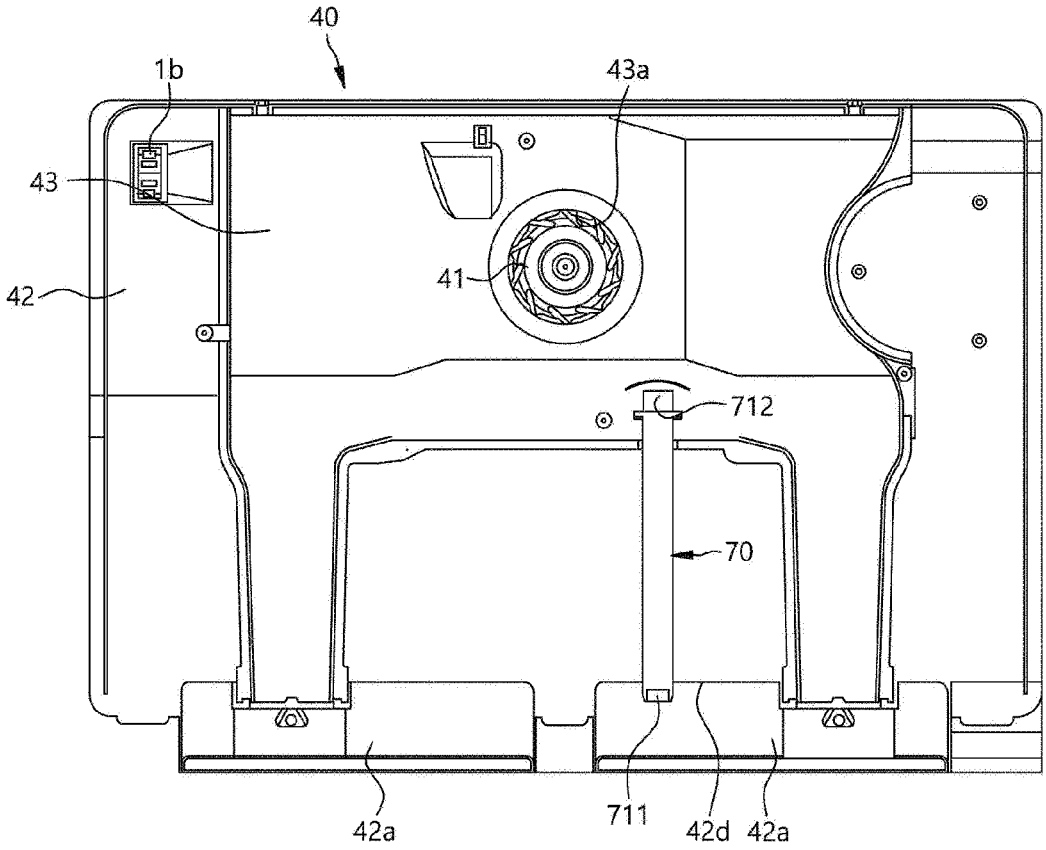

【Figure 15】
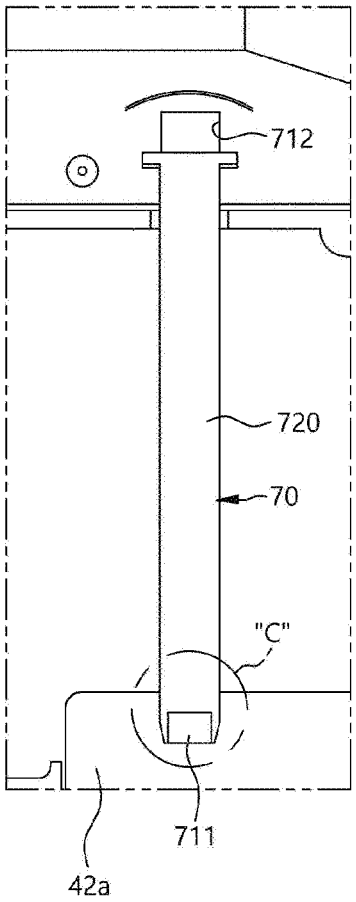

【Figure 16】
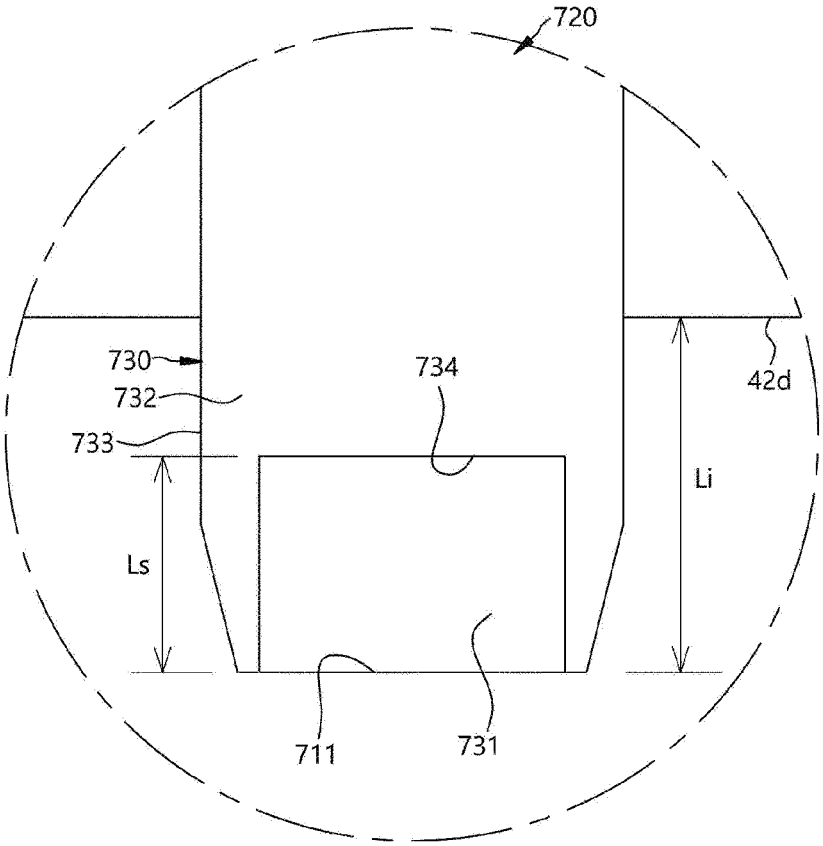

【Figure 17】
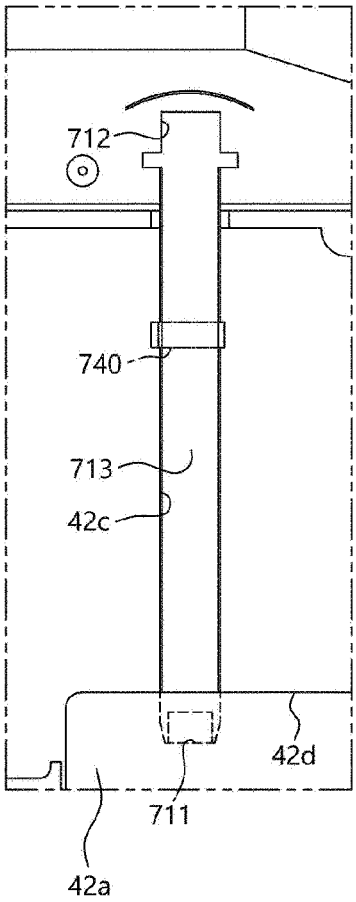

【Figure 18】
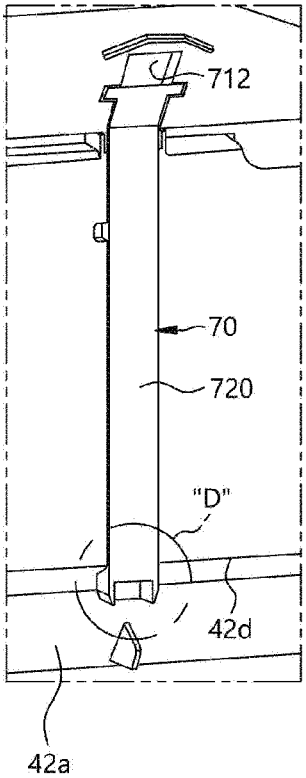

【Figure 19】
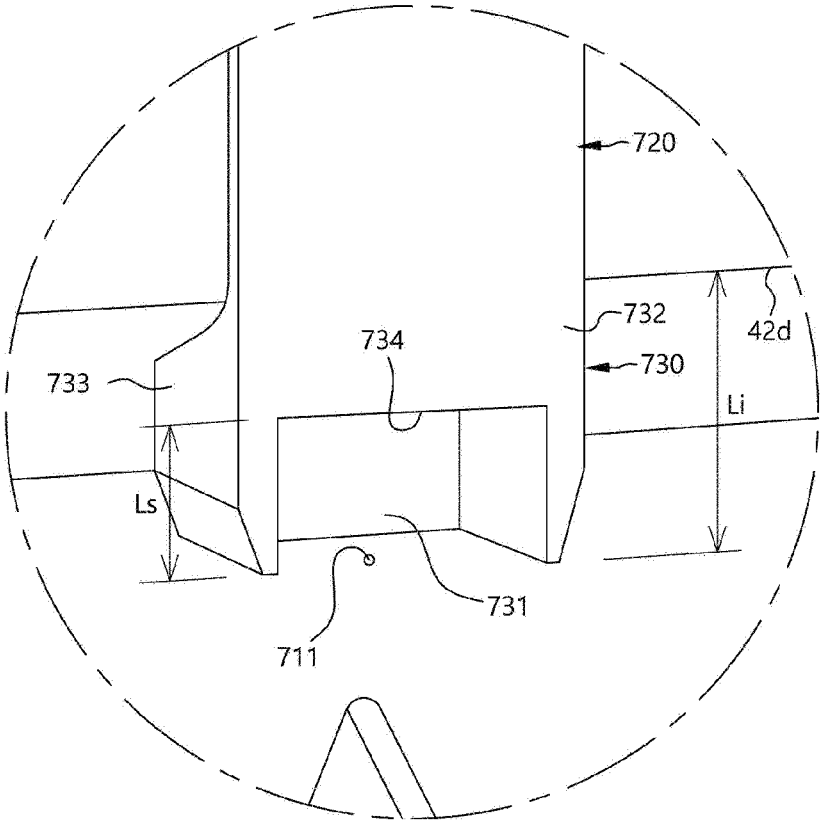

【Figure 20】

| Protruding length (Li)(mm) | 0 | | 5 | | 10 | | 15 | | 20 | |
|---|---|---|---|---|---|---|---|---|---|---|
| Flow rate (CMM) | Before frosting | after frosting | Before frosting | after frosting | Before frosting | after frosting | Before frosting | after frosting | Before frosting | after frosting |
| | 0.014 | 0.033 | 0.010 | 0.032 | 0.004 | 0.030 | 0.001 | 0.029 | 0.001 | 0.025 |
| Flow rate difference (CMM) | 0.019 | | 0.022 | | 0.026 | | 0.028 | | 0.025 | |
| velocity of flow (m/s) | Before frosting | after frosting | Before frosting | after frosting | Before frosting | after frosting | Before frosting | after frosting | Before frosting | after frosting |
| | 0.92 | 2.38 | 0.68 | 2.26 | 0.26 | 2.12 | 0.05 | 2.05 | 0.04 | 1.80 |
| velocity of flow difference (m/s) | 1.46 | | 1.58 | | 1.87 | | 2.00 | | 1.76 | |

【Figure 21】

| Slot length (Ls)(mm) | 0 | | 5 | | 10 | | 15 | |
|---|---|---|---|---|---|---|---|---|
| Flow rate (CMM) | Before frosting | after frosting | Before frosting | after frosting | Before frosting | after frosting | Before frosting | after frosting |
| | 0.006 | 0.031 | 0.005 | 0.0031 | 0.002 | 0.031 | 0.001 | 0.029 |
| Flow rate difference (CMM) | 0.0256 | | 0.026 | | 0.028 | | 0.028 | |
| velocity of flow (m/s) | Before frosting | after frosting | Before frosting | after frosting | Before frosting | after frosting | Before frosting | after frosting |
| | 0.40 | 2.20 | 0.35 | 2.16 | 0.15 | 2.15 | 0.05 | 2.05 |
| velocity of flow difference (m/s) | 1.80 | | 1.81 | | 2.00 | | 2.00 | |

【Figure 22】
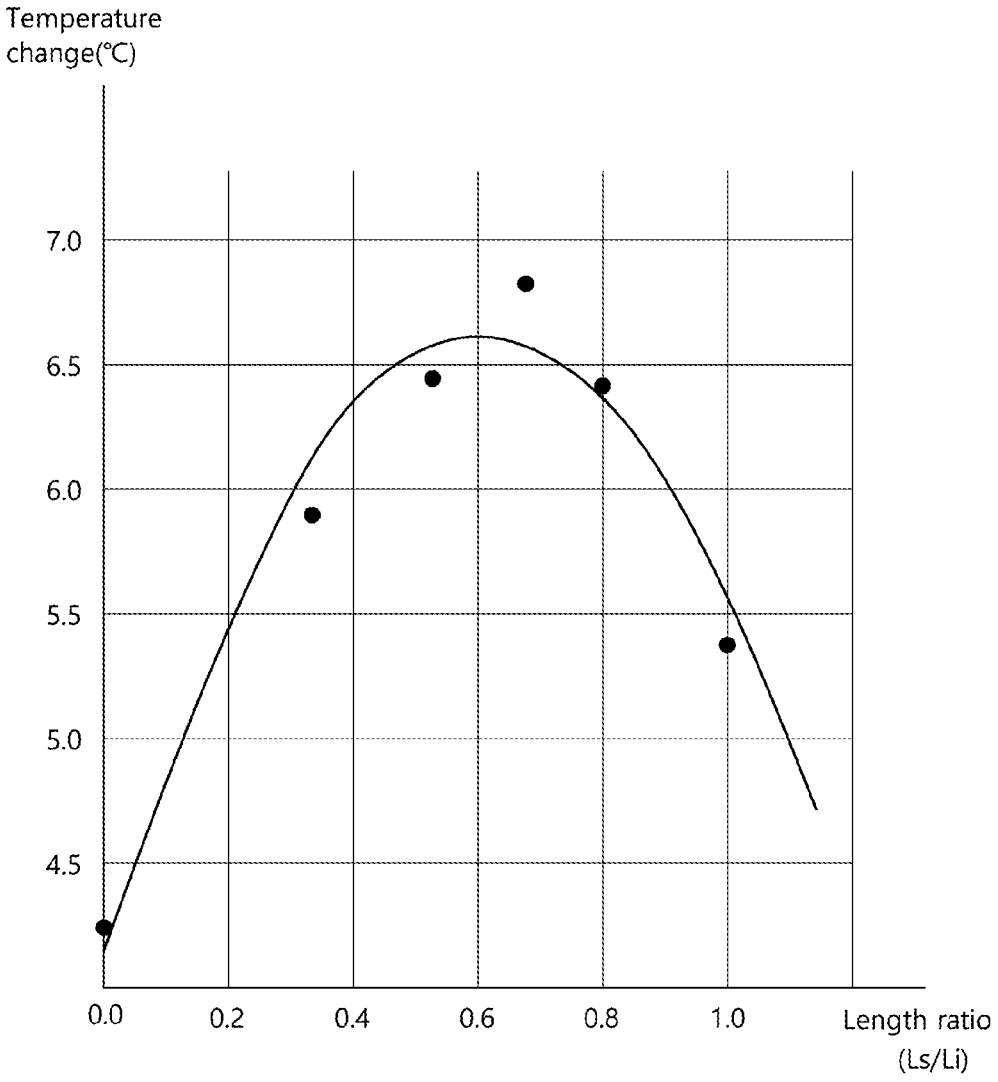

【Figure 23】
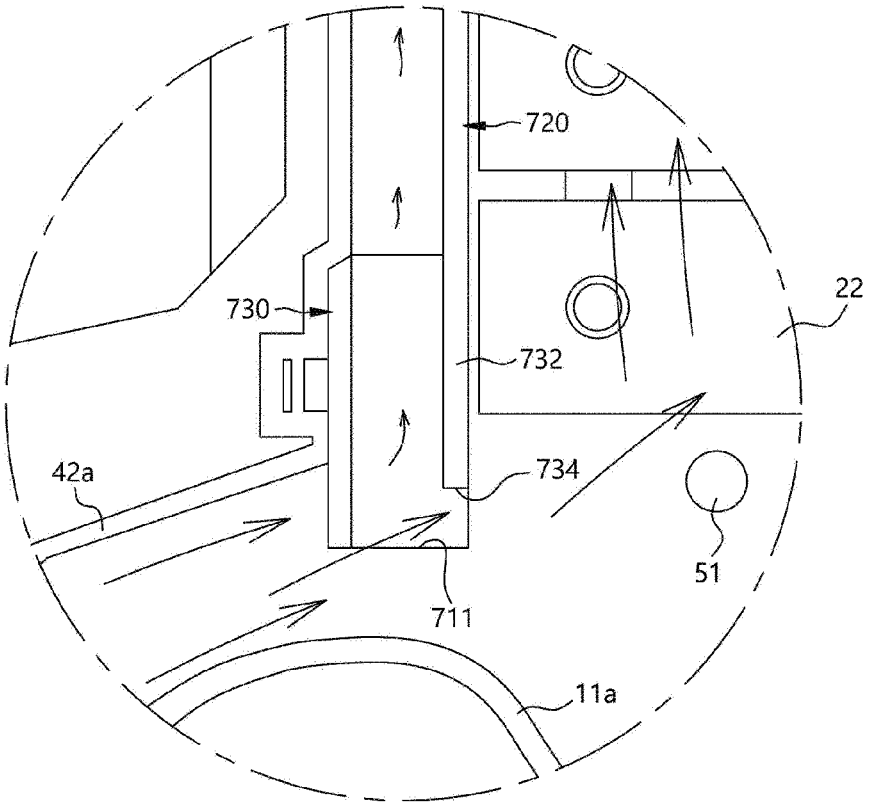

【Figure 24】
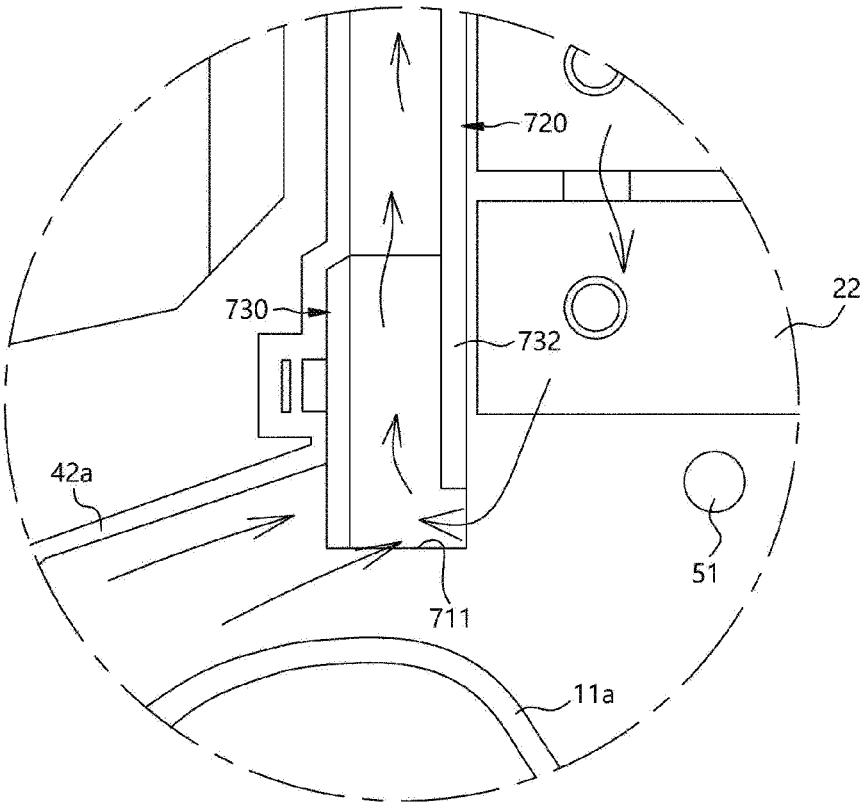
【Figure 25】
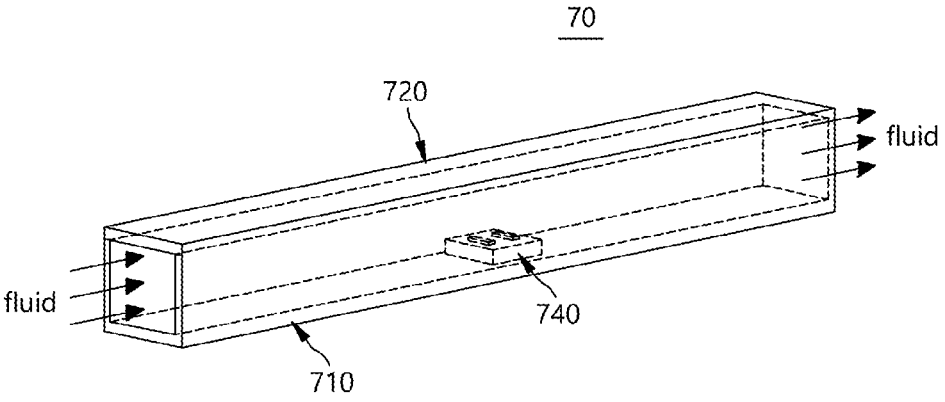

【Figure 26】
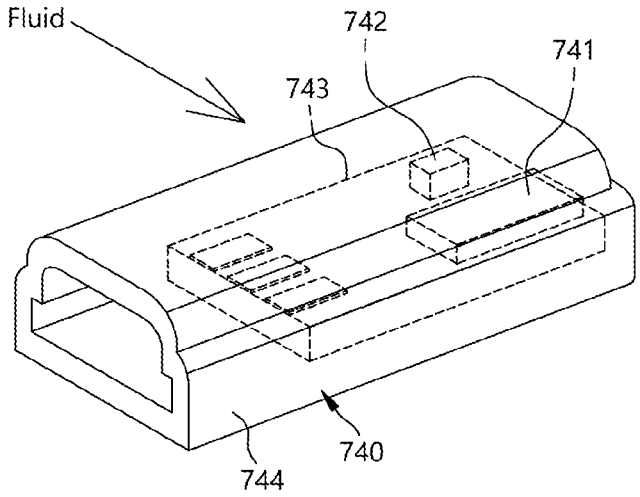

【Figure 27】
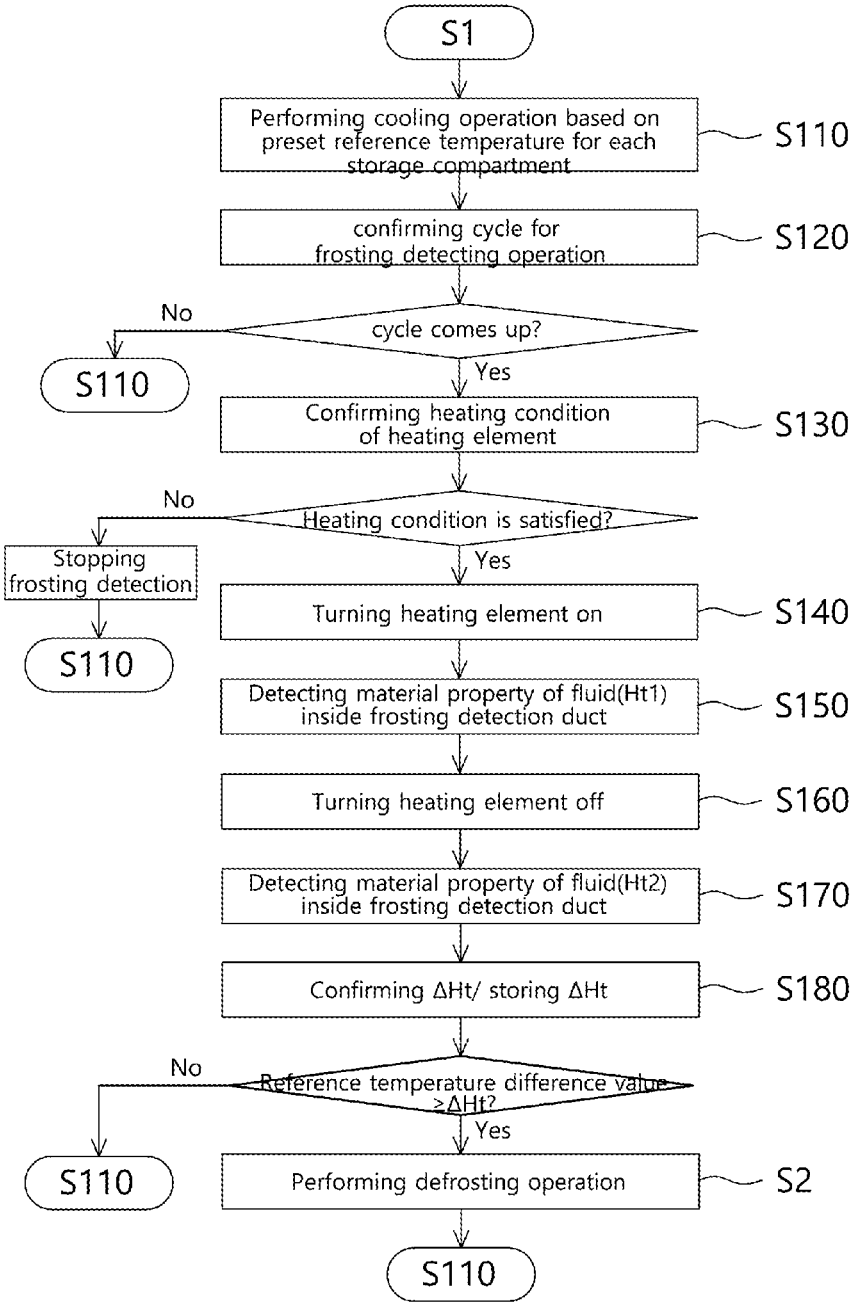

【Figure 28】
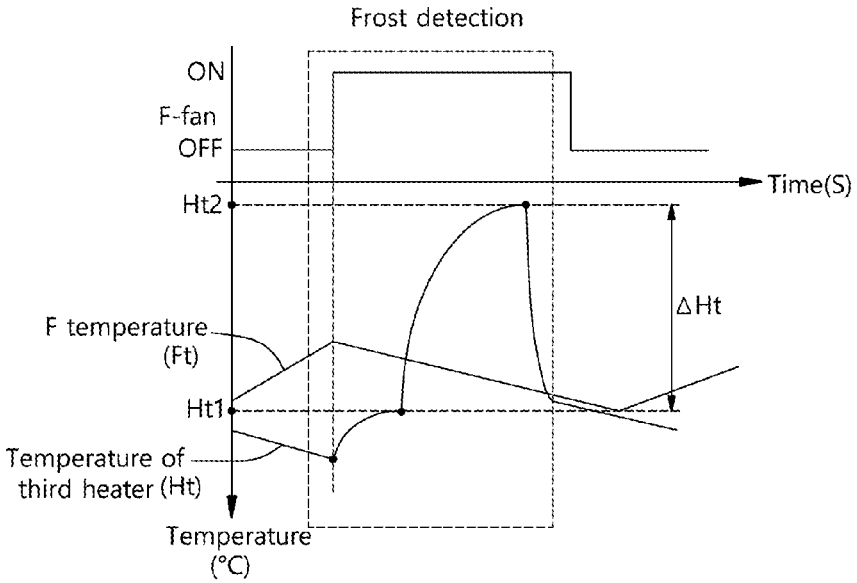

【Figure 29】
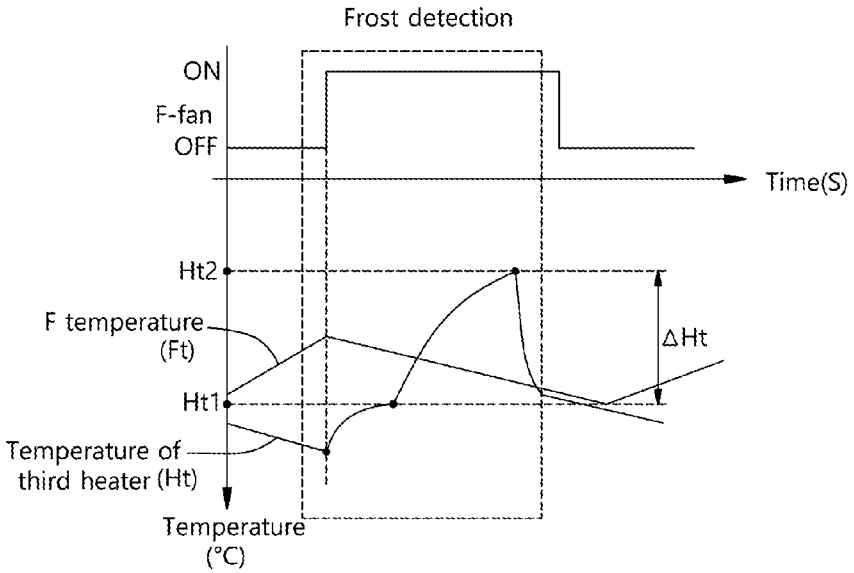
【Figure 30】
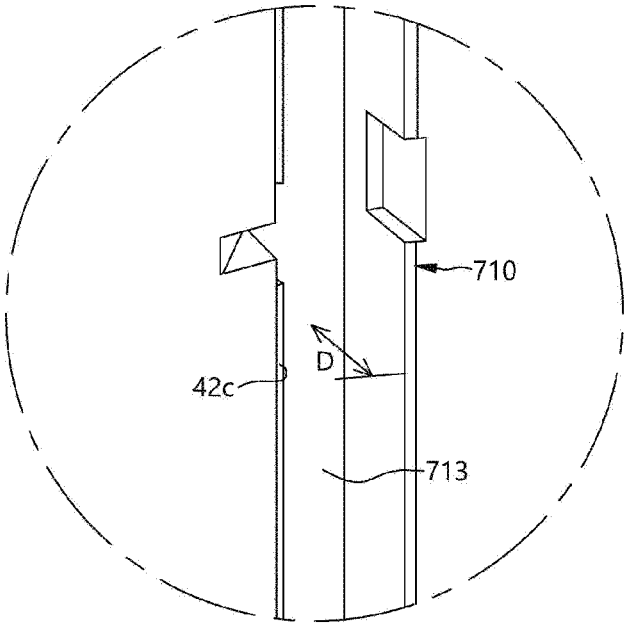

【Figure 31】
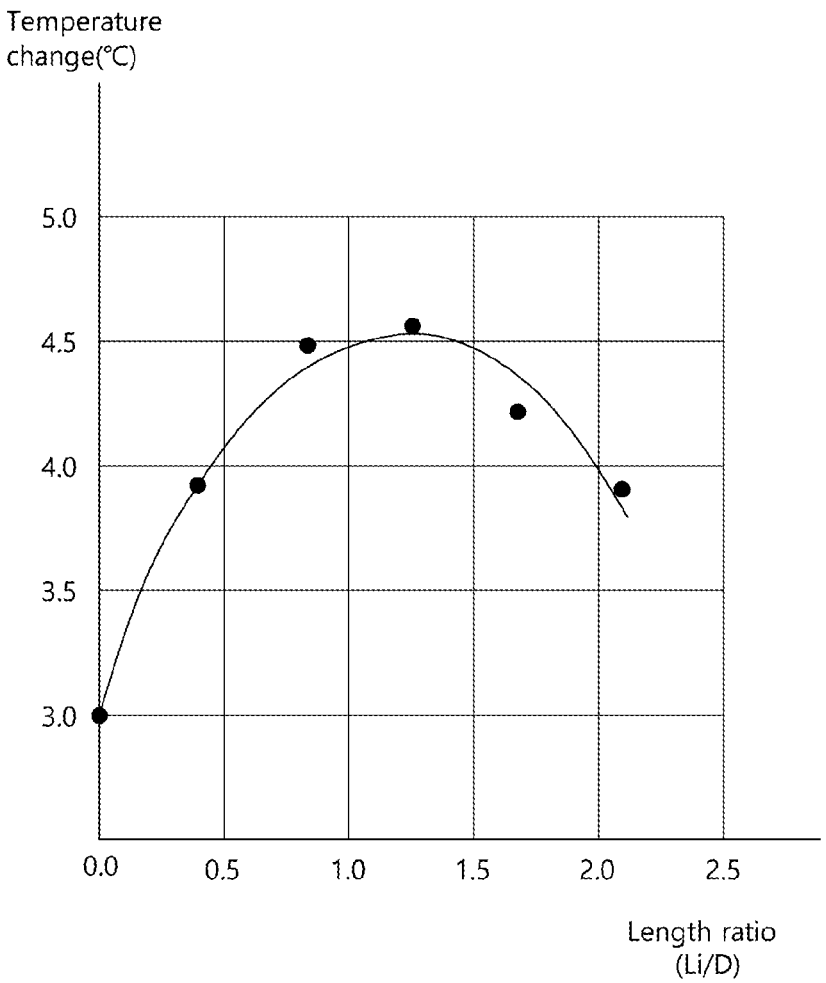

【Figure 32】
| Length ratio (Li/D) | | Temperature change | Logic temperature | Logic |
|---|---|---|---|---|
| Min | Max | | | |
| 1.0D | 1.5D | 4.5deg | 36deg | Clogging in flow path |
| 0.7D | 1.8D | 4.3deg | 34deg | Initial temperature after defrosting |
| 0.3D | 2.1D | 3.8deg | 30deg | Detecting remaining ice |
| 0.2D | 2.2D | 3.5deg | 28deg | Logic temperature |
| 0.0D | 2.5D | 3.0deg | 24deg | Inserting defrosting |
【Figure 33】
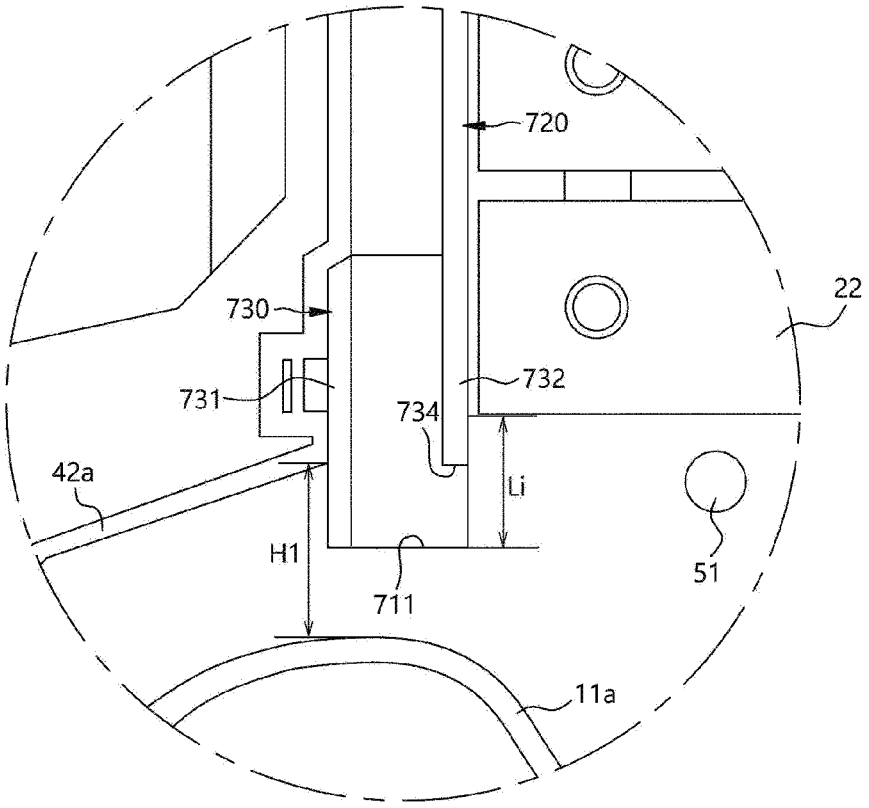

【Figure 34】
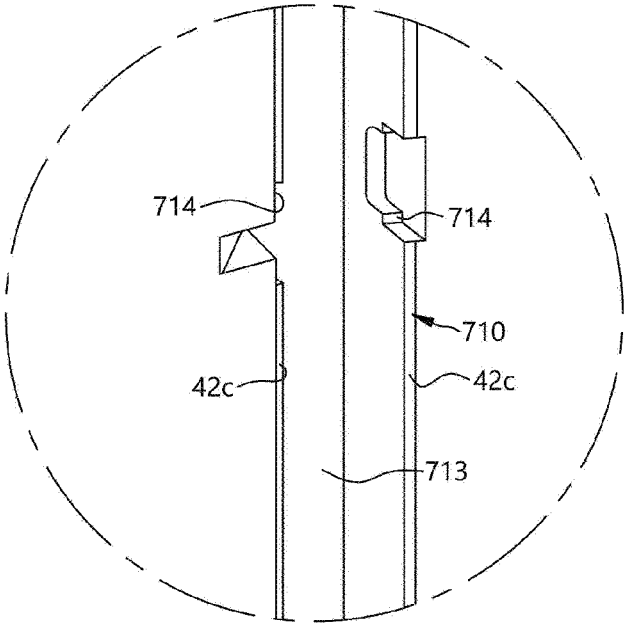

【Figure 35】
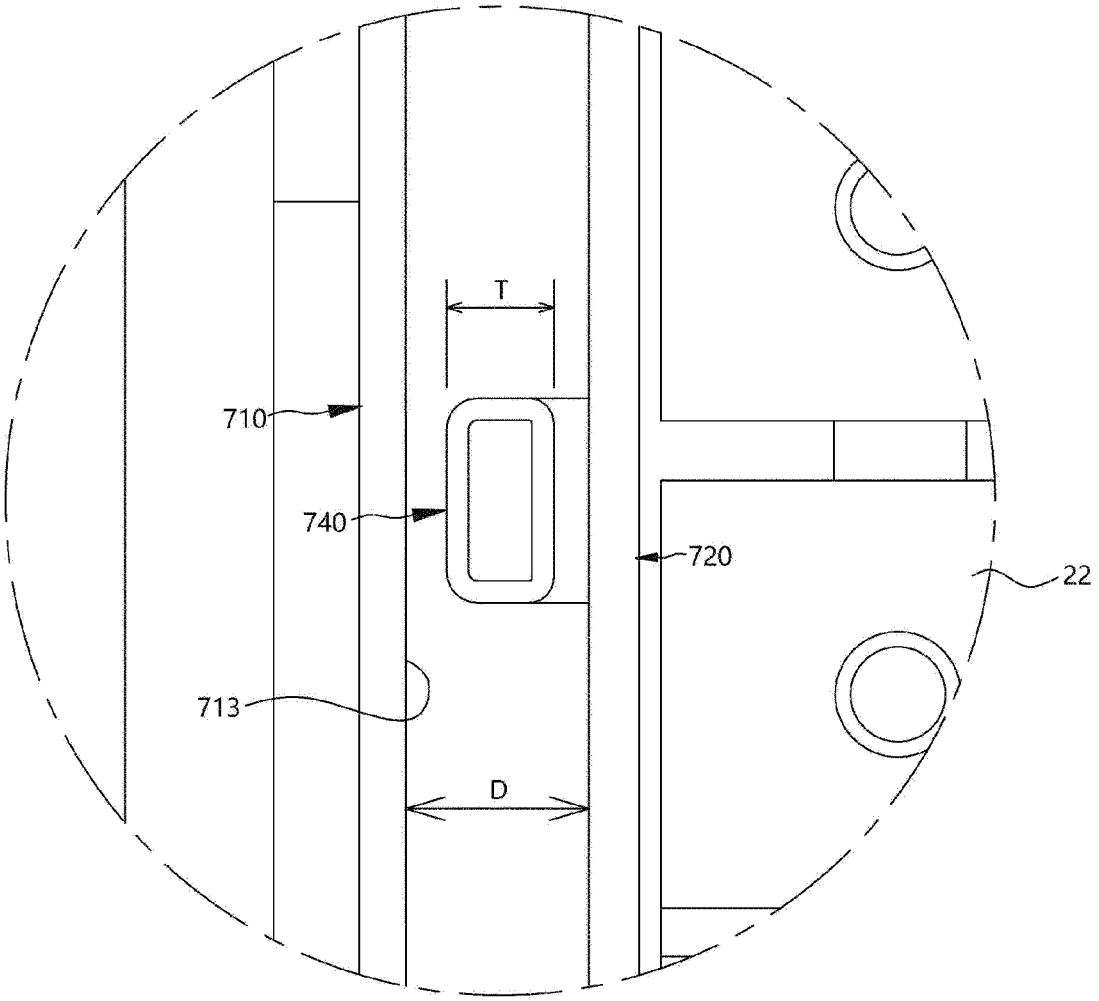

【Figure 36】
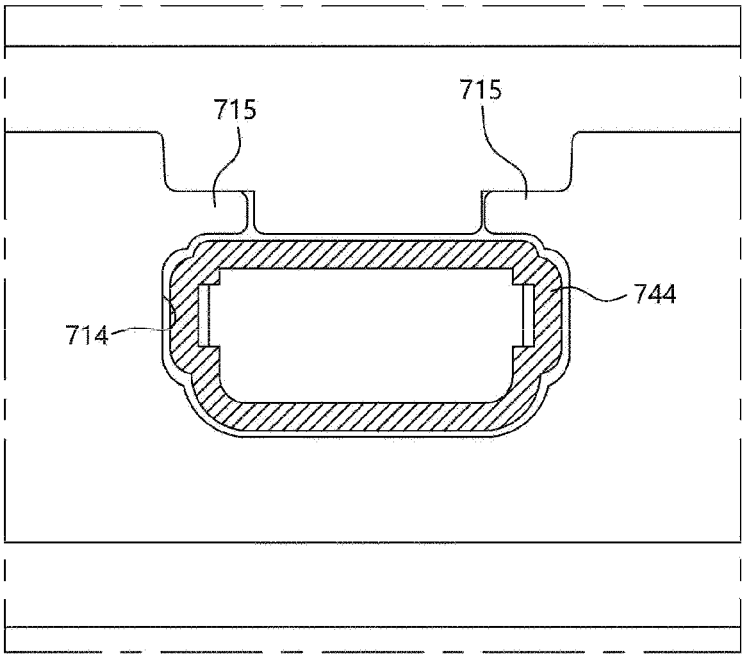
【Figure 37】
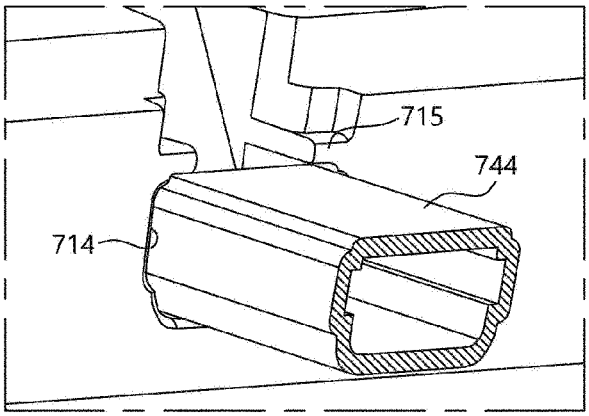

【Figure 38】
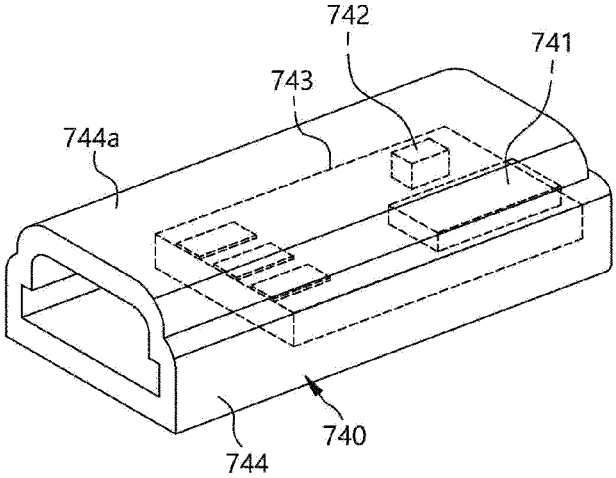
【Figure 39】
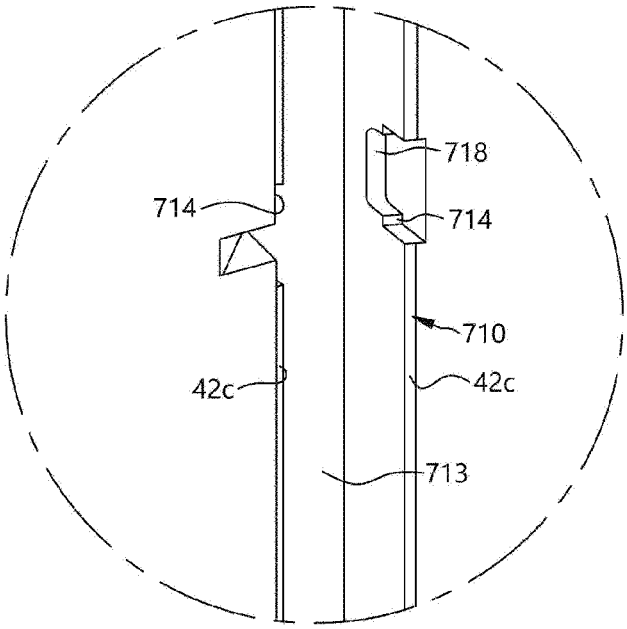

【Figure 40】
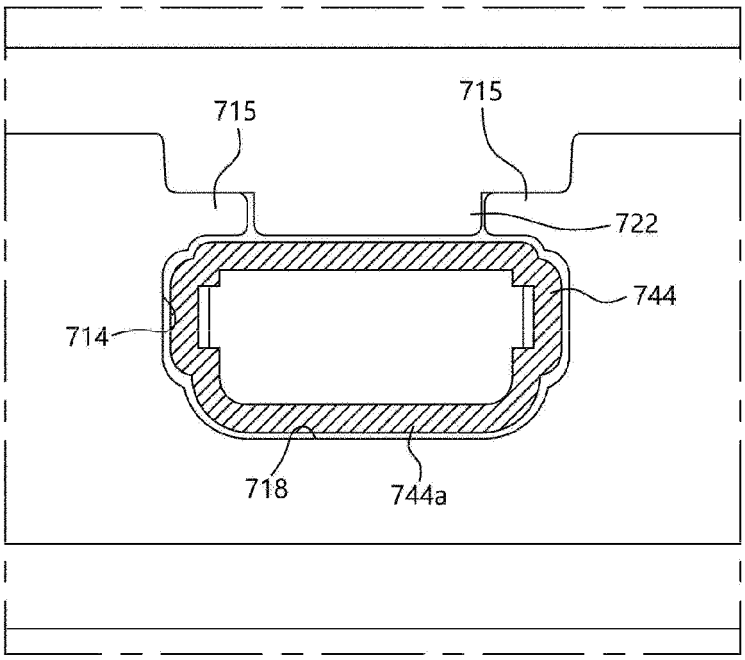
【Figure 41】
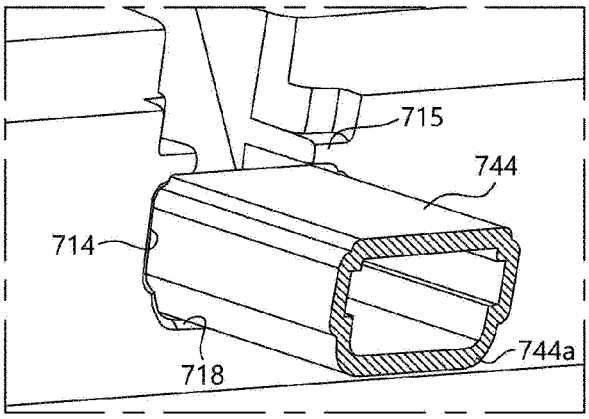

【Figure 42】
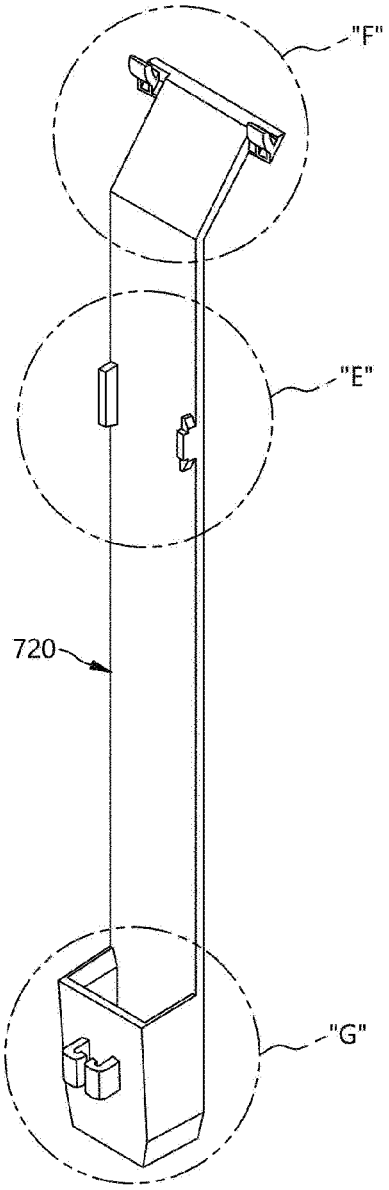

【Figure 43】
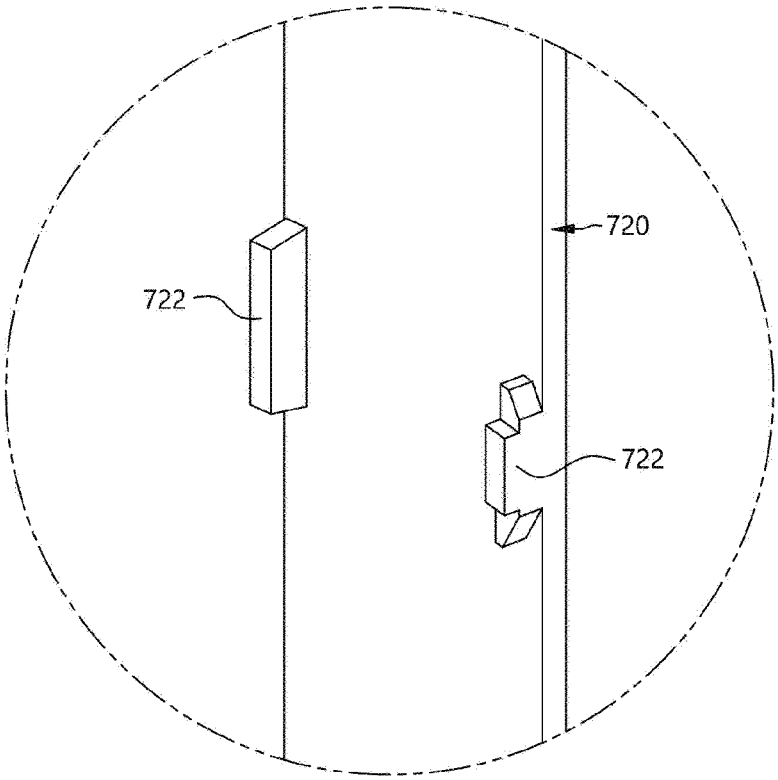

【Figure 44】
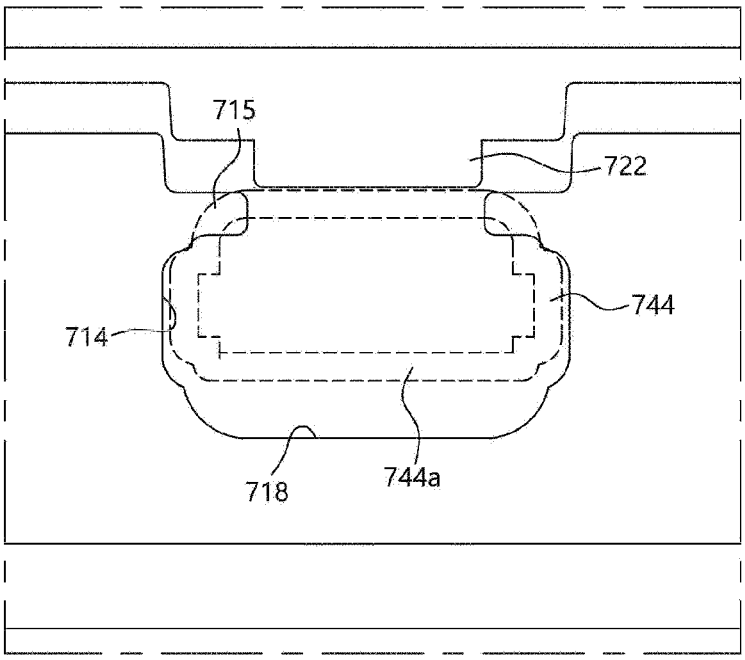

【Figure 45】
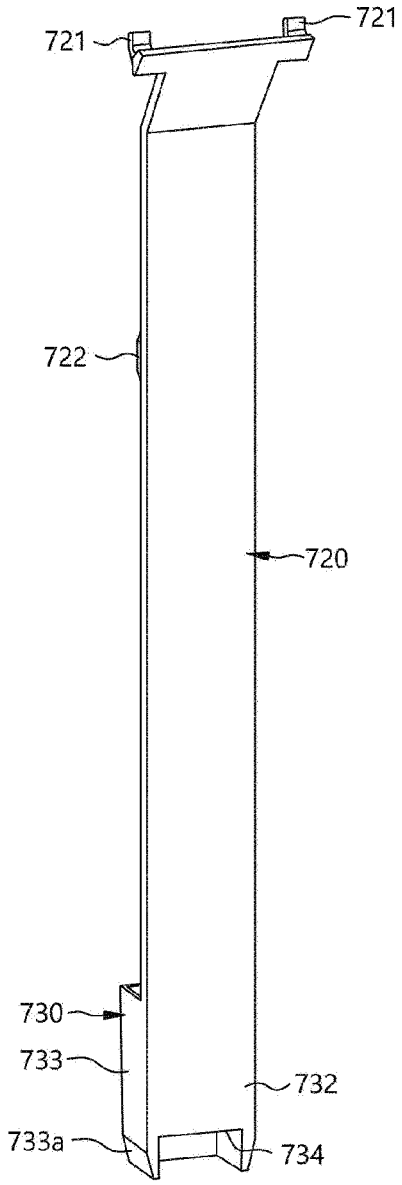

【Figure 46】
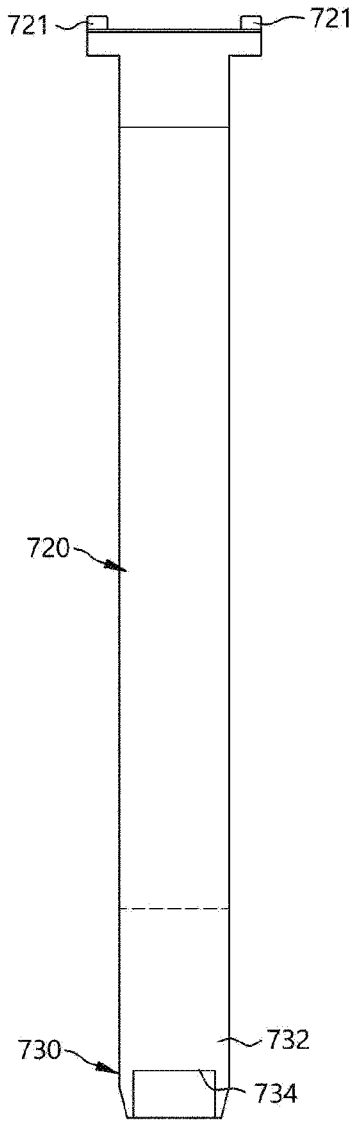

【Figure 47】
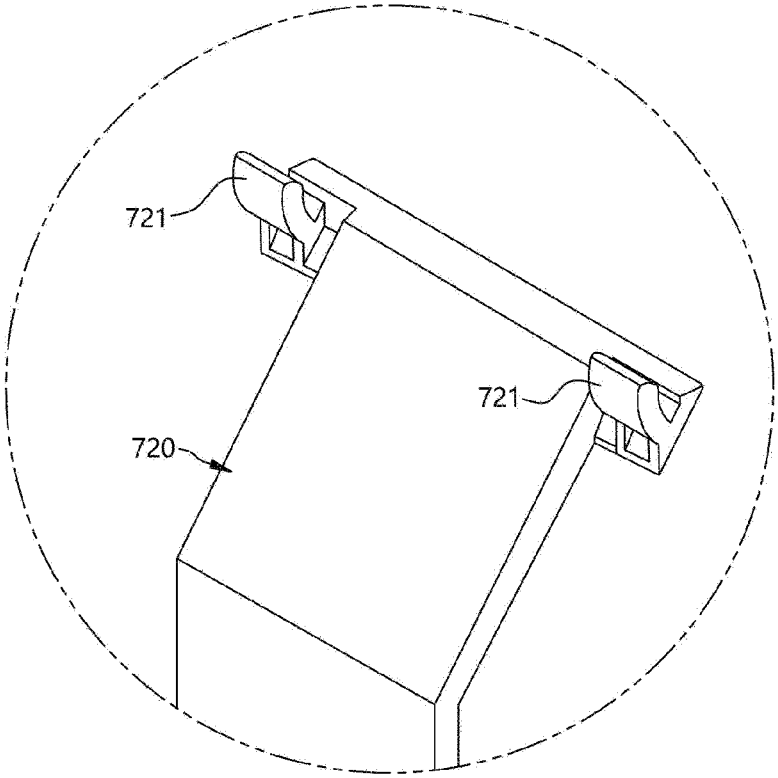

【Figure 48】
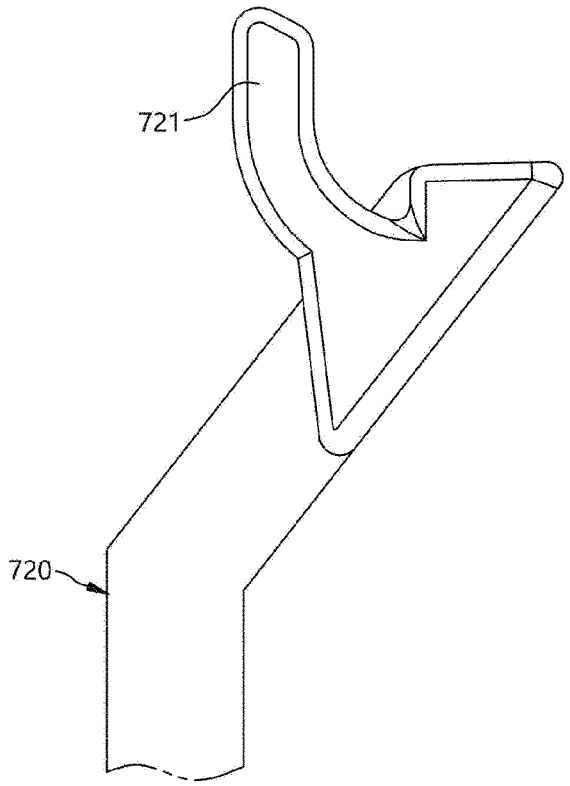

【Figure 49】
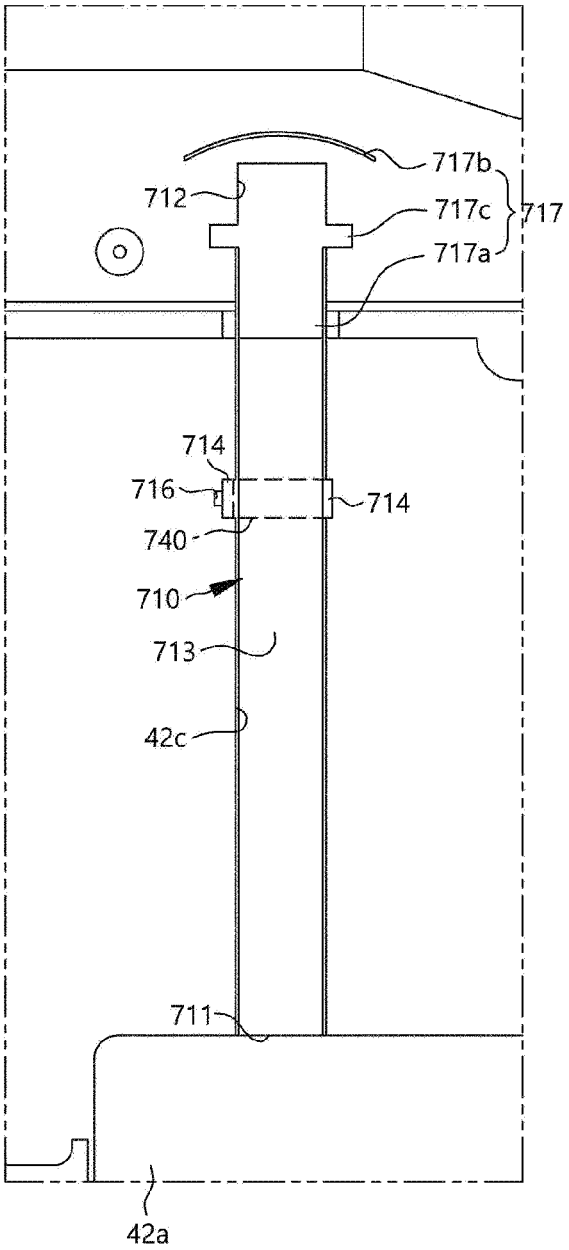

【Figure 50】
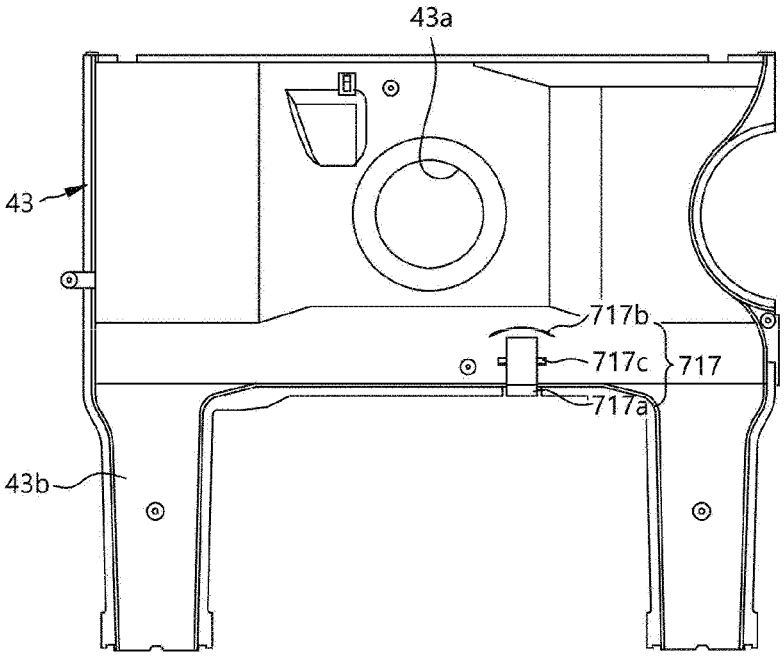

【Figure 51】
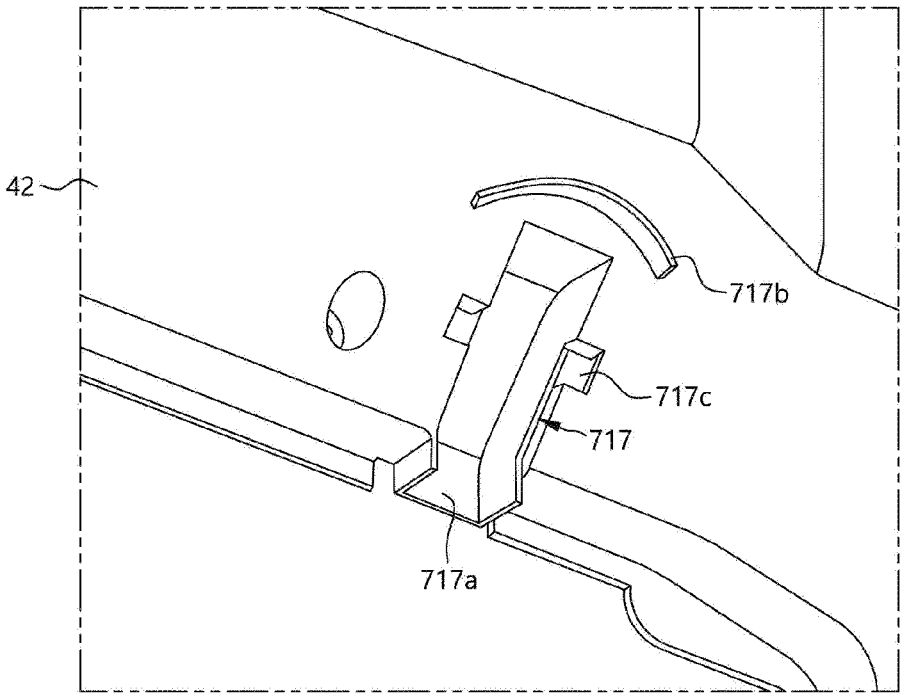

【Figure 52】
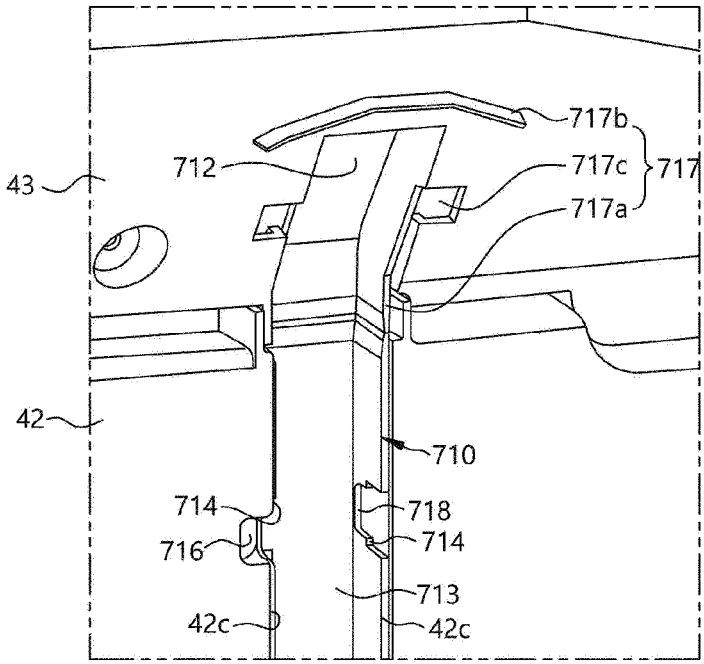

【Figure 53】
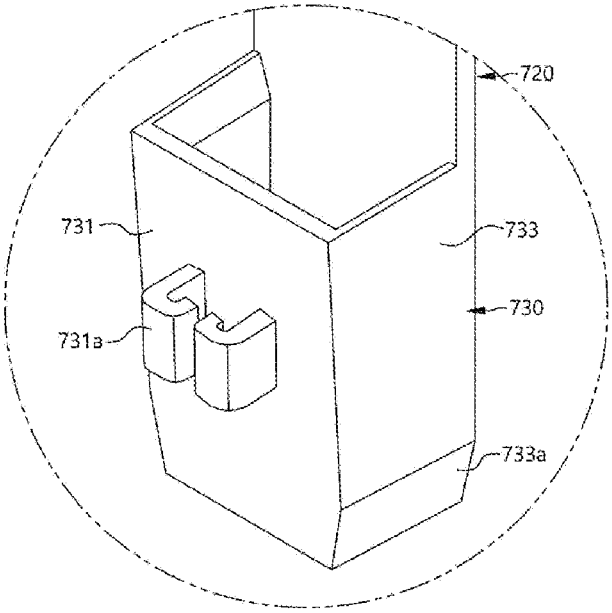
【Figure 54】
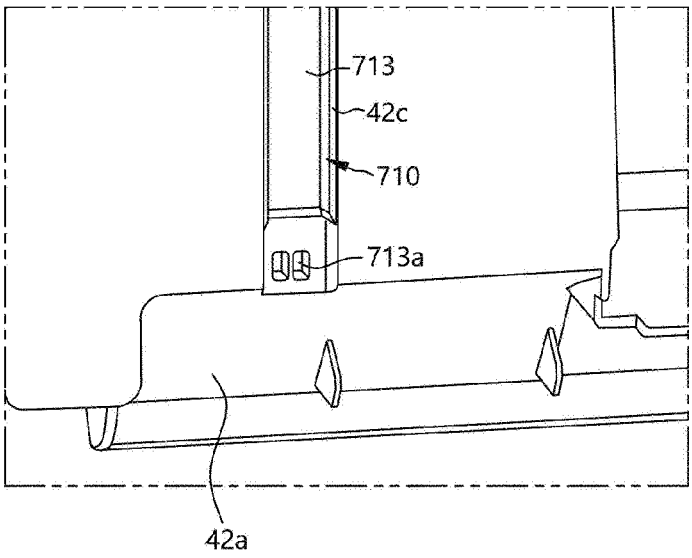

【Figure 55】
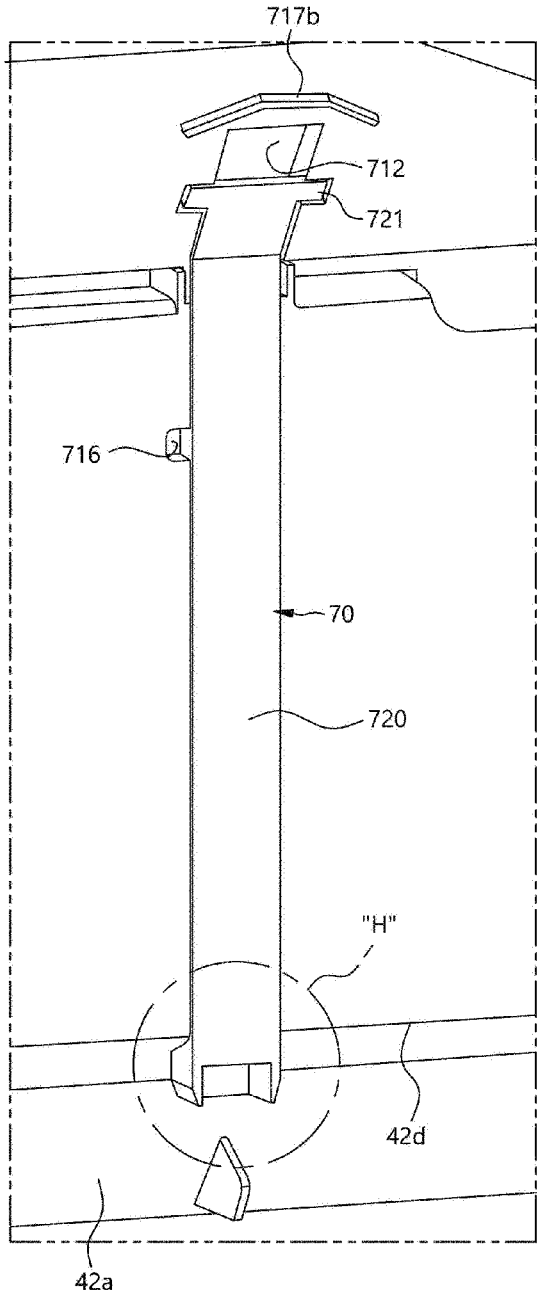

【Figure 56】
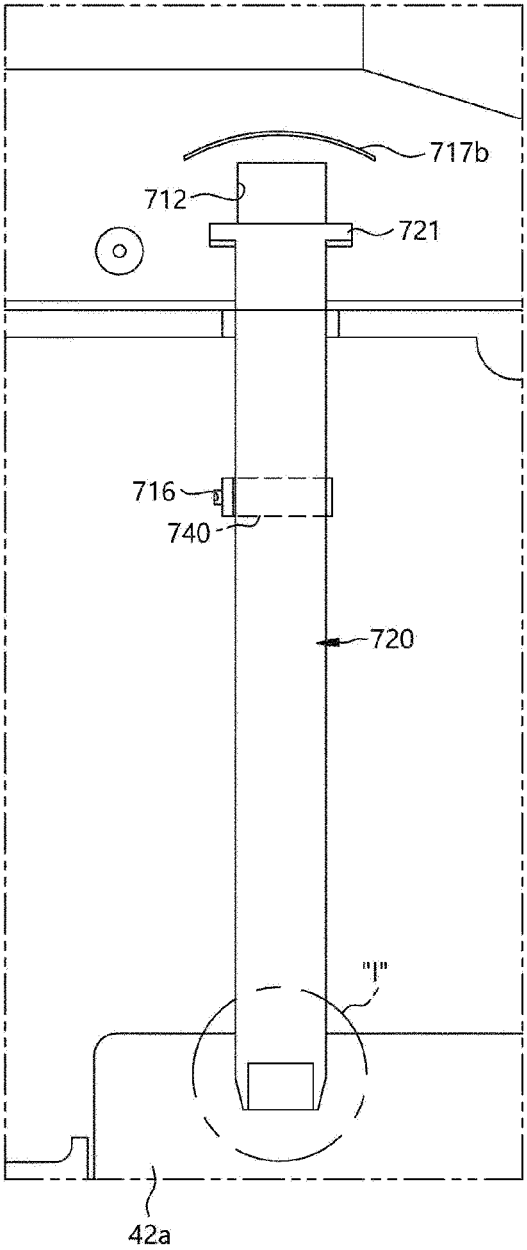

【Figure 57】
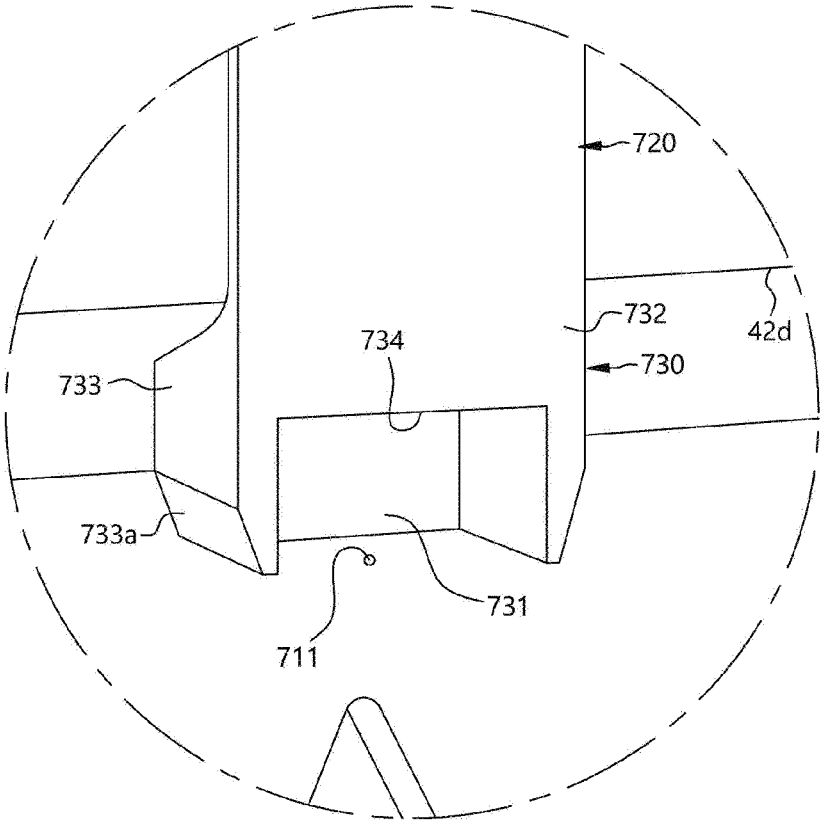

【Figure 58】
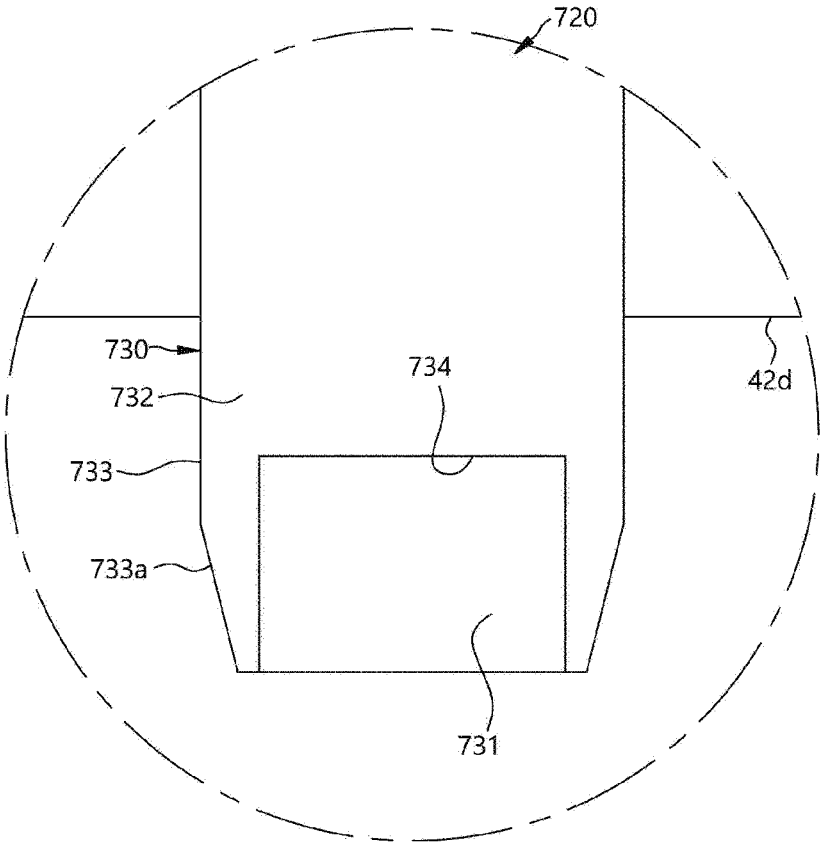

【Figure 59】
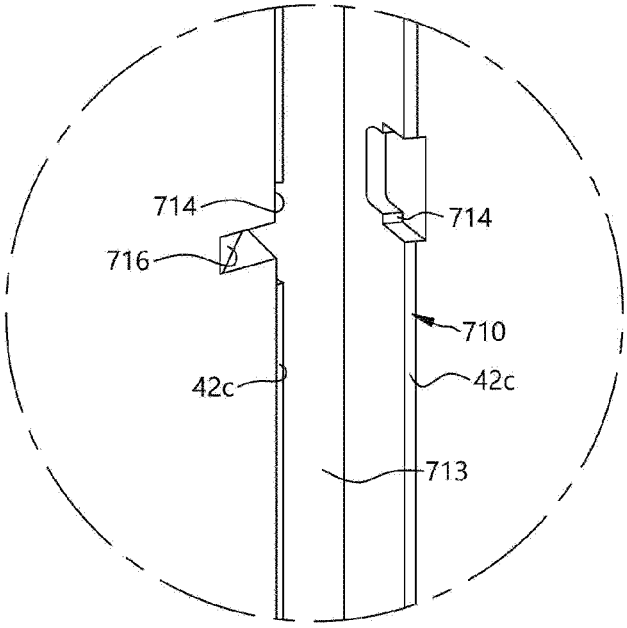

【Figure 60】
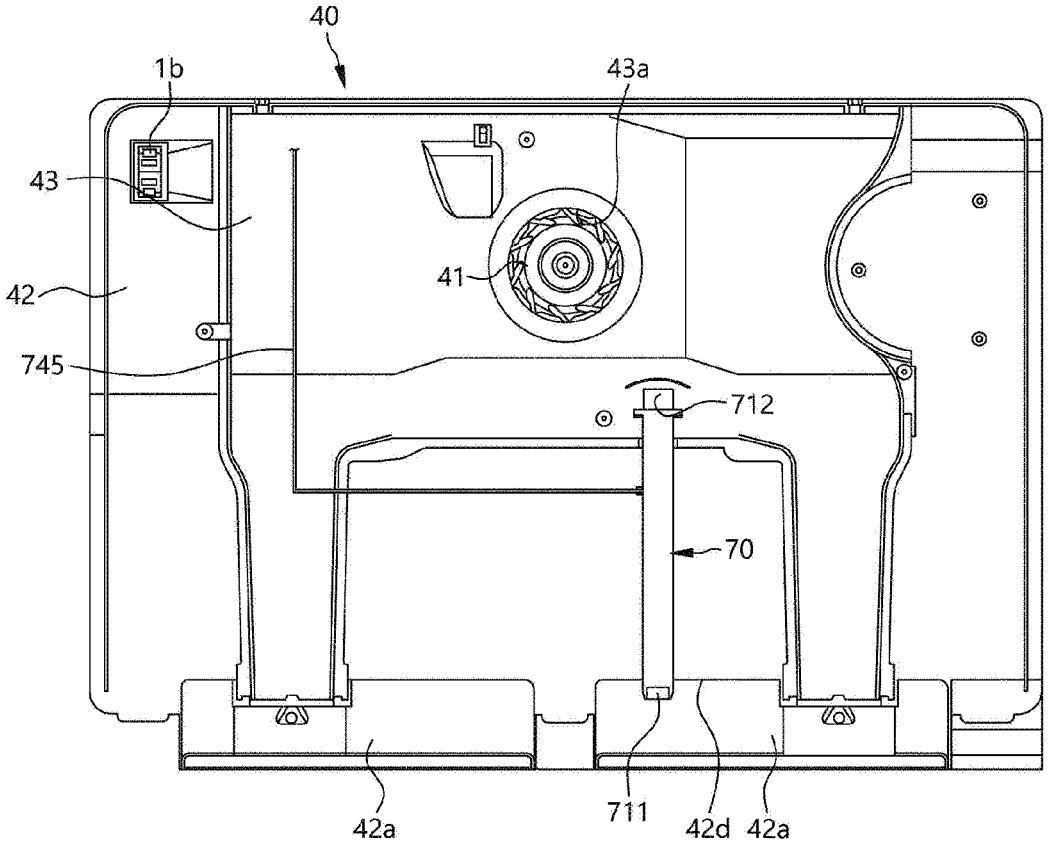

REFRIGERATOR

CROSS-REFERENCE TO RELATED APPLICATIONS

This application is a National Stage of International Application No. PCT/KR2021/009259, filed on Jul. 19, 2021, which claims the benefit of Korean Patent Application No. 10-2020-0098360, filed on Aug. 6, 2020, Korean Patent Application No. 10-2020-0098361, filed on Aug. 6, 2020, and Korean Patent Application No. 10-2020-0098365, the contents of which are all hereby incorporated by reference herein in their entirety.

TECHNICAL FIELD

The present disclosure relates to a refrigerator including a frosting detecting device.

BACKGROUND

In general, a refrigerator is an appliance that uses cold air to store objects in a storage space for a long time or while maintaining at a constant temperature.

The refrigerator includes a refrigeration system including one or more evaporators to generate and circulate the cold air.

Herein, the evaporator serves to maintain internal air of the refrigerator within a preset temperature range by exchanging heat between a low-temperature and low-pressure refrigerant with the internal air of the refrigerator (cold air circulating inside the refrigerator).

Frost is generated on a surface of the evaporator due to water or humidity contained in the internal air of the refrigerator or moisture existing around the evaporator during heat exchange with the internal air of the refrigerator.

Conventionally, when a certain time elapses after the operation of the refrigerator started, a defrosting operation is performed to remove frost generated on the surface of the evaporator.

In other words, conventionally, the defrosting operation is performed through indirect estimation based on the operation time, rather than directly detecting the amount of frost generated on the surface of the evaporator.

Accordingly, conventionally, the defrosting operation is performed even though the frosting is not generated, and thus, there are problems in that energy consumption efficiency is reduced or the defrosting operation is not performed despite excessive frosting.

Specifically, the defrosting operation is performed by allowing a heater to emit heat and raise the temperature around the evaporator so that defrosting is performed. After the defrosting operation is performed as described above, a large load operation is performed so that the internal temperature of the refrigerator quickly reaches a preset temperature, resulting in large power consumption.

Accordingly, conventionally, various studies have been made to shorten the time for the defrosting operation or the cycle of the defrosting operation.

In recent years, in order to accurately detect the amount of frosting on the surface of the evaporator, a method using temperature difference or pressure difference between an inlet side and an outlet side of the evaporator has been proposed, and the method was disclosed in Korean Patent Application Publication No. 10-2019-0101669 (Patent Document 1), Korean Patent Application Publication No. 10-2019-0106201 (Patent Document 2), Korean Patent Application Publication No. 10-2019-0106242 (Patent Document 3), Korean Patent Application Publication No. 10-2019-0112482 (Patent Document 4), Korean Patent Application Publication No. 10-2019-0112464 (Patent Document 5), etc.

The above documents describe a frosting detection duct (bypass flow path) formed in a cold air duct to have a separate flow from an air flow passing through the evaporator and the amount of frosting is detected by measuring a temperature difference change in response to a difference of air amount passing through the frosting detection duct due to the frosting on the evaporator.

Accordingly, the amount of actual frosting may be detected, and based on the amount of frosting detected above, a start time of defrosting operation may be precisely determined.

Meanwhile, in order to increase detection reliability with respect to the amount of frosting on the evaporator, it is preferable that the amount of air passing through the frosting detection duct changes significantly when compared with before frosting and during frosting.

A method of increasing a difference of the amount of air may be variously achieved.

In patent document 1, in order to increase the reliability of frosting detection, a location of a sensor, a control method of a controller, a structure by which a fluid inlet part (barrier) protrudes from a frosting detection duct, locations of an inlet and an outlet of the frosting detection duct, etc., have been proposed.

Specifically, in patent document 1, it is mentioned that a protruding length of the fluid inlet part may be preset at a value that is within 10 mm or more and 17 mm or less.

However, in the protruding structure of the fluid inlet part (barrier) proposed in patent document 1, the protruding length of the fluid inlet part and a length of a slot are presented as numerical values, and when the duct is changed for each model of a refrigerator, actually, it is difficult to obtain an identical effect.

Of course, in patent document 1, it is mentioned that the length of the slot may be designed within a range of ⅕ to ½ of the protruding length of the fluid inlet part.

However, the relationship between the slot and the protruding length is just considering a preferable length range of the slot and a preferable protruding length range of the fluid inlet part.

Accordingly, when when it is designed in the relationship of the two length ranges proposed in patent document 1 (length of slot is designed within range of ⅕ to ½ of protruding length of fluid inlet part), inflow of air flowing back into the frosting detection duct during frosting is insufficient, and thus a temperature difference is also insufficient to have high discrimination.

Specifically, due to insufficient air inflow rate during frosting, the discrimination for frosting detection is deteriorated so that it is difficult to perform precise frosting detection, and thus a performing time of defrosting operation is imprecise and entire degradation of the power consumption efficiency is inevitable.

Moreover, the protruding length of the fluid inlet part is related to not only the length of the slot, but also an internal depth of the frosting detection duct. But in patent document 1, the relationship between the protruding length and the internal depth of the frosting detection duct is not mentioned.

In other words, when the protruding length of the fluid inlet part or the length of the slot is designed without considering the internal depth of the frosting detection duct, it is possible to obtain only the discrimination according to a temperature difference value sufficient to confirm whether or not frosting occurs, but the discrimination sufficient to confirm other frosting-related information cannot be obtained.

Specifically, in patent document 4, a method of determining freezing of a cooling fan or clogging of the frosting detection duct is performed by confirming whether or not a temperature difference value between the minimum temperature and the maximum temperature when a heating element emits heat reaches a reference value.

However, considering only the protruding length of the fluid inlet part, it is inevitably difficult to obtain a temperature difference value sufficient to determine clogging of the frosting detection duct.

In other words, when the protruding length of the fluid inlet part is not considered together with the internal depth of the frosting detection duct, it is not possible to secure enough discrimination to determine clogging of the frosting detection duct.

In addition, when detecting frosting, a difference in temperature detected by the frosting detecting device should exceed at least 28° C. in order to have discrimination to recognize a variety of information related to frosting.

In this case, the variety of information related to the frosting may include not only detection of the frosting, but also clogging of the frosting detection duct, whether or not ice remains after defrosting, and the like.

However, as examples, each patent document above, since only the protruding length of the fluid inlet part of the length of the slot is considered, when detecting frosting, the frosting detecting device may detect only a difference in the temperature of about 26° C. to 28° C., and with that temperature difference, it is difficult to secure sufficient discrimination to identify and determine other information related to frosting.

In other words, the protruding length of the fluid inlet part affects the amount of fluid flowing into the frosting detection duct when the amount of frosting is small in the evaporator, but the length of the slot formed in the fluid inlet part affects the amount of fluid flowing into the frosting detection duct when frosting exists on the evaporator.

Accordingly, the protruding length of the fluid inlet part and the length of the slot should always be considered together so as to provide the highest temperature difference regardless of the amount of frosting.

Nonetheless, in the patent documents, since no research has been conducted to consider both the protruding length of the fluid inlet part and the length of the slot, the fluid inlet part and the length of the slot have to be designed separately. Therefore, material properties detected during frosting detection do not provide the discrimination to detect not only frosting but also other information.

Furthermore, in the patent documents, while defrosting operation is performed, defrosting water generated as ice generated on the evaporator melts may flow into the frosting detection duct.

At this point, the defrosting water introduced into the frosting detection duct may not drain completely from the frosting detection duct due to a sensor located in the frosting detection duct and may partially remain in the frosting detection duct.

In other words, the temperature of the narrow and long frosting detection duct may remain below zero even during defrosting operation, and thus the defrosting water may freeze while flowing along the frosting detection duct.

However, in the patent documents, a structure for preventing the frosting detection duct from being blocked or the sensor from being frozen by the defrosting water flowing into the frosting detection duct has not been provided, and there is a problem that the frosting detection duct may be blocked or the sensor may be frozen due to the defrosting water or water remaining in the flow path.

Of course, there is a risk that the frosting detection duct may be shut off or the sensor may be frozen by condensate water caused by a temperature difference between the inside and outside of the frosting detection duct, not the defrosting water.

Furthermore, the frosting detection duct according to the patent documents may have a problem in that water flowing along an outer wall surface at a fluid inlet side may gradually freeze at the fluid inlet and block the fluid inlet.

In other words, in those frosting detection duct, there is a phenomenon in which water present on the outer wall surface at the fluid inlet side may not fall from the fluid inlet portion and remains, and that remaining water freezes and blocks the fluid inlet.

Furthermore, a known method for detecting frosting is to install the heating element and a detection element for detecting frosting to be sequentially located in a flowing direction of the fluid.

However, the sensor may be installed upside down (installation in which rear surface of printed circuit board (PCB) faces the inside of flow path) due to carelessness of a worker, and when the sensor is not precisely installed in a regular position, a precise temperature difference value may not be obtained, and thus a control failure may occur.

SUMMARY

The present disclosure has been made to solve the various problems, and has various aspects as follows.

One aspect of the present disclosure is to provide an optimum design condition for the relationship between a vertical opening distance of an inlet slot and a protruding length of a fluid inlet part that are formed at a frosting detection duct.

Another aspect of the present disclosure is to allow a material property obtained by an optimum design condition to secure the discrimination sufficient to additionally determine a variety of information related to frosting in addition to determining frosting.

Still another aspect of the present disclosure is to provide a flow path resistor, which applies resistance to a flow of a fluid, to a portion of the frosting detection duct where the fluid is introduced.

Yet another aspect of the present disclosure is to design the protruding length of the fluid inlet part having the discrimination sufficient to determine clogging of the frosting detection duct.

Yet another aspect of the present disclosure is to determine the protruding length of the fluid inlet part in consideration of a flow path depth of the frosting detection duct.

Yet another aspect of the present disclosure is to design the protruding length of the frosting detection duct in consideration of a height of a flow path of the fluid flowing toward a cooling source.

Yet another aspect of the present disclosure is to smoothly drain defrosting water or moisture that is introduced into the frosting detection duct.

Yet another aspect of the present disclosure is to prevent water that flows along an outer wall surface at a fluid inlet side of the frosting detection duct from freezing at the fluid inlet.

Yet another aspect of the present disclosure is for a worker to accurately recognize imprecise mounting of a frosting sensor for detecting frosting.

In order to achieve various aspects described above, the technical solutions may be provided as follows.

A refrigerator of the present disclosure may be configured to allow a fluid inlet part to generate resistance to a flow of a fluid. Accordingly, the amount of the fluid introduced through the fluid inlet part may be reduced.

The refrigerator of the present disclosure may have a fluid inlet formed on one wall surface of the fluid inlet part. Accordingly, some of the fluid flowing toward a cooling source while passing through a storage compartment may be introduced via the fluid inlet.

The refrigerator of the present disclosure may have an inlet slot on the fluid inlet part. Accordingly, fluid flowing back from the cooling source may be introduced.

The refrigerator of the present disclosure may be configured such that a protruding length Li of the fluid inlet part to a slot length Ls of the inlet slot may be satisfied with a condition of $0.2 \leq Ls/Li \leq 1.0$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to precisely recognize frosting may be secured.

The refrigerator of the present disclosure may be configured such that a part of a frosting detection duct may be disposed on a flow path formed between a second duct and the storage compartment. Accordingly, the fluid passing through the frosting detection duct may flow into the storage compartment via the second duct.

The refrigerator of the present disclosure may be configured such that a material property measured by a frost detecting device may include at least temperature, pressure, flow rate.

The refrigerator of the present disclosure may include a frosting sensor that may include a sensor.

The refrigerator of the present disclosure may include the frosting sensor that may include a detecting derivative.

The refrigerator of the present disclosure may be configured such that the detecting derivative induces improvement of precision when the material property is measured.

The refrigerator of the present disclosure may include the detecting derivative constituting the frost detecting device that may include a heating element that emits heat.

The refrigerator of the present disclosure may include a sensor constituting the frost detecting device that may include a sensor measuring the temperature of the heat.

The refrigerator of the present disclosure may include the cooling source that may include at least one of a thermoelectric module or an evaporator.

The refrigerator of the present disclosure may include the thermoelectric module that may include a thermoelement.

The refrigerator of the present disclosure may be configured such that the protruding length Li of the fluid inlet part to the slot length Ls of the inlet slot may be satisfied with a condition of $0.2 \leq Ls/Li \leq 0.8$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to precisely recognize frosting may be secured.

The refrigerator of the present disclosure may be configured such that the protruding length Li of the fluid inlet part to the slot length Ls of the inlet slot may be satisfied with a condition of $0.2 \leq Ls/Li \leq 0.6$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to precisely recognize frosting may be secured.

The refrigerator of the present disclosure may be configured such that the protruding length Li of the fluid inlet part to the slot length Ls of the inlet slot may be satisfied with a condition of $0.4 \leq Ls/Li \leq 1.0$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to precisely recognize frosting may be secured.

The refrigerator of the present disclosure may be configured such that the protruding length Li of the fluid inlet part to the slot length Ls of the inlet slot may be satisfied with a condition of $0.4 \leq Ls/Li \leq 0.8$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to additionally recognize a variety of information related to frosting in addition to recognizing frosting may be secured.

The refrigerator of the present disclosure may be configured such that the protruding length Li of the fluid inlet part to the slot length Ls of the inlet slot may be satisfied with a condition of $0.6 \leq Ls/Li \leq 1.0$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to precisely recognize frosting may be secured.

The refrigerator of the present disclosure may be configured such that the protruding length Li of the fluid inlet part to the slot length Ls of the inlet slot may be satisfied with a condition of $0.6 \leq Ls/Li \leq 0.8$. Accordingly, compared to when the protruding length Li of the fluid inlet part to the slot length Ls of the inlet slot is not considered, a temperature difference before and after a heating element emits heat may be additionally differ at least 5° C. or more so that the discrimination sufficient to additionally recognize a variety of information related to frosting in addition to recognizing frosting may be secured.

The refrigerator of the present disclosure may be configured such that an opening sectional area G1 of the fluid inlet may be satisfied with a condition of $0.8*G2 \leq G1 \leq 1.3*G2$ on the basis of an opening sectional area G2 of the inlet slot. Accordingly, deterioration of the discrimination caused when the fluid inlet is designed excessively smaller or larger than the inlet slot may be improved.

The refrigerator of the present disclosure may be configured such that the inlet slot that guides the fluid to be introduced into the frosting detection duct after frost or ice is generated on the cooling source may be formed between the fluid inlet part of the frosting detection duct and the cooling source. Accordingly, the discrimination with respect to before and after frosting of the cooling source may be improved.

The refrigerator of the present disclosure may have the frosting detection duct disposed in front of an evaporator. Accordingly, some the fluid flowing from the storage compartment to the evaporator may be introduced into the frosting detection duct.

The refrigerator of the present disclosure may have the fluid inlet part of the frosting detection duct that may be disposed lower than a lower end of the evaporator. Accordingly, some the fluid flowing from the storage compartment to the evaporator may be introduced into the frosting detection duct.

The refrigerator of the present disclosure may have a flow path resistor provided in the fluid inlet part of the frosting detection duct. Accordingly, the amount of fluid flowing toward the cooling source may be larger than the amount of fluid introduced into the frosting detection duct.

The refrigerator of the present disclosure may be configured to the amount per unit time of the fluid flowing toward the cooling source may be larger than the amount per unit time of the fluid introduced into the frosting detection duct. Accordingly, when frosting of the cooling source occurs, some of the fluid passing through the cooling source may be additionally introduced into the frosting detection duct.

The refrigerator of the present disclosure may be configured such that the protruding length Li of the fluid inlet part may be satisfied with a condition of $0.5*D \leq Li \leq 2.0*D$ with respect to a flow path depth D in the frosting detection duct. Accordingly, the discrimination sufficient to precisely recognize frosting may be secured.

The refrigerator of the present disclosure may be configured such that the protruding length Li of the fluid inlet part may be satisfied with a condition of $0.5*D \leq L \leq 1.5*D$ with respect to a flow path depth D in the frosting detection duct. Accordingly, the discrimination sufficient to precisely recognize frosting may be secured.

The refrigerator of the present disclosure may be configured such that the protruding length Li of the fluid inlet part may be satisfied with a condition of $1.0*D \leq Li \leq 2.0*D$ with respect to a flow path depth D in the frosting detection duct. Accordingly, the discrimination sufficient to precisely recognize frosting may be secured.

The refrigerator of the present disclosure may be configured such that the protruding length Li of the fluid inlet part may be satisfied with a condition of $1.0*D \leq Li \leq 1.5*D$ with respect to a flow path depth D in the frosting detection duct. Accordingly, the discrimination sufficient to precisely recognize flow path clogging of the frosting detection duct in addition to recognizing whether or not frosting occurs may be secured.

The refrigerator of the present disclosure may be configured such that the flow path depth D in the frosting detection duct may be satisfied with a condition of $7.62\ mm \leq D \leq 22\ mm$. Accordingly, precisely designing the protruding L of the fluid inlet part to the flow path depth D may be possible.

The refrigerator of the present disclosure may be configured such that a part of the fluid inlet part may protrude in a flow path direction of the fluid from a boundary of the first duct to generate a flow path resistance.

The refrigerator of the present disclosure may be configured such that the protruding length Li of the fluid inlet part may be satisfied with a condition of $H1-H1*5/15 \leq Li \leq H1+H1*10/15$ with respect to a flow path height H1 formed by a flow path of the fluid provided between the first duct and the casing. Accordingly, precisely designing the protruding length L of the fluid inlet part may be possible.

The refrigerator of the present disclosure may be configured such that the protruding length Li of the fluid inlet part may be satisfied with a condition of $H1-H1*5/15 \leq Li \leq H1+H1*5/15$ with respect to a flow path height H1 formed by a flow path of the fluid provided between the first duct and the casing. Accordingly, precisely designing the protruding length L of the fluid inlet part may be possible.

The refrigerator of the present disclosure may have the fluid inlet part that may be located at the fluid outlet side of the first duct. Accordingly, some of the fluid passing through the first duct may be introduced into the flow path in the frosting detection duct via the fluid inlet part.

The refrigerator of the present disclosure may have the flow resistor that is provided between the fluid inlet part and the fluid outlet side of the first duct. Accordingly, the flow rate per time unit at the fluid outlet side of the first duct may be larger than the flow rate per time unit of the fluid introduced into the frosting detection duct via the fluid inlet part.

The refrigerator of the present disclosure may have the flow resistor that may be provided between a portion where the fluid is introduced into the frosting detection duct and the flow path through which the fluid flows toward the cooling source via the first duct. Accordingly, the amount of fluid flowing toward the cooling source may be larger than the amount of fluid introduced into the frosting detection duct.

The refrigerator of the present disclosure may be configured to the amount per unit time of the fluid flowing toward the cooling source may be larger than the amount per unit time of the fluid introduced into the frosting detection duct. Accordingly, when frosting of the cooling source occurs, some of the fluid passing through the cooling source may be additionally introduced into the frosting detection duct.

The refrigerator of the present disclosure may include an inclined surface on an outer surface of a flow path cover. Accordingly, it may be prevented that water is generated and freezes on the outer surface of the flow path cover.

The refrigerator of the present disclosure may have an inclined surface on a circumferential wall surface of the fluid inlet part. Accordingly, it may be prevented that water is generated and freezes on the outer surface of the fluid inlet part.

The refrigerator of the present disclosure may have inclined surfaces on opposite lateral wall surfaces of the fluid inlet part. Accordingly, it may be prevented that water present on the opposite lateral wall surfaces of the fluid inlet part flows along the inclined surfaces and forms ice on the portions.

The refrigerator of the present disclosure may have a contact protrusion on the flow path cover. Accordingly, when the frosting sensor is imprecisely mounted to the frosting detection duct, the flow path cover may not be fully coupled to the detection duct by the contact protrusion, and a worker may accurately recognize this imprecise mounting.

The refrigerator of the present disclosure may be configured such that the insertion depth D of the frosting detection duct may be satisfied with a condition of $(1.5\ mm*2)+T \leq D$ with respect to a thickness T of the frosting sensor. Accordingly, even when defrosting water flows into the frosting detection duct, it may be prevented that the defrosting water freezes on the frosting sensor.

The refrigerator of the present disclosure may be configured such that the fluid outlet of the frosting detection duct may be disposed to be exposed to the flow path formed between the cooling source and the second duct. Accordingly, the fluid passing through the frosting detection duct may be prevented from being affected by the cooling source.

The refrigerator of the present disclosure may include the frosting detection duct that may have a fluid outlet located at a shroud. Accordingly, through the portion where the fluid outlet of the shroud is located, the fluid passing through the frosting detection duct may be discharged.

The refrigerator of the present disclosure may include the frosting detection duct that may have a guide flow path located at a rear surface of the fan grille.

The refrigerator of the present disclosure may be configured such that a part of the fluid outlet part may be inserted into the guide flow path. Accordingly, even when the defrosting water is introduced through the fluid outlet, the defrosting water may flow smoothly into the guide flow path of the fan grille.

The refrigerator of the present disclosure may be configured such that one portion of the flow path cover constituting the frosting detecting device may be in contact with the frosting sensor installed in the frosting detection duct. Accordingly, when mounting of the frosting sensor is imprecisely performed, mounting of the flow path cover may be also imprecisely performed and the worker may accurately recognize this imprecise mounting.

The refrigerator of the present disclosure may have installation grooves formed on the opposite lateral wall surfaces in the frosting detection duct.

The refrigerator of the present disclosure may be configured such that opposite ends of the frosting sensor may be inserted into the installation grooves. Accordingly, the frosting sensor may be installed to the regular position.

The refrigerator of the present disclosure may configured such that the contact protrusion of the flow path cover may be inserted into the installation grooves. Accordingly, the contact protrusion may be brought into contact with an end of the frosting sensor located inside the installation grooves.

The refrigerator of the present disclosure may include the frosting sensor on which a protrusion end protrudes and the installation grooves having insertion grooves. Accordingly, whether or not precise mounting of the frosting sensor occurs may be recognized.

The refrigerator of the present disclosure may be configured such that a signal line connected to the frosting sensor is horizontally led out from the frosting detection duct to reach a rear surface of the guide duct constituting the shroud and then bent perpendicular while being in contact with an outer surface of the guide duct and led out upward. Accordingly, it may be prevented that the signal line is damaged due to contact with the cooling source.

The refrigerator of the present disclosure may include a coupling part provided at the flow path cover. Accordingly, the flow path cover may be precisely coupled to the frosting detection duct.

The refrigerator of the present disclosure may include a first coupling part on an upper end of the flow path cover. Accordingly, the upper end of the flow path cover may be precisely coupled to the frosting detection duct.

The refrigerator of the present disclosure may include a second coupling part provided at a lower end of the flow path cover. Accordingly, the lower end of the flow path cover may be precisely coupled to the frosting detection duct.

As described above, the refrigerator of the present disclosure has various effects as follows.

The refrigerator of the present disclosure is configured to provide the flow path resistance to the portion of the frosting detection duct where the fluid is introduced, so that when frosting occurs insignificantly, the amount of the fluid flowing into the frosting detection duct may be minimized.

The refrigerator of the present disclosure is configured such that the fluid may flow smoothly due to a pressure difference between the fluid inlet part and the fluid outlet part even with the flow path resistance while frosting is generated.

The refrigerator of the present disclosure is configured to design a ratio of the protruding length Li of the fluid inlet part to the slot length Ls of the inlet slot of the frosting detection duct to be satisfied with the condition of $0.2 \leq Ls/Li \leq 1.0$, so that the logic temperature for detecting frosting may increase in comparison with changing only the vertical opening distance of the inlet slot or only the vertical protruding length of the fluid inlet part.

The refrigerator of the present disclosure is configured to secure the logic temperature at a value within a larger temperature range than a reference temperature difference value used to determine conventionally frosting, so that the discrimination to additionally identify causes related to a variety of frosting in addition to performing frosting detection may be secured.

The refrigerator of the present disclosure is configured to design the opening sectional area G1 of the fluid inlet to be satisfied with the condition of $0.8G2 \leq G1 \leq 1.3G2$ on the basis of the opening sectional area G2 of the inlet slot, so that the deterioration of the discrimination by designing the fluid inlet excessively smaller or larger than the inlet slot may be reduced.

The refrigerator of the present disclosure is configured to design the protruding length of the fluid inlet part in consideration of the flow path depth of the frosting detection duct, so that clogging of the frosting detection duct may be precisely determined. Furthermore, the discrimination sufficient to determine additional information related to frosting may be secured.

The refrigerator of the present disclosure is configured to design the protruding length of the fluid inlet part in consideration of the height of flow path of the fluid flowing toward the cooling source, so that clogging of the frosting detection duct may be precisely determined. Furthermore, the discrimination sufficient to determine additional information related to frosting may be secured.

The refrigerator of the present disclosure is configured to the amount of fluid per unit time at the fluid outlet side of the first duct is larger than the amount of fluid per unit time of the fluid introduced into the frosting detection duct, so that when frosting occurs on the cooling source some of the fluid passing through the cooling source may be introduced into the frosting detection duct.

The refrigerator of the present disclosure is configured to discharge water such as condensate water generated on the lateral wall of the fluid inlet part while the water flows without being condensed at the portion, so that it is possible to prevent water from being formed and freezing at the fluid inlet part.

The refrigerator of the present disclosure is configured to allow the insertion depth D of the frosting detection duct to be satisfied with the condition of $(1.5\ mm2)+T \leq D$ with respect to the thickness T of the frosting sensor, water may smoothly pass through the gap between each wall surface in the frosting detection duct and the frosting sensor.

The present disclosure may be configured to prevent freezing of the frosting sensor.

The refrigerator of the present disclosure is configured to have the mounting protrusion, which is formed at the fluid inlet side of the fluid outlet part, to be recessed into the guide flow path, so that even when water such as defrosting water, condensate water, etc., is introduced via the fluid outlet the water may flow smoothly without staying in a connected portion between the fluid outlet part and the guide flow path.

The refrigerator of the present disclosure is configured to allow at least one portion of the flow path cover to be in contact with the frosting sensor, whether or not the frosting sensor is imprecisely installed may be recognized by whether coupling of the flow path cover is precisely performed.

The refrigerator of the present disclosure is configured to provide the coupling part to the flow path cover to couple the flow path cover to the frosting detection duct, so that precise mounting and mounting maintenance of the flow path cover may be achieved.

The refrigerator of the present disclosure is configured to install the signal line lead out of the frosting sensor while having the shortest path and without interfering with a fluid flow, so that damage to the signal line may be prevented.

DESCRIPTION OF DRAWINGS

FIG. 1 is a front view schematically showing an internal structure of a refrigerator according to an embodiment of the present disclosure;

FIG. 2 is a longitudinal-sectional view schematically showing a structure of the refrigerator according to the embodiment of the present disclosure;

FIG. 3 is a state view schematically showing an operation state, which is performed in response to an operation reference value on the basis of a user set reference temperature with respect to each storage compartment of the refrigerator according to the embodiment of the present disclosure;

FIG. 4 is a block diagram schematically showing a control structure of the refrigerator according to the embodiment of the present disclosure;

FIG. 5 is a view schematically showing a structure of a thermoelectric module according to the embodiment of the present disclosure;

FIG. 6 is a block diagram schematically showing a refrigeration cycle of the refrigerator according to the embodiment of the present disclosure;

FIG. 7 is a main part sectional view showing a space behind a second storage compartment inside a casing in order to describe installation of a frost detecting device and an evaporator that constitute the refrigerator according to the embodiment of the present disclosure;

FIG. 8 is an enlarged view showing part "A" in FIG. 7;

FIG. 9 is a front-perspective view of a fan duct assembly used to describe installation of the frost detecting device constituting the refrigerator according to the embodiment of the present disclosure;

FIG. 10 is a rear-perspective view of the fan duct assembly used to describe installation of the frost detecting device constituting the refrigerator according to the embodiment of the present disclosure;

FIG. 11 is an exploded-perspective view showing the fan duct assembly without a flow path cover and a sensor of the refrigerator according to the embodiment of the present disclosure;

FIG. 12 is an enlarged view showing part "B" in FIG. 11;

FIG. 13 is a rear view showing the fan duct assembly to describe the relationship between installation locations of the frosting detecting device and a cooling source that constitute the refrigerator according to the embodiment of the present disclosure;

FIG. 14 is a rear view showing the fan duct assembly to describe installation of the frost detecting device constituting the refrigerator according to the embodiment of the present disclosure;

FIG. 15 is an enlarged view showing installation of the frost detecting device constituting the refrigerator according to the embodiment of the present disclosure;

FIG. 16 is an enlarged view showing part "C" in FIG. 15;

FIG. 17 is an enlarged view showing a state without a flow path cover to describe an internal state of a frosting detection duct of the frosting detecting device constituting the refrigerator according to the embodiment of the present disclosure;

FIG. 18 is an enlarged-perspective view showing installation of the frost detecting device constituting the refrigerator according to the embodiment of the present disclosure;

FIG. 19 is an enlarged view showing part "D" in FIG. 18;

FIG. 20 is a comparative table showing the relationship between a flow rate and a velocity of flow with respect to a protruding length of a fluid inlet part of the refrigerator according to the embodiment of the present disclosure;

FIG. 21 is a comparative table showing the relationship between a flow rate and a velocity of flow with respect to a slot length of an inlet slot of the refrigerator according to the embodiment of the present disclosure;

FIG. 22 is a graph showing a temperature change with respect to a ratio of a slot length of the inlet slot to a protruding length of the fluid inlet part of the refrigerator according to the embodiment of the present disclosure;

FIGS. 23 and 24 are main part enlarged views showing a flow of a fluid in response to whether or not frosting on the frosting detecting device occurs according to the embodiment of the present disclosure;

FIG. 25 is a main part enlarged view showing installation of the frost detecting device according to the embodiment of the present disclosure;

FIG. 26 is a view schematically showing a frosting sensor of the frost detecting device according to the embodiment of the present disclosure;

FIG. 27 is a flowchart showing a control process performed by a controller in an event of frost detecting operation of the refrigerator according to the embodiment of the present disclosure;

FIGS. 28 and 29 are state graphs showing temperature change in the frosting detection duct in response to on/off of the heating element and on/off of the cooling fan while frosting to the evaporator of the refrigerator is in progress according to the embodiment of the present disclosure;

FIG. 30 is a main part perspective view showing the frosting detection duct to describe a second embodiment of the present disclosure;

FIG. 31 is a graph showing a temperature change with respect to a ratio of a protruding length of the fluid inlet part to the fluid depth of the refrigerator according to the second embodiment of the present disclosure;

FIG. 32 is a comparative table showing the relationship between a temperature change, a logic temperature, and a logic with respect to a flow path depth and a protruding length of the refrigerator according to the second embodiment of the present disclosure;

FIG. 33 is a view showing a flow path height of the refrigerator according to a third embodiment of the present disclosure;

FIG. 34 is a view showing a structure of an installation groove according to a fourth embodiment of the present disclosure;

FIG. 35 is a view showing the relationship between an insertion depth of a guide flow path and a thickness of the frosting sensor according to the fourth embodiment of the present disclosure;

FIGS. 36 and 37 are views showing the relationship between the installation groove and a separation preventing protrusion according to the fourth embodiment of the present disclosure;

FIGS. 38 to 41 are views showing the relationship between a protrusion end, an insertion groove, and the installation groove according to a fifth embodiment of the present disclosure;

FIG. 42 is a view showing a flow path cover to describe the fifth embodiment of the present disclosure;

FIG. 43 is an enlarged view showing part "E" in FIG. 42;

FIG. 44 is a view showing a state when the frosting sensor is imprecisely installed in the installation groove according to the fifth embodiment of the present disclosure;

FIGS. 45 and 46 are views showing a structure of the flow path cover according to a sixth embodiment of the present disclosure;

FIG. 47 is an enlarged view showing part "F" in FIG. 42;

FIG. 48 is a side view showing a first coupling part of the flow path cover according to the sixth embodiment of the present disclosure;

FIG. 49 is a state view showing the relationship between a fluid outlet part and the frosting detection duct according to the sixth embodiment of the present disclosure;

FIG. 50 is a view showing the fluid outlet part installed to a shroud according to the sixth embodiment of the present disclosure;

FIG. 51 is a main part enlarged view showing the fluid outlet part according to the sixth embodiment of the present disclosure;

FIG. 52 is a main part enlarged view showing the coupling relationship between the fluid outlet part and the frosting detection duct according to the sixth embodiment of the present disclosure;

FIG. 53 is a main part enlarged view showing a second coupling part according to the sixth embodiment of the present disclosure;

FIG. 54 is an enlarged view showing part "G" in FIG. 42;

FIGS. 55 and 56 are views showing a structure for preventing water inflow according to a seventh embodiment of the present disclosure;

FIG. 57 is an enlarged view showing part "H" in FIG. 55 to show a structure for preventing water formation according to an eighth embodiment of the present disclosure;

FIG. 58 is an enlarged view showing part "I" in FIG. 56;

FIG. 59 is a main part enlarged view showing a structure to lead a signal line according to a ninth embodiment of the present disclosure; and FIG. 60 is a view showing the structure to lead the signal line according to the ninth embodiment of the present disclosure.

DETAILED DESCRIPTION

Hereinbelow, preferred embodiments of a structure and embodiments of an operational control of a refrigerator of the present disclosure will be described with reference to accompanying FIGS. 1 to 60.

FIG. 1 is a front view schematically showing an internal structure of a refrigerator according to an embodiment of the present disclosure. FIG. 2 is a longitudinal-sectional view schematically showing a structure of the refrigerator according to the embodiment of the present disclosure.

As shown in the drawings, according to the embodiment of the present disclosure, a refrigerator 1 may include a casing 11.

The casing 11 may include an outer casing 11*b* providing an exterior shape of the refrigerator 1.

Furthermore, the casing 11 may include an inner casing 11*a* providing an internal wall surface of the refrigerator 1. A storage compartment may be provided at the inner casing 11*a* to store stored objects.

The storage compartment may include two storage compartments that respectively store stored objects at different temperatures. Of course, the storage compartment may include one storage compartment or three or more multiple storage compartments.

The storage compartments may include a first storage compartment 12 maintained at a first set reference temperature.

The first set reference temperature may be a temperature at which stored objects do not freeze and also may be a temperature range lower than an external temperature of the refrigerator 1 (room temperature).

For example, the first set reference temperature may be preset at a temperature that is less than or equal to 32° C. and higher than 0° C. Of course, when necessary (for example, according to the room temperature, a type of stored objects, or the like), the first set reference temperature may be preset to be higher than 32° C. or equal to or less than 0° C.

Specifically, the first set reference temperature may be an internal temperature of the first storage compartment 12 preset by a user. However, when the user does not preset the first set reference temperature, an arbitrary designated temperature may be used as the first set reference temperature.

The first storage compartment 12 may be configured to be operated at a first operational reference value that is set to maintain the first set reference temperature.

The first operational reference value may be preset at a temperature range value including a first lower limit temperature NT-DIFF1. For example, when the internal temperature of the first storage compartment 12 reaches the first lower limit temperature NT-DIFF1 on the basis of the first set reference temperature, an operation for supplying cold air stops.

The first operational reference value may be preset at a temperature range value including a first upper limit temperature NT+DIFF1. For example, when the internal temperature of the first storage compartment 12 rises on the basis of the first set reference temperature, the operation for cold air supply may be resumed before reaching the first upper limit temperature NT+DIFF1.

As described above, inside the first storage compartment 12, on the basis of the first set reference temperature, the supply of cold air is performed or interrupted in consideration of the first operational reference value with respect to the first storage compartment.

This set reference temperature NT and the operational reference value DIFF are shown in accompanying FIG. 3.

Furthermore, the storage compartment may include a second storage compartment 13 maintained at a second set reference temperature.

The second set reference temperature may be a temperature lower than the first set reference temperature. At this point, the second set reference temperature may be preset by the user, and when the user does not preset the second set reference temperature, an arbitrary preset temperature may be used as the second set reference temperature.

The second set reference temperature may be a temperature at which stored objects can freeze. For example, the second set reference temperature may include a temperature that is less than or equal to 0° C. and equal to or higher than −24° C. Of course, when necessary (for example, according to the room temperature, a type of stored objects, or the like), the second set reference temperature may be preset to be higher than 0° C. or less than or equal to −24° C.

The second set reference temperature may be an internal temperature of the second storage compartment 13 preset by the user. However, when the user does not preset the second set reference temperature, an arbitrary designated temperature may be used as the second set reference temperature.

The second storage compartment 13 may be configured to be operated at a second operational reference value that is set to maintain the second set reference temperature.

The second operational reference value may be preset at a temperature range value including a second lower limit temperature NT-DIFF2. For example, when the internal temperature of the second storage compartment 13 reaches the second lower limit temperature NT-DIFF2 on the basis of the second set reference temperature, an operation for supplying cold air stops.

The second operational reference value may be preset at a temperature range value including a second upper limit temperature NT+DIFF2. For example, when the internal temperature of the second storage compartment 13 rises on the basis of the second set reference temperature, the operation for cold air supply may be resumed before reaching the second upper limit temperature NT+DIFF2.

As described above, inside the second storage compartment 13, on the basis of the second set reference temperature, the supply of cold air is performed or interrupted considering the second operational reference value with respect to the second storage compartment.

The first operational reference value may be preset with a temperature range between the upper limit temperature and the lower limit temperature smaller than the second operational reference value. For example, the second lower limit temperature NT-DIFF2 and the second upper limit temperature NT+DIFF2 of the second operational reference value may be preset to ±2.0° C., and the first lower limit temperature NT-DIFF1 and the first upper limit temperature NT+DIFF1 of the first operational reference value may be preset to ±1.5° C.

Meanwhile, the above-described storage compartment is configured to circulate a fluid and maintain the internal temperature of the storage compartment.

The fluid may be air. Of course, the fluid may be a gas other than air.

The temperature outside the storage compartment (room temperature) may be measured by a first temperature sensor 1*a* as shown in FIG. 4, and the internal temperature of the storage compartment may be measured by a second temperature sensor 1*b*.

The first temperature sensor 1*a* and the second temperature sensor 1*b* may be separately provided. Of course, the room temperature and the internal temperature of the storage compartment may be measured by one temperature sensor or be measured by two or more temperature sensors that cooperate.

The second temperature sensor 1*b* may be provided in a second duct (e.g., second fan duct assembly), and this structure may be the same as shown in FIG. 10.

Furthermore, as shown in FIGS. 1 and 2, the storage compartment 12, 13 may include a door 12*b*, 13*b*.

The door 12*b*, 13*b* serves to open and close the storage compartment 12, 13, and may have a rotatable opening and closing structure, or may have a drawer-type opening and closing structure.

The door 12*b*, 13*b* may include one or more doors.

Next, according to the embodiment of the present disclosure, the refrigerator 1 may include a cooling source.

The cooling source may include a structure that generates cold air.

The structure that generates cold air of the cooling source may be configured in various ways.

For example, the cooling source may include a thermoelectric module 23.

As shown in FIG. 5, the thermoelectric module 23 may include a thermoelement 23*a* including an endothermic surface 231 and an exothermic surface 232. The thermoelectric module 23 may comprise of a module including a sink 23*b* connected to at least one of the endothermic surface 231 and the exothermic surface 232 of the thermoelement 23*a*.

According to the embodiment of the present disclosure, the structure that generates cold air of the cooling source comprises an evaporator 21, 22.

The evaporator 21, 22 may constitute the refrigerating system together with the compressor 60 (referring to FIG. 6), and serve to perform heat exchange with air passing through the evaporator and lower the temperature of the air.

When the storage compartment includes the first storage compartment 12 and the second storage compartment 13, the evaporator may include a first evaporator 21 and a second evaporator 22, and the first evaporator 21 may supply cold air to the first storage compartment 12 and the second evaporator 22 may supply cold air to the second storage compartment 13.

At this point, inside the inside space of the inner casing 11*a*, the first evaporator 21 may be located at a rear side in the first storage compartment 12, and the second evaporator 22 may be located at a rear side in the second storage compartment 13.

Of course, although not shown in the drawing, one evaporator may be provided only in at least one of the first storage compartment 12 and the second storage compartment 13.

Even when two evaporators are provided, the one compressor 60 constituting the refrigerating cycle may be provided. In this case, as shown in FIG. 6, the compressor 60 may be connected to the first evaporator 21 so as to supply a refrigerant via a first refrigerant path 61, and may be connected to the second evaporator 22 so as to supply the refrigerant via a second refrigerant path 62. At this point, the refrigerant path 61, 62 may be selectively opened and closed using a refrigerant valve 63.

The refrigerator may include a structure that supplies the generated cold air to the storage compartment.

A cooling fan may be included as a structure that supplies the cold air of the cooling source. The cooling fan may serve to supply the cold air into the storage compartment 12, 13, the cold air being generated while passing through the cooling source.

At this point, the cooling fan may include a first cooling fan 31 that supplies the cold air generated while passing through the first evaporator 21, into the first storage compartment 12.

The cooling fan may include a second cooling fan 41 that supplies the cold air generated while passing through the second evaporator 22, into the second storage compartment 13.

Next, according to the embodiment of the present disclosure, the refrigerator 1 may include a first duct.

The first duct may be formed of at least one of a passage through which air passes (e.g., tube such as duct, pipe, or the like), a hole, and an air flow path. Air may flow from the inside space of the storage compartment to the cooling source by guidance of the first duct.

With reference to FIG. 7, the first duct may include an inlet duct 42*a*. In other words, a fluid flowing in the second storage compartment 13 may flow into the second evaporator 22 by guidance of the inlet duct 42*a*.

The first duct may include a part of a bottom surface of the inner casing 11*a*. At this point, a part of the bottom surface of the inner casing 11*a* is a portion that is from a portion facing the bottom surface of the inlet duct 42*a* to a position to which the second evaporator 22 is mounted. Therefore, the first duct provides a flow path through which a fluid flows from the inlet duct 42*a* toward the second evaporator 22.

Next, according to the embodiment of the present disclosure, the refrigerator 1 may include the second duct.

The second duct may be formed of at least one of a passage that guides air around the evaporator 21, 22 constituting the cooling source so that the air flows into the storage compartment (e.g., tube such as duct, pipe, or the like), a hole, and a flow path of air.

The second duct may include a fan duct assembly 30, 40 that is located at front of the evaporator 21, 22.

As shown in FIGS. 1 and 2, the fan duct assembly 30, 40 may include at least one of a first fan duct assembly 30 and a second fan duct assembly 40, and the first fan duct assembly 30 guides cold air so that the cold air flows into the first storage compartment 12, and the second fan duct assembly 40 guides cold air so that the cold air flows into the second storage compartment 13.

At this point, a space between the fan duct assembly 30, 40 where the evaporator 21, 22 is located and a rear wall surface of the inner casing 11*a* may be defined as a heat-exchange flow path where air exchanges heat with the evaporator 21, 22.

Of course, although not shown in the drawings, even when a evaporator is provided only at one of the storage compartment, the fan duct assembly 30, 40 may be provided at each storage compartment 12, 13. And even when the evaporator 21, 22 is provided to each storage compartment 12, 13, only one fan duct assembly 30, 40 may be provided. Various configurations are possible.

Meanwhile, in the description of the embodiment below, it is illustrated that a structure that generates cold air of the cooling source is the second evaporator 22, and a structure that supplies the cold air of the cooling source is the second cooling fan 41, and the first duct is the inlet duct 42*a* formed in the second fan duct assembly 40, and the second duct is the second fan duct assembly 40.

As shown in FIGS. 7 to 9, the second fan duct assembly 40 may include a fan grille 42.

The inlet duct 42*a* may be formed in the fan grille 42 to suction air from the second storage compartment 13. The inlet duct 42*a* may be formed at each of opposite ends of a lower portion of the fan grille 42, and is configured to guide a suctioned flow of air that flows along an inclined corner portion, which is inclined due to a machine chamber between a bottom surface and the rear wall surface in the inner casing 11*a*.

At this point, the inlet duct 42*a* may be used as a partial structure of the above-described first duct. In other words, the inlet duct 42*a* guides a fluid inside the second storage compartment 13 to flow into second evaporator 22.

The inlet duct 42*a* may be formed to protrude forward (inside of second storage compartment) and may be formed to be gradually inclined downward in a forward direction.

An inclination of the inlet duct 42*a* may be formed to be equal or similar to an inclination formed due to the machine chamber in a rear portion of the bottom surface of the inner casing 11*a*.

Meanwhile, a fluid discharge part 42*b* may be formed on the fan grille 42 to discharge cold air into the second storage compartment 13.

The fluid discharge part 42*b* may include two or more multiple cold air outlets 42*b*. For example, as shown in FIG. 9, the cold air outlets 42*b* may be respectively formed at opposite side portions of an upper portion, opposite side portions of an intermediate portion, and opposite side portions of a lower portion of the fan grille 42.

As shown in FIGS. 10 to 11, the second fan duct assembly 40 may include a shroud 43.

The shroud 43 may be coupled to a rear surface of the fan grille 42. Accordingly, a flow path for guiding a flow of cold air into the second storage compartment 13 may be provided between the shroud 43 and the fan grille 42.

A fluid inlet 43*a* may be formed on the shroud 43. The fluid inlet 43*a* is located at a higher position than the second evaporator 22. In other words, cold air passing through the second evaporator 22 flows into the flow path between the fan grille 42 and the shroud 43 via the fluid inlet 43*a* and then passes through each cold air outlet 42*b* of the fan grille 42 by guidance of the flow path, so that the cold air is discharged to the second storage compartment 13.

The cold air outlet 42*b* may include two or more multiple cold air outlets 42*b*. For example, as shown in FIG. 9, the cold air outlets 42*b* may be respectively formed at opposite side portions of an upper portion, opposite side portions of an intermediate portion, and opposite side portions of a lower portion of the fan grille 42.

The second evaporator 22 may be provided to be located at a lower position than the fluid inlet 43*a*.

Furthermore, guide ducts 43*b* may be formed to extend downward on opposite side portions of the shroud 43. Each of the guide ducts 43*b* guides cold air blown by the second cooling fan 41 to flow to reach the fluid discharge part 42*b* that is located at the lower portion of the fan grille 42, among the fluid discharge parts 42*b*.

Meanwhile, the second cooling fan 41 may be installed in the flow path between the fan grille 42 and the shroud 43.

Preferably, the second cooling fan 41 may be installed in the fluid inlet 43*a* formed in the shroud 43. In other words, by operation of the second cooling fan 41, air inside the second storage compartment 13 may pass successively through the inlet duct 42*a* and the second evaporator 22 and then may flow into the flow path via the fluid inlet 43*a*.

Next, according to the embodiment of the present disclosure, the refrigerator 1 may include a defrosting device 50.

The defrosting device 50 provides a heat source so as to remove frost generated on the cooling source (e.g., second evaporator). Of course, the defrosting device 50 may perform defrosting of the frost detecting device 70, which will be described below, or prevent freezing.

As shown in FIGS. 7 and 13, the defrosting device 50 may include a first heater 51. In other words, frost generated on the second evaporator 22 (cooling source) may be removed by heat-emission of the first heater 51.

The first heater 51 may be located at a lower portion (air inlet side) of the second evaporator 22. In other words, through heat-emission of the first heater 51, the first heater 51 is configured such that heat can be supplied in the air flowing direction from a lower end of the second evaporator 22 to an upper end thereof.

Of course, although not shown in the drawing, the first heater 51 may be located at a lateral portion of the second evaporator 22, may be located at a front portion or a rear portion of the second evaporator 22, may be located at an upper portion of the second evaporator 22, or may be located to be brought into contact with the second evaporator 22.

The first heater 51 may comprise of a sheath heater. In other words, the first heater 51 may be configured such that frost generated on the second evaporator 22 is removed by using radiant heat and convective heat of the sheath heater.

As shown in FIGS. 7 and 13, the defrosting device 50 may include a second heater 52.

The second heater 52 may emit heat at a lower output than the first heater 51 and supply the heat to the second evaporator 22.

The second heater 52 may be located to be in contact with a heat-exchange fin of the second evaporator 22. In other words, the second heater 52 is configured to remove frost generated on the second evaporator 22 by heat conduction while being directly in contact with the second evaporator 22.

As an example, the second heater 52 may comprise of an L-cord heater. In other words, the second heater may be configured to remove frost generated on the second evaporator 22 by conductive heat of the L-cord heater. The second heater 52 may be installed to be in contact with the heat-exchange fin located in an upper portion (air outlet side) of the second evaporator 22.

The heater included in the defrosting device 50 may include both of the first heater 51 and the second heater 52, or may include only one of the first heater 51 and the second heater 52.

Meanwhile, the defrosting device 50 may include an evaporator temperature sensor.

The evaporator temperature sensor may detect the temperature around the defrosting device 50, and the detected temperature value may be used as a factor that determines ON/OFF of the heater 51, 52.

As an example, after the heater 51, 52 is turned ON, when the temperature value detected by the evaporator temperature sensor reaches a specific temperature (defrosting termination temperature), the heater 51, 52 may be turned OFF.

The defrosting termination temperature may be preset as an initial temperature, and when after defrosting is completed and remaining ice is detected on the second evaporator 22, the defrosting termination temperature may be raised by a predetermined temperature.

Next, according to the embodiment of the present disclosure, the refrigerator 1 may include a frost detecting device 70.

The frost detecting device 70 may be a device that detects the amount of frost or ice generated on the cooling source.

The frosting detecting device may be located on a flow path of a fluid guided to the first duct and the second duct.

For example, the frosting detecting device may be located on the flow path of the fluid guided to the inlet duct 42*a* (first duct) and the second fan duct assembly 40 (second duct) and detect frosting of the second evaporator 22 (cooling source).

Furthermore, the frost detecting device 70 may recognize a degree of frosting of the second evaporator 22 by using a sensor outputting different values in response to a fluid property. At this point, the fluid property may include at least one of temperature, pressure, and flow rate.

The frost detecting device 70 may be configured to precisely determine the execution time of defrosting operation on the basis of the degree of frosting recognized as described above.

A first embodiment of the frosting detecting device 70 will be described in detail with reference to FIGS. 7 to 16.

FIG. 7 is a main part sectional view showing installation of the frosting detecting device and the evaporator. FIG. 8 is an enlarged view showing part "A" in FIG. 7. FIGS. 10 to 16 are views showing installation of the frosting detecting device to the second fan duct assembly.

First, the frosting detecting device 70 may include a frosting detection duct 710.

The frosting detection duct 710 may provide a flow passage (flow path) of air detected by a frosting sensor 740 in order to detect frosting of the second evaporator 22. The frosting detection duct 710 may be provided as a portion where a frosting sensor 740 to detect frosting of the second evaporator 22 is located.

The frosting detection duct 710 may be configured to guide a separate air flow divided from an air flow passing through the second evaporator 22 and an air flow in the second fan duct assembly 40.

The frosting detection duct 710 may include a fluid inlet 711 and a fluid outlet 712.

The fluid inlet 711 is open to allow a fluid to be introduced into the frosting detection duct 710, and the fluid outlet 712 is open to discharge the fluid that passes through the frosting detection duct 710.

The frosting detection duct 710 may be located on a flow path of cold air that is circulated in the second storage compartment 13, the inlet duct 42*a*, the second evaporator 22, and the second fan duct assembly 40.

At least a part of the frosting detection duct 710 may be arranged on a flow path formed between the first duct and the cooling source. For example, at least a part of the frosting detection duct 710 may be disposed on a flow path formed between the inlet duct 42*a* and the second evaporator 22.

As an example, the fluid inlet 711 of the frosting detection duct 710 may be located to be open toward the flow path of the fluid flowing toward the air inlet side of the second evaporator 22 while passing through the inlet duct 42*a*. In other words, some of the air suctioned into the air inlet side of the second evaporator 22 through the inlet duct 42*a* may flow into the frosting detection duct 710.

At least a part of the frosting detection duct 710 may be arranged on a flow path formed between the second duct and the second storage compartment 13. For example, at least a part of the frosting detection duct 710 may be disposed on a flow path formed between the second fan duct assembly 40 and the second storage compartment 13.

As another example, the fluid outlet 712 of the frosting detection duct 710 may be located between an air outlet side of the second evaporator 22 and a flow path through which cold air is supplied to the second storage compartment 13.

More specifically, as shown in FIG. 13, the fluid outlet 712 of the frosting detection duct 710 may be located to be open on a flow path through which a fluid flows toward the fluid inlet 43*a* of the shroud 43 while passing through the second evaporator 22.

In other words, air that passed through the frosting detection duct 710 may directly flow between the air outlet side of the second evaporator 22 and the fluid inlet 43*a* of the shroud 43.

Meanwhile, the frosting detection duct 710 may include a fluid outlet part 717.

The fluid outlet part 717 is provided to guide a fluid, which flows along a guide flow path 713, to be discharged via the fluid outlet 712.

The fluid outlet part 717 may be formed at an inclined portion of the shroud 43 and may be formed into a recessed portion with open lower and rear surfaces while having opposite lateral wall surfaces, a bottom surface, and an upper surface. At this point, the fluid outlet 712 may be a portion of the open rear surface of the fluid outlet part 717.

The frosting detection duct 710 is formed by recessing a facing surface to a surface of the second fan duct assembly 40, the surface facing the second evaporator 22, thereby allowing air to flow into the frosting detection flow path 710. At this point, as shown in FIG. 9, the frosting detection duct 710 may protrude forward from the second fan duct assembly 40 by the recessed insertion depth D.

The frosting detection duct 710 may be formed such that a part thereof may be formed in the fan grille 42 and other parts thereof may be formed in the shroud 43. For example, a lower portion through which a fluid is introduced may be formed in the fan grille 42, and an upper portion through which the fluid is discharged may be formed in the shroud 43.

Accordingly, the frosting detection duct 710 may be disposed to cross the cooling source (second evaporator) vertically. At this point, the fluid outlet 712 is provided at an upper end of the frosting detection duct 710, and the fluid inlet 711 may be provided at a lower end of the frosting detection duct 710.

Although not shown in the drawings, the frosting detection duct 710 may be formed only at the fan grille 42 or at the shroud 43.

The frosting detection duct 710 may include the guide flow path 713. Air introduced into the frosting detection duct 710 via the fluid inlet 711 flows to pass through the frosting detection duct 710 by guidance of the guide flow path 713.

The guide flow path 713 is formed by being recessed on a rear surface of the second fan duct assembly 40 (rear surface of fan grille) and guides a fluid that is introduced into the frosting detection duct 710 while passing through the fluid inlet 711. At this point, the guide flow path 713 may be formed to be open at an upper surface, a lower surface, and a rear surface while having opposite lateral wall surfaces and a bottom surface.

The frosting detection duct 710 may include a flow path cover 720.

The flow path cover 720 may be configured to cover the open rear surface (surface facing second evaporator) of the guide flow path 713.

Although not shown in the drawings, the frosting detection duct 710 may be configured to be manufactured as a separate tubular body from the second fan duct assembly 40 and then fixed (attached or coupled) to the second fan duct assembly 40.

As the flow path cover 720 is installed to cover the open rear surface of the guide flow path 713, the flow path cover 720 serves to partition the flow path inside the frosting detection duct 710 from the external environment. The fluid outlet 712 provided in the frosting detection duct 710 may be formed by the flow path cover 720.

In other words, as the flow path cover 720 is formed to cover remaining portions except for the side through which a fluid of the guide flow path 713 is discharged, the fluid outlet 712 may be provided while being open toward the fan grille 42.

At least a part of the flow path cover 720 may be formed to be inclined (or rounded). In other words, considering that a portion of the shroud 43 where a part of the guide flow path 713 is formed to be inclined (or rounded), a part covering a part of the guide flow path 713 may be formed to be inclined (or rounded) at the same inclination as the inclined surface (or round surface) of the shroud 43.

A rear surface of the flow path cover 720 may be located on the same level as the rear surface of the fan grille 42.

As shown in FIGS. 11 and 17, a placing step 42*c*, on which the flow path cover 720 is placed, may be formed in the fan grille 42 on which the guide flow path 713 is recessed.

The placing step 42*c* may be recessed from the rear surface of the fan grille 42 by a thickness of the flow path cover 720.

Accordingly, when the flow path cover 720 is installed at the guide flow path 713, a rear surface of the flow path cover 720 (surface facing second evaporator) may be located on the same level as (or flush with) the rear surface of the fan grille 42 (surface facing second evaporator).

As shown in FIGS. 12, 16, and 19, the flow path cover 720 may include a fluid inlet part 730.

The fluid inlet part 730 is configured to provide a flow resistance to a fluid introduced into the guide flow path 713.

In other words, by the flow resistance of the fluid inlet part 730, a flow rate (flow rate per unit time at fluid outlet side of first duct) of a fluid flowing toward the cooling source by guidance of the first duct may be larger than a flow rate (flow rate per unit time of fluid introduced into frosting detection duct) of a fluid introduced into the guide flow path 713.

The fluid inlet part 730 may be formed at a lower end of the flow path cover 720.

The fluid inlet part 730 may be formed into a tubular body having a circumferential wall surface.

The fluid inlet part 730 may be arranged at a position lower than a lower end (air inlet side) of the cooling source (second evaporator). Accordingly, the flow rate per time unit at the fluid outlet side of the first duct may be larger than the flow rate per time unit of the fluid introduced into the frosting detection duct 710 via the fluid inlet part 730.

As shown in FIG. 12, the upper surface and the lower surface of the fluid inlet part 730 may be formed to be open.

The open lower surface of the fluid inlet part 730 may serve as the fluid inlet 711, and the open upper surface of the fluid inlet part 730 may be formed to match with the open lower surface of the guide flow path 713.

The fluid inlet part 730 may serve as a flow resistor to prevent a flow of a fluid introduced into the frosting detection duct 710. In other words, by the fluid inlet part 730 serving as the flow resistor, a flow rate of the fluid introduced into the frosting detection duct 710 may be smaller than a flow rate of a fluid flowing toward the cooling source.

At this point, the flow resistor may be either one of a separate structure or a shape provided to either component, which serve to guide the fluid around the cooling source to be introduced into the frosting detection duct 710 after frost or ice has been generated on the cooling source.

Of course, although not shown in the drawings, the flow resistor may be formed as a separate structure from the fluid inlet part 730 and may be additionally provided on a flow path through which a fluid flows toward the cooling source via the fluid inlet part 730 of the frosting detection duct 710 or the first duct.

A part of the fluid inlet part 730 may be formed by protruding from a boundary 42*d* of the first duct toward the flow path of the fluid provided by the first duct. At this point, the boundary 42*d* of the first duct may be a bent portion where the inlet duct 42*a* protruding forward from the lower end of the fan grille 42 is bent to be inclined from the fan grille 42. The fluid inlet part 730 may protrude downward in a right down direction from the bent portion.

The protruding portion of the fluid inlet part 730 serves as flow resistance with respect to a fluid flowing from the storage compartment (second storage compartment) toward the cooling source (second evaporator) by guidance of the first duct(inlet duct).

Considering this, as a protruding length Li (height protruding downward from boundary of inlet duct) of the fluid inlet part 730 increases, the amount of fluid introduced into the guide flow path 713 before frosting of the cooling source (second evaporator) may be reduced. Therefore, as the amount of fluid introduced into the guide flow path 713 before frosting is less, a velocity of flow in the guide flow path 713 may be slower.

Then, as a velocity of flow in the guide flow path 713 is reduced, a difference between the maximum temperature and the minimum temperature detected by ON/OFF control of a heating element 741 of a frosting sensor 740, which will be described below, may increase, so that the discrimination in frosting detection using the temperature difference may be improved.

FIG. 20 is a table showing the flow rate and the velocity of flow of the fluid before and after frosting in response to the protruding length Li of the fluid inlet part 730 to be described later.

As shown in the table, before frost is generated on the cooling source, as the protruding length Li of the fluid inlet part 730 increases, the flow rate of the fluid introduced into the guide flow path 713 may be reduced, and the velocity of flow may be reduced.

At this point, with the protruding length Li of the fluid inlet part 730, it is checked that during frosting on the cooling source, a difference in the flow rate of the fluid introduced into the guide flow path 713 is insignificant and a difference in the velocity of flow is also insignificant.

Of course, as shown in the table, when the protruding length Li of the fluid inlet part 730 is formed excessively long (e.g., 20 mm) beyond the optimum range (e.g., 12~18 mm), a difference (difference in flow rate) in the amount of the fluid introduced into the guide flow path 713 before frosting and during frosting is reduced, and thus a difference in the velocity of flow is also reduced.

Meanwhile, the fluid inlet part 730 may be formed to have a front wall 731. The front wall 731 of the fluid inlet part 730 is a wall surface located at the flow inlet side of the fluid flowing toward the cooling source by guidance of the first duct.

The fluid inlet part 730 may be formed to have a rear wall 732. The rear wall 732 of the fluid inlet part 730 is a wall surface located at the flow outlet side of the fluid flowing toward the cooling source by guidance of the first duct. The rear wall 732 may be a wall surface at the side facing the cooling source.

The fluid inlet part 730 may include lateral walls 733. The lateral walls 733 may be formed to connect the front wall 731 to the rear wall 732.

An inlet slot 734 may be formed in the rear wall 732 of the fluid inlet part 730.

The inlet slot 734 is formed to be open so as to guide cold air that is flowing back from the cooling source (e.g., second evaporator) to be introduced into the guide flow path 713.

In other words, as ice or frost generated on the second evaporator 22 is in progress, some of a fluid passing through the second evaporator 22 flows back while receiving flow resistance from the generated frost or ice, and thus the flowing-back cold air may be smoothly introduced into the guide flow path 713 via the inlet slot 734 and pass through the guide flow path 713.

FIG. 21 is a table showing the introduced amount and the velocity of flow of a fluid before and after frosting, in response to a slot length Ls of the inlet slot 734.

As shown in the table, after frosting of the cooling source starts, as the slot length Ls increases, a larger difference in velocity of flow is provided than before frosting.

Furthermore, the inlet slot 734 serves to pass the fluid flowing toward the cooling source by guidance of the inlet duct 42*a* in a process of passing through the fluid inlet part 730, so that the fluid directly flows the cooling source without hitting the rear wall 732 of the fluid inlet part 730.

In other words, when the inlet slot 734 is not provided in the rear wall 732, in the process during which the fluid is passing through the fluid inlet part 730, the fluid flows into the guide flow path 713 while hitting the rear wall 732.

Accordingly, when the inlet slot 734 is not provided, there is a disadvantage in that discrimination is lowered when frosting detection is performed due to excessive amount of introduced fluid before frosting.

Of course, also when the inlet slot 734 formed in the rear wall 732 is excessively large, the discrimination may be lowered due to the excessive amount of introduced fluid before frosting.

Even when the inlet slot 734 is provided in the fluid inlet part 730, the inlet slot 734 may be formed in either portion between the fluid inlet part 730 or the cooling source.

Preferably, the inlet slot 734 may be formed such that a flow rate per unit time of the fluid flowing toward the cooling source (e.g., second evaporator) is larger than a flow rate per unit time of the fluid introduced into the guide flow path 713.

The inlet slot 734 is formed to be open from the bottom of the rear wall 732 constituting the fluid inlet part 730 to a predetermined height.

Meanwhile, the slot length Ls (vertical height) of the inlet slot 734 may be configured to be satisfied with a condition of $0.2Li \leq Ls \leq 1.0Li$ with respect to the protruding length Li of the fluid inlet part 730.

In other words, as described based on the comparative tables in FIGS. 20 and 21, as the protruding length Li of the fluid inlet part 730 and the slot length Ls of the inlet slot 734 increases, it may be confirmed that a difference in velocity of flow before and after frosting increases.

However, there is a limit to increasing the protruding length Li of the fluid inlet part 730 and the slot length Ls of the inlet slot 734, and excessively increasing the length of either one or excessively increasing the two lengths may cause adverse effects.

For example, as shown in the graph in FIG. 22, in response to a length ratio of the protruding length Li of the fluid inlet part 730 to the slot length Ls of the inlet slot 734, a difference in the flow rate of the fluid introduced into the guide flow path 713 before and after frosting or a difference in the velocity of flow of the fluid may be significantly changed.

Considering this, by not only limiting either one of the slot length Ls of the inlet slot 734 and the vertical protruding length Li of the fluid inlet part 730, but also providing the optimum ratio of the protruding length Li to the slot length Ls, precise design of the slot length Ls of the inlet slot 734 based on the protruding length Li of the fluid inlet part 730 may be achieved.

Accordingly, the amount of the fluid introduced into the guide flow path 713 may be minimized before frosting and the amount of the fluid introduced into the guide flow path 71 during frosting may be maximized, so that a difference in the amount of the fluid before frosting and during frosting may have sufficient discrimination.

At this point, 0.2 and 1.0 may be the minimum limit and the maximum limit for the downward protruding length Li of the fluid inlet part 730 to the slot length Ls of the inlet slot 734, and the minimum limit and the maximum limit may be limits that may obtain not only detection of frosting but also other information regarding the frosting.

In other words, when the protruding length Li of the fluid inlet part 730 to the slot length Ls of the inlet slot 734 is designed in the ratio between the minimum limit and the maximum limit, it may be determined that whether or not clogging frosting occurs (defrosting operation is required or not) or whether initial frosting occurs (frosting is initial or not).

In the initial point of frosting, the frosting detection operation is not necessarily operated for each cycle, so that power consumption caused by performing the frosting detection operation may be reduced and the power consumption efficiency may be improved.

Preferably, the slot length Ls (vertical height) of the inlet slot 734 may be configured to be satisfied with a condition of $0.2Li \leq Ls \leq 0.8Ls$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740, which will be described later, may additionally differ by ±5° C. or more, so that it may be additionally determined that at least one of whether or not initial frosting occurs and whether or not ice remains after the defrosting operation, in addition to whether or not frost clogging occurs.

Preferably, the slot length Ls (vertical height) of the inlet slot 734 may be configured to be satisfied with a condition of $0.2Li \leq Ls \leq 0.6Li$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740, which will be described later, may additionally differ by ±5° C. or more in comparison with when the protruding length Li of the fluid inlet part 730 to the slot length Ls of the inlet slot 734 is not considered. Accordingly, it may be additionally determined that at least one of whether or not initial frosting occurs and whether or not ice remains after the defrosting operation, in addition to whether or not frost clogging occurs.

Preferably, the slot length Ls (vertical height) of the inlet slot 734 may be configured to be satisfied with a condition of $0.4Li \leq Ls \leq 1.0Li$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740 may additionally differ by ±5° C. or more in comparison with when the protruding length Li of the fluid inlet part 730 to the slot length Ls of the inlet slot 734 is not considered. Accordingly, it may be additionally determined that at least one of whether or not initial frosting occurs and whether or not ice remains after the defrosting operation, in addition to whether or not frost clogging occurs.

Preferably, the slot length Ls (vertical height) of the inlet slot 734 may be configured to be satisfied with a condition of $0.6Li \leq Ls \leq 1.0Li$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740, which will be described later, may additionally differ by ±5° C. or more in comparison with when the protruding length Li of the fluid inlet part 730 to the slot length Ls of the inlet slot 734 is not considered. Accordingly, it may be additionally determined that at least one of whether or not initial frosting occurs and whether or not ice remains after the defrosting operation, in addition to whether or not frost clogging occurs.

Preferably, the slot length Ls (vertical height) of the inlet slot 734 may be configured to be satisfied with a condition of $0.6Li \leq Ls \leq 0.8Li$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740, which will be described later, may additionally differ by ±5° C. or more in comparison with when the protruding length Li of the fluid inlet part 730 to the slot length Ls of the inlet slot 734 is not considered. Accordingly, it may be additionally determined that at least one of whether or not initial frosting occurs and whether or not ice remains after the defrosting operation, in addition to whether or not frost clogging occurs.

Most preferably, the slot length Ls (vertical height) of the inlet slot 734 may be configured to be satisfied with a condition of $0.4Li \leq Ls \leq 0.8Li$ with respect to the protruding length Li of the fluid inlet part 730.

When the protruding length Li of the fluid inlet part 730 to the slot length Ls of the inlet slot 734 is designed so as to be satisfied with the condition, a material property (e.g., temperature difference) detected by the frosting sensor 740 may have the discrimination for frosting detection.

For example, temperatures before and after heating of the heating element 741 constituting the frosting sensor 740, which will be described later, may additionally differ by ±6° C. or more in comparison with when the protruding length Li of the fluid inlet part 730 to the slot length Ls of the inlet slot 734 is not considered. Accordingly, it may be additionally determined that at least one of whether or not initial frosting occurs, whether or not ice remains after the defrosting operation, and internal clogging of the guide flow path 713 occurs, in addition to whether or not frost clogging occurs.

Of course, with the distance ratios, the condition of 0.6Li≤Ls≤0.8Li may have the amount of temperature change larger than the condition of 0.4Li≤Ls≤0.8Li.

However, considering that there is difficulty in designing for the condition of 0.6Li≤Ls≤0.8Li in comparison with the condition of 0.4Li≤Ls≤0.8Li, presetting the distance ratio to the condition of 0.4Li≤Ls≤0.8Li may be preferable.

FIG. 22 is a graph showing the amount of temperature change for each ratio of the protruding length Li of the fluid inlet part 730 to the slot length Ls of the inlet slot 734 (amount of change to temperature without considering relationship between conventional slot length and protruding length).

As shown in the graph, when each distance ratio is satisfied with the condition of 0.4Li≤Ls≤0.8Li, it may be confirmed that the amount of temperature change of ±6° C. or more is additionally obtained.

Meanwhile, an opening sectional area G1 of the fluid inlet 711 of the frosting detection duct 710 may be configured to be satisfied with a condition of 0.8G2≤G1≤1.3G2 based on an opening sectional area G2 of the inlet slot 734.

The condition may be a condition that reduce the deterioration of the discrimination of clogging in the guide flow path 713 or frosting detection caused when the fluid inlet 711 is designed excessively small or large in comparison with the inlet slot 734.

Furthermore, in response to the amount of frosting of the second evaporator 22, the amount of air (fluid) flowing in the inside of the frosting detection duct 710 varies.

In other words, as the amount of frosting of the second evaporator 22 increases and an air flow passing through the second evaporator 22 is gradually clogged, a pressure difference between the air inlet side and the air outlet side of the second evaporator 22 gradually becomes larger. Correspondingly, the amount of air suctioned into the frosting detection duct 710 gradually increases by the pressure difference.

As the amount of air suctioned into the frosting detection duct 710 becomes larger, the temperature of a heating element 741 constituting the frosting sensor 740 described below falls, and a temperature difference value ΔHt in on/off of the heating element 741 (hereinbelow, which is referred to as "logic temperature") falls.

Considering this, as the logic temperature ΔHt inside the frosting detection duct 710 becomes lower, the logic temperature being detected by the frosting sensor 740, the amount of frosting of the second evaporator 22 increases.

Referring to FIG. 23, when there is no frost at the second evaporator 22 or a frosting amount is significantly less, most of the air passes through the second evaporator 22 in the heat-exchange space. On the other hand, some of the air may flow into the frosting detection duct 710.

For example, based on a state in which frosting does not occur on the second evaporator 22, the frosting detection flow path 710 may be configured such that about 98% of the air suctioned via the inlet duct 42*a* passes through the second evaporator 22 and remaining of the air passes through the frosting detection duct 710.

At this point, the amount of air passing through the second evaporator 22 and the frosting detection duct 710 may gradually vary in response to the amount of frosting on the second evaporator 22.

For example, when frost is generated on the second evaporator 22, the amount of air passing through the second evaporator 22 is reduced. On the other hand, the amount of air passing through the frosting detection duct 710 increases.

In other words, compared to the amount of air passing through the frosting detection duct 710 before frosting of the second evaporator 22, the amount of air passing through the frosting detection duct 710 in frosting of the second evaporator 22 significantly increases.

Specifically, it is desirable to configure the frosting detection duct 710 such that change in the amount of air according to the amount of frosting on the second evaporator 22 may be at least doubled. In other words, in order to determine the amount of frosting using the amount of air, the amount of air should be generated by at least two times or more to obtain a detection value sufficient to have discrimination.

Referring to FIG. 24, when the amount of frosting on the second evaporator 22 is large enough to require the defrosting operation, frost on the second evaporator 22 acts as flow path resistance, so that the amount of the air flowing in the heat-exchange space of the evaporator 22 is reduced and the amount of the air flowing in the frosting detection duct 710 increases.

As described above, the flow rate of the air flowing in the frosting detection duct 710 varies according to the amount of frosting of the second evaporator 22.

Furthermore, the frost detecting device 70 may include the frosting sensor 740.

The frosting sensor 740 is a sensor that detects a material property of a fluid passing through inside of the frosting detection duct 710. At this point, the fluid property may include at least one of temperature, pressure, and flow rate.

Specifically, the frosting sensor 740 may be configured to calculate the amount of frosting on the second evaporator 22 on the basis of a difference in an output value that is changed according to the material property of the air (fluid) passing through inside the frosting detection duct 710.

In other words, the amount of frosting on the second evaporator 22 is calculated by a difference in the output value detected by the frosting sensor 740 to be used to determine whether the defrosting operation is required.

The frosting sensor 740 may be a sensor that may detect the amount of frosting on the second evaporator 22 by using a temperature difference in response to the amount of air passing through the frosting detection duct 710.

In other words, as shown in FIG. 25, the frosting sensor 740 is provided at a portion where a fluid flows, inside the frosting detection duct 710, so that the amount of frosting on the second evaporator 22 may be detected on the basis of the output value that changes according to a fluid flow inside the frosting detection duct 710.

Of course, the output value may be variously determined as not only the above-described temperature difference, but also a pressure difference, other property difference, or the like.

As shown in FIG. 26, the frosting sensor 740 may include a detecting derivative.

The detecting derivative may provide for induced improvement of measurement precision so that the sensor (temperature sensor) may further precisely measure a material property (or output value).

The detecting derivative may include the heating element 741. The heating element 741 may be supplied with power and emits heat.

The frosting sensor 740 may include a temperature sensor 742.

The temperature sensor 742 may comprise of a sensing element that measures the temperature around the heating element 741. In other words, considering that the temperature around the heating element 741 varies according to the amount of the air passing through the heating element 741 while passing through inside the frosting detection duct 710, the temperature sensor 742 measures a change in temperature and then the degree of frosting of the second evaporator 22 is calculated on the basis of the change in temperature.

The frosting sensor 740 may include a sensor PCB 743.

The sensor PCB 743 is configured to determine a difference between the temperature detected by the temperature sensor 742 in an OFF state of the heating element and the temperature detected by the temperature sensor 742 in an ON state of the heating element 741.

For example, when the amount of frosting on the second evaporator 22 is less, a flow rate of the air passing through inside the frosting detection duct 710 is less, and in this case, heat generated due to the heat state of the heating element 741 is cooled relatively low by the above-described flowing air. Accordingly, the temperature detected by the temperature sensor 742 is high, and the logic temperature ΔHt is also high.

On the other hand, when the amount of frosting on the second evaporator 22 is large, a flow rate of the air passing through inside the frosting detection duct 710 is large, and in this case, heat generated due to the ON state of the heating element 741 is cooled relatively more by the above-described flowing air. Accordingly, the temperature detected by the temperature sensor 742 is low, and the logic temperature ΔHt is also low.

Therefore, the amount of frosting on the second evaporator 22 may be precisely determined according to high or low of the logic temperature ΔHt, and on the basis of the amount of frosting on the second evaporator 22 determined as described above, the defrosting operation may be performed at the precise time.

In other words, when the logic temperature ΔHt is high, it is determined that the amount of frosting on the second evaporator 22 is low, and when the logic temperature ΔHt is low, it is determined that the amount of frosting on the second evaporator 22 is high. Accordingly, the reference temperature difference value is designated, and when the logic temperature ΔHt is lower than the designated reference temperature difference value, it may be determined that the defrosting operation of the second evaporator 22 is required.

Meanwhile, the sensor PCB 743 may be configured to determine whether the logic temperature ΔHt is less than or equal to a reference difference value.

Meanwhile, the frosting sensor 740 is installed in a direction that crosses a direction of air passing through inside the frosting detection duct 710, and a surface of the frosting sensor 740 and an inner surface of the frosting detection duct 710 are located to be spaced apart from each other. In other words, water may flow down through a gap between the frosting sensor 740 and the frosting detection duct 710 that are spaced apart from each other. At this point, a distance of the gap is preferably formed sufficient to prevent water from staying between the surface of the frosting sensor 740 and the inner surface of the frosting detection duct 710.

It is preferable that the heating element 741 and the temperature sensor 742 may be located together on either surface of the frosting sensor 740. In other words, the heating element 741 and the temperature sensor 742 are located on the same surface, so that the temperature sensor 742 may precisely sense the change in temperature due to heat-emission of the heating element 741.

Furthermore, the frosting sensor 740 may be disposed between a fluid inlet 711 and a fluid outlet 712 of the frosting detection duct 710, inside the frosting detection duct 710. Preferably, the frosting sensor 740 may be disposed at a position spaced apart from the fluid inlet 711 and the fluid outlet 712.

For example, the frosting sensor 740 may be disposed at an intermediate position inside the frosting detection duct 710. The frosting sensor 740 may be disposed at a position inside the frosting detection duct 710 relatively close to the fluid inlet 711 than the fluid outlet 712. Or the frosting sensor 740 may be disposed at a position inside the frosting detection duct 710 relatively closer to the fluid outlet 712 than the fluid inlet 711.

Furthermore, the frosting sensor 740 may include a sensor housing 744.

The sensor housing 744 serves to prevent the water flowing down along the inside of the frosting detection duct 710 from being brought into contact with the heating element, the temperature sensor 742, or the sensor PCB 743.

The sensor housing 744 may be formed such that either one of opposite ends thereof is open. Accordingly, a signal line (or power line) may be led out of the sensor PCB 743.

Next, according to the embodiment of the present disclosure, the refrigerator 1 may include a controller 80.

The controller 80 may be a device that controls operation of the refrigerator 1, such as a microprocessor, an electrical logic circuit, etc.

As shown in FIG. 4, the controller 80 may detect the room temperature and the internal temperature of the storage compartment by using each temperature sensor 1*a*, 1*b*.

The controller 80 may control the frosting sensor 740 or receive the information sensed by the frosting sensor 740.

Furthermore, the controller 80 may control the cooling source.

For example, when the internal temperature of the storage compartment 12, 13 is within the dissatisfaction temperature region divided on the basis of the set reference temperature NT preset by the user for the storage compartment, the controller 80 may control the supply amount of cold air to increase so that the internal temperature of the storage compartment may be reduced. When the internal temperature of the storage compartment is within the satisfaction temperature region divided on the basis of the set reference temperature NT, the controller 80 may control the supply amount of cold air to be reduced.

Furthermore, the controller 80 may control the defrosting device 50.

Furthermore, the controller 80 may control the frost detecting device 70 to perform frost detecting operation.

To this end, the controller 80 may perform the frost detecting operation for a preset frost detecting time. The frosting detecting time may be controlled to vary depending on a temperature value of the room temperature measured by the first temperature sensor 1*a*, or the temperature preset by the user.

For example, as the room temperature becomes higher, the frost detecting time may be controlled to be performed at short intervals due to more frequent cooling operation, and as the room temperature becomes lower, the frost detecting time may be controlled to be performed at sufficiently long intervals due to fewer cooling operations.

Furthermore, the controller 80 may control the frosting sensor 740 to be operated for a predetermined cycle.

In other words, the heating element 741 of the frosting sensor 740 emits heat for a predetermined time by control of the controller 80, and the temperature sensor 742 of the frosting sensor 740 detects the temperature directly after the heating element 741 is turned ON and detects the temperature directly after the heating element 741 is turned OFF.

Therefore, after the heating element 741 is turned ON, the lowest temperature and the highest temperature may be detected and a temperature difference value between the lowest temperature and the highest temperature may be maximized, so that discrimination for frosting detection may be more enhanced.

Furthermore, the controller 80 may detect a temperature difference value (logic temperature ΔHt) when the heating element 741 is turned ON and OFF, and may determine whether the maximum value of the logic temperature ΔHt is less than or equal to a first reference difference value. At this point, the first reference difference value may be preset as a value sufficient not to operate the defrosting operation.

Of course, the sensor PCB 743 constituting the frosting sensor 740 may be configured to perform detecting the logic temperature ΔHt and comparing the logic temperature to the first reference difference value.

In this case, the controller 80 may be configured to receive the detection of the logic temperature ΔHt and the comparison result value with the first reference difference value that are performed by the sensor PCB 743 to control ON/OFF of the heating element 741.

Next, a frosting detection operation for detecting the amount of frosting with respect to the second evaporator 22 will be described.

FIG. 27 is a flowchart showing a control process in which the defrosting operation is performed by determining a defrosting requirement time of the refrigerator. FIGS. 28 and 29 are state graphs showing change in the temperature that is measured by the frosting sensor before frosting and during frosting of the second evaporator.

FIG. 28 is a state graph showing change in temperature of the second storage compartment 13 and change in temperature of the heating element before frosting of the second evaporator 22. FIG. 29 is a state graph showing change in temperature of the second storage compartment and change in temperature of the heating element during frosting of the second evaporator (when frosting occurs while exceeding a permissible value).

As shown in the drawings, after the preceding frosting operation terminates, at S1, cooling operation of each storage compartment 12, 13 based on the first set reference temperature and the second set reference temperature is performed under the control of the controller 80, at S110.

At this point, the above-described cooling operation is performed under the operation control of at least either one of the first evaporator 21 and the first cooling fan 31 according to the first operational reference value designated on the basis of the first set reference temperature, and the cooling operation is performed under the operation control of at least either one of the second evaporator 22 and the second cooling fan 41 according to the second operational reference value designated on the basis of the second set reference temperature.

For example, when the internal temperature of the first storage compartment 12 is within the dissatisfaction temperature region divided on the basis of the first set reference temperature preset by the user, the controller 80 controls the first cooling fan 31 to be operated, and when the internal temperature is within the satisfaction temperature region, the controller 80 controls the first cooling fan 31 to stop operating.

At this point, the controller 80 controls the refrigerant valve 63 to selectively open and close the refrigerant path 61, 62, thereby performing the cooling operation with respect to the first storage compartment 12 and the second storage compartment 13.

Furthermore, cooling operation for the second storage compartment 13 is performed by providing air (cold air) passing through the second evaporator 22 into the second storage compartment 13 by operation of the second cooling fan 41. The cold air circulated inside the second storage compartment 13 flows toward the air inlet side of the second evaporator 22 by guidance of the inlet duct 42*a* constituting the second fan duct assembly 40 and then repeatedly flows while passing through the second evaporator 22.

At this point, most (e.g., about 98%) of air that flows toward the air inlet side of the second evaporator 22 by guidance of the inlet duct 42*a* may pass through the second evaporator 22. However, some (e.g., about 2%) of air is introduced into the guide flow path 713 via the fluid inlet 711 of the frosting detection duct 710 located at the air inlet side of the second evaporator 22.

Specifically, the fluid outlet 712 of the frosting detection duct 710 is disposed at a location considering a pressure difference with the fluid inlet 711 and is disposed at a location considering an effect of a pressure generated by an operation of the second cooling fan 41 (location considering a spacing from the second cooling fan).

Accordingly, air passing through the frosting detection duct 710 is less affected by a pressure of the second cooling fan 41 and some air forcibly flows by a pressure difference between the fluid outlet 712 and the fluid inlet 711 even in non-frosting. Accordingly, minimum discrimination (temperature difference before and after frosting) for the frosting detection may be secured.

In addition, during the general cooling operation described above, confirming the cycle to perform the frost detecting operation is continuously determined, at S120.

At this point, the performance cycle of the frost detecting operation may be a cycle of time, and may be a cycle in which the same operation such as a specific component or operation cycle is repeatedly performed. The cycle may be a cycle in which the second cooling fan 41 is operated.

The frost detecting device 70 is configured to detect the amount of frosting on the second evaporator 22 on the basis of a temperature difference value (logic temperature ΔHt) in response to a change in the flow rate of air passing through the guide flow path 713.

Considering this, as the logic temperature ΔHt becomes higher, the reliability of a detection result of the frost detecting device 70 may be secured, and when the second cooling fan 41 is operated, the highest logic temperature ΔHt may be secured.

The second cooling fan 41 of the second fan duct assembly 40 may be operated while the operation of the first cooling fan 31 of the first fan duct assembly 30 stops. Of course, when necessary, the second cooling fan 41 may be controlled to be operated also when the operation of the first cooling fan 31 does not completely stop.

The heating element 741 may be controlled to emit heat simultaneously while power is supplied to the second cooling fan 41, or the heating element 741 may be controlled to emit heat immediately after power is supplied to the second cooling fan 41 or when a certain condition is satisfied while power has been supplied to the second cooling fan 41.

The heating element 741 may be controlled to emit heat when a certain condition is satisfied while power is supplied to the second cooling fan 41. In other words, when the cycle for the frost detecting operation comes up, when the heating condition of the heating element 741 is confirmed, at S130, and then the heating condition is satisfied, the heating element 741 is controlled to emit heat.

The heating condition may include at least either basic condition of the condition in which after the second cooling fan 41 is operated and the preset time elapses, the heating element is controlled to automatically emit heat; the condition in which before the second cooling fan 41 is operated the internal temperature (temperature detected by temperature sensor) of the guide flow path 713 gradually falls; the condition in which the second cooling fan 41 is in operation; and the condition in which the door of the second storage compartment 13 is not opened.

In addition, when it is confirmed that the above-described heating condition is satisfied, while the heating element 741 emits heat under the control of the controller 80 (or control of sensor PCB) at S140.

Furthermore, the above-described heating of the heating element 741 is performed, and the temperature sensor 742 detects a material property in the guide flow path 713, e.g., the temperature Ht1, at S150.

The temperature sensor 742 may detect the temperature Ht1 simultaneously while the heating element 741 emits heat, and after heat-emission of the heating element 741 is performed, the temperature sensor 742 may detect the temperature Ht1.

Specifically, the temperature Ht1 detected by the temperature sensor 742 may be the minimum temperature inside the guide flow path 713 to be confirmed after the heating element 741 is turned ON.

The detected temperature Ht1 may be stored in the controller (or sensor PCB).

In addition, the heating element 741 emits heat for a preset heating time. At this point, the preset heating time may be a time that may have the discrimination for a change in temperatures inside the guide flow path 713.

For example, it is preferable that the logic temperature ΔHt when the heating element 741 emits heat for the preset heating time has the discrimination except for the logic temperature ΔHt by predicted or unpredicted other factors.

The preset heating time may be the specific time, or may be the time that is variable in response to the peripheral environment.

For example, the preset heating time may be the time shorter than a difference between the time, which is required for the changed cycle when the operational cycle of the first cooling fan 31 for the cooling operation of the first storage compartment 12 is changed to be shorter than the preceding operational cycle, and the time required for the above-described heating condition.

Furthermore, the preset heating time may be the time shorter than a difference between the time changed when the operational time of the second cooling fan 41 for the cooling operation of the second storage compartment 13 is changed to be shorter than the preceding operational time, and the time required for the above-described heating condition.

Furthermore, the preset heating time may be the time shorter than the operational time of the second cooling fan 41 when the second storage compartment 13 is operated at the maximum load.

Furthermore, the preset heating time may be the time shorter than a difference between the time for the second cooling fan 41 to be operated in response to a change in the internal temperature of the second storage compartment 13 and the time required for the above-described heating condition.

Furthermore, the preset heating time may be the time shorter than a difference between the operation times of the second cooling fan 41 changed in response to the designated internal temperature of the second storage compartment 13 designated by the user and the time required for the above-described heating condition.

In addition, when the preset heating time elapses, while the supply of power to the heating element 741 is interrupted, heat-emission of the heating element 741 may stop, at S160.

Of course, even when the heating time does not elapse, supply of power to the heating element 741 may be controlled to be interrupted.

For example, when the temperature detected by the temperature sensor 742 exceeds a preset temperature value (e.g., 70° C.), the supply of power to the heating element 741 may be controlled to be interrupted, and when the door of the second storage compartment 13 is opened, the supply of power to the heating element 741 may be controlled to be interrupted.

When unexpected operation of the first storage compartment 12 (operation of first cooling fan) occurs, the supply of power to the heating element 741 may be controlled to be interrupted.

When the second cooling fan 41 is turned OFF, the supply of power to the heating element 741 may be controlled to be interrupted.

As described above, when heat-emission of the heating element 741 stops, a value of a material property of the guide flow path 713 detected by the temperature sensor 742, i.e., the temperature Ht2 may be detected, at S170.

At this point, the temperature detection of the temperature sensor 742 may be performed simultaneously with the stop of heat-emission of the heating element 741, and may be performed after heat-emission of the heating element 741 stops.

Specifically, the temperature Ht2 detected by the temperature sensor 742 may be the maximum temperature inside the guide flow path 713 to be confirmed at a point of time before and after the heating element 741 is turned OFF.

The detected temperature Ht2 may be stored in the controller 80 (or, sensor PCB).

In addition, the controller 80 (or sensor PCB) may calculate each logic temperature ΔHt on the basis of each detected temperature Ht1, Ht2, and may determine whether or not the defrosting operation with respect to the cooling source 22 (second evaporator) is performed, on the basis of the logic temperature ΔHt calculated as described above.

In other words, after calculating at S180 and storing a difference value ΔHt between the temperature Ht1 when the heating element 741 emits heat and the temperature Ht2 when heat-emission of the heating element 741 terminates, the controller 80 may determine whether or not the defrosting operation is performed, on the basis of the logic temperature ΔHt.

For example, when the logic temperature ΔHt is higher than the preset first reference difference value, the flow rate of air in the guide flow path 713 is less, and thus the controller may determine that the amount of frosting on the second evaporator 22 is less than the amount of frosting required for the defrosting operation.

In other words, when the amount of frosting on the second evaporator 22 is less, a difference between a pressure at an air inlet and a pressure at an air outlet of the second evaporator 22 is small, and thus the flow rate of air flowing in the guide flow path 713 is small, so that the logic temperature ΔHt is relatively high.

On the other hand, when the logic temperature ΔHt is lower than the preset second reference difference value, the flow rate of air in the guide flow path 713 is large, so that the controller may determine that the amount of frosting on the second evaporator 22 is sufficient to perform the defrosting operation.

In other words, when the amount of frosting on the second evaporator 22 is large, a difference between a pressure at the air inlet and a pressure at the air outlet of the second evaporator 22 is great, and the flow rate of air flowing in the guide flow path 713 is large due to the difference in pressure, so that the logic temperature ΔHt is relatively low.

At this point, the second reference difference value may be a value that is preset sufficiently to perform the defrosting operation. Of course, the first reference difference value and the second reference difference value may be the same value, or the second reference difference value may be preset as a lower value than the first reference difference value.

The first reference difference value and the second reference difference value may be one specific value or be a value in a range.

For example, the second reference difference value may be 24° C., and the first reference difference value may be the temperature in the range from 24° C. to 30° C.

Meanwhile, when the protruding length Li of the fluid inlet part to the slot length Ls of the inlet slot is configured to be satisfied with a condition of $0.4 \leq Ls/Li \leq 0.8$, the temperature change amount with respect to the distance ratio before and after heat-emission of the heating element constituting the frosting sensor obtains additionally ±6° C. or more. Therefore, the logic temperature ΔHt may be obtained to about 36° C.

Accordingly, whether or not the logic temperature reaches a difference value between the first reference difference value and the second reference difference value may be precisely determined and a variety of information that is differently configured with the first reference difference value and the second reference difference value may be identified.

For example, each reference difference value may be divided into not only the first reference difference value and the second reference difference value, but also at least one of a reference difference value that may recognize whether or not frost clogging occurs, a reference difference value that may recognize whether or not initial frosting occurs, a reference difference value that may recognize whether or not ice remains after the defrosting operation is performed, a reference difference value that may recognize clogging inside the guide flow path 713, and a reference difference value that may recognize sensor freezing.

In other words, as the optimum ratio of the protruding length Li of the fluid inlet part 730 to the slot length Ls of the inlet slot 734 considering flow-back of the fluid during frosting is designed, additional temperature change amount of 6° C. or more may be obtained, so that a variety of information such as clogging of a flow path or detection of initial temperature after defrosting may be performed.

Specifically, a cycle for performing the frosting detection operation may be configured to be changed in response to division of the above-described reference difference values and the maximum temperature change amount.

For example, when it is detected that the logic temperature is within 28° C. to 30° C., the cycle may be preset such that the frosting detection operation is not performed for each cycle but one, or two or more frosting detection operations are omitted.

In addition, as a comparative result for the logic temperature and each of the above-described reference difference values, when the logic temperature ΔHt detected by the controller 80 is higher than the preset first reference difference value (e.g., 24° C. to 30° C.), it may be determined that the amount of frosting on the second evaporator 22 has failed to reach the preset amount of frosting.

In this case, after operation of the second cooling fan 41 stops, frosting detection may stop until a following cycle is operated.

Next, the operation of the following cycle of the second cooling fan 41 is performed, the process of determining whether or not the heating condition for the frosting detection is satisfied may be repeatedly performed.

However, when the logic temperature ΔHt detected by the controller 80 is lower than the preset second reference difference value (e.g., 24° C.), the controller determines that the second evaporator 22 exceeds the preset amount of frosting, the defrosting operation may be controlled to be performed, at S2.

At this point, when the defrosting operation is performed, the logic temperature ΔHt for each frosting detection cycle that is stored may be reset.

Next, a process S2 of performing the defrosting operation with respect to the second evaporator 22 will be described below.

First, after the heating element 741 is turned off, the defrosting operation may be performed by determination of the controller 80.

When the defrosting operation is performed, the first heater 51 constituting the defrosting device 50 may emit heat.

In other words, it is configured that heat generated by heat-emission of the first heater 51 is used to remove frost generated on the second evaporator 22.

At this point, when the first heater 51 comprising of the sheath heater is turned on, heat generated by the first heater 51 removes frost generated on the second evaporator 22 in radiation and convection.

Furthermore, when the defrosting operation is performed, the second heater 52 constituting the defrosting device 50 may emit heat.

In other words, it is configured that heat generated by heat-emission of the second heater 52 is used to remove frost generated on the second evaporator 22.

At this point, when the second heater 52 comprising of the L-cord heater is turned on, heat generated by the second heater 52 is conducted into a heat-exchange fin, thereby removing frost generated on the second evaporator 22.

The first heater 51 and the second heater 52 may be controlled to emit heat simultaneously, or it may be controlled that the first heater 51 emits heat preferentially and then the second heater 52 emits heat, or it may be controlled that the second heater 52 emits heat preferentially and then the first heater 51 emits heat.

In addition, after heat-emission of the first heater 51 or the second heater 52 is performed for a preset time, heat-emitting of the first heater 51 or the second heater 52 stops.

At this time, even when the first heater 51 and the second heater 52 are provided together, the stopping of heat-emission may be performed in the two heaters 51 and 52, but may be controlled such that heat-emission of either heater stops preferentially and then heat-emission of the other heater stops next.

The time for heat-emission of each heater 51, 52 may be preset by the specific time (e.g., 1 time, etc.) or may be preset by the time that is variable in response to the amount of frosting.

Furthermore, the first heater 51 or the second heater 52 may be operated at the maximum load, or operated at the load that is variable in response to the amount of defrosting.

In addition, when the defrosting operation depending on operation of the defrosting device 50 is performed, the heating element 741 constituting the frosting sensor 740 may be controlled to emit heat with the defrosting operation.

In other words, in the defrosting operation, considering that water caused by frost melting may also flow into the guide flow path 713, it may be preferable that the heating element 741 also emits heat to prevent the flowing water from freezing in the guide flow path 713.

Furthermore, the defrosting operation may be performed on the basis of time, or temperature.

In other words, when the defrosting operation is performed for randomized time, the defrosting operation may be controlled to terminate, and when the temperature of the second evaporator 22 reaches the preset temperature, the defrosting operation may be controlled to terminate.

In addition, when operation of the above-described defrosting device 50 is completed, the first cooling fan 31 is operated at the maximum load to allow the first storage compartment 12 to reach the preset temperature range and then the second cooling fan 41 is operated at the maximum load, so that the second storage compartment 13 may reach the preset temperature range.

At this point, when the first cooling fan 31 is operated, the refrigerant compressed from the compressor 60 may be controlled to be supplied to the first evaporator 21, and when the second cooling fan 41 is operated, the refrigerant compressed from the compressor 60 may be controlled to be supplied to the second evaporator 22.

In addition, when the temperature conditions of the first storage compartment 12 and the second storage compartment 13 are satisfied, the above-described control for the frosting detection of the second evaporator 22 performed by the frost detecting device 70 is successively performed.

Of course, immediately after operation of the defrosting device 50 is completed, it may be preferable to detect remaining ice to determine whether or not additional defrosting operation is required.

In other words, when remaining ice is detected, an additional defrosting operation is performed even though a defrosting operation cycle does not come up, and the remaining ice may be completely removed.

Meanwhile, the defrosting operation may not be performed only based on the information obtained by the frost detecting device 70.

For example, due to the user's negligence, the door of either storage compartment may be opened for a long time (including tiny-opening, etc.).

This state may be recognized by a sensor that performs opening detection of the door, and in this case, the defrosting operation may be preset to be forcibly performed when a certain time elapses without operating the frost detecting device 70.

Furthermore, when the frosting detection operation is not cyclically performed due to excessive frequent opening and closing of the door, without using the information obtained by the frost detecting device 70, the defrosting operation may be preset to be forcibly performed at preset time considering frequent opening and closing of the door.

Furthermore, after the defrosting operation is completed, the above-described cooling operation is performed at S110, and continuously, the frosting detecting operation for detecting frosting is performed again.

Specifically, by the logic temperature configured after the defrosting operation is completed and the frosting detection operation is performed, either confirmation of remaining ice, failure of the temperature sensor 742, and clogging of the guide flow path 713 may be confirmed.

For example, Immediately after defrosting, when the logic temperature detected during initial frosting detection operation is equal to or less than 14° C., freezing of the temperature sensor 742 may be determined, and when the logic temperature is detected to be 37° C. or more, clogging of the guide flow path 713 may be determined, and when the logic temperature is detected to be within a range between 28° C. and 30° C., it may be determined that ice remains on the cooling source.

Therefore, in the refrigerator of the present disclosure, the flow path resistance is provided to a portion of the frosting detection duct 710 where a fluid is introduced, so that even when frosting is insignificant the amount of fluid flowing into the frosting detection duct 710 may be minimized. While frosting is performed, the fluid may smoothly flow by a pressure difference between the fluid inlet part 730 and the fluid outlet 712 even with the flow path resistance.

The refrigerator 1 of the present disclosure is configured to design the protruding length Li of the fluid inlet part 730 to the slot length Ls of the inlet slot 734 formed in the fluid inlet part 730 to be satisfied with a condition of $0.2 \leq Ls/Li \leq 1.0$. Accordingly, comparing when only a vertical opening distance of the inlet slot 734 is changed or only a vertical protruding length of the fluid inlet part 730 is changed, the logic temperature for frosting detection may increase.

Furthermore, a value of a larger temperature range may be obtained than a reference temperature difference value used for conventional frosting determination as the logic temperature, so that the refrigerator of the present disclosure may have the discrimination that may additionally identify a cause related to a variety of frosting in addition to serving to simply detect frosting detection.

Furthermore, in the refrigerator of the present disclosure, the opening sectional area G1 of the fluid inlet 711 may be designed to be satisfied with a condition of $0.8G2 \leq G1 \leq 1.3G2$ based on the opening sectional area G2 of the inlet slot 734. Accordingly, it may be possible to reduce the deterioration of the discrimination caused when the fluid inlet is designed excessively smaller or larger than the inlet slot 734.

Meanwhile, as the frosting detecting device 70 constituting the refrigerator of the present disclosure, not only the above-described first embodiment, but various embodiments to improve the performance for frosting detection or prevent flow path clogging, etc., may be provided.

This will be described in detail for each embodiment as follows.

First, the present disclosure may have a structure of a second embodiment to improve the discrimination for frosting detection.

In the second embodiment of the present disclosure, the detection precision for frosting detection may be improved by providing the optimum design condition for the relationship between the slot length Ls of the inlet slot 734 and the protruding length Li of the fluid inlet part 730 of the frosting detection duct 710.

To this end, the protruding length Li of the fluid inlet part 730 may be designed by considering a flow path depth D (referring to FIG. 30) in the frosting detection duct 710 (more specifically, guide flow path).

In other words, in response to a distance ratio of the protruding length Li to the flow path depth D of the fluid inlet part 730, a difference of the flow rate or a difference of the velocity of flow of the fluid introduced into the guide flow path 713 before and after frosting may be significantly changed, and thus a difference of temperature change may be significantly changed.

The maximum depth of the flow path depth in the guide flow path 713 may be preset considering the flow rate of the fluid and the width of the frosting sensor 740, and when defrosting water is introduced into the guide flow path 713, the minimum depth may be determined considering smooth flowing of the defrosting water.

When considering the flow rate of the fluid and the width of the frosting sensor 740 and flowing of the defrosting water, the flow path depth D may be configured to be satisfied with a condition of 7.62 mm≤D≤22 mm.

The protruding length Li of the fluid inlet part 730 considering the flow path depth D in the guide flow path 713 is preferably configured to be satisfied with a condition of 0.5D≤Li≤2.0D.

In the condition, 0.5 and 2.0 may be the minimum limit value and the maximum limit value with respect to the flow path depth D in the guide flow path 713 to the protruding length L of the fluid inlet part 730.

The minimum limit value and the maximum limit value may be limit values that may obtain not only frosting confirmation, but also other information related to the frosting.

In other words, when the protruding length L of the fluid inlet part 730 considering the flow path depth D in the guide flow path 713 is designed in a ratio between the minimum limit value to the maximum limit value, the amount of temperature change that has the discrimination sufficient to precisely perform the determination of whether or not frost clogging occurs (whether or not defrosting operation is required).

FIG. 31 is a graph showing the amount of temperature change with respect to a ratio of a protruding length of the fluid inlet to a fluid depth.

As shown in the graph, as the protruding length Li of the fluid inlet part 730 is designed on the basis of the condition, the minimum temperature change amount (e.g., temperature change before and after heat-emission of ±3.8° C. or more) may be obtained. Furthermore, not only defrosting start time may be configured, but also it may detect whether or not initial frosting occurs by the minimum temperature change amount obtained as described above. At this point, in the initial point of frosting, the frosting detection operation is not necessarily operated for each cycle, so that power consumption caused by performing the frosting detection operation may be reduced and the power consumption efficiency may be improved.

As an example, the protruding length Li of the fluid inlet part 730 may be configured to be satisfied with a condition of 0.5D≤Li≤1.5D with respect to the flow path depth D in the guide flow path 713.

When the protruding length Li of the fluid inlet part 730 is designed to be satisfied with the condition, a material property (e.g., temperature difference) detected by the frosting sensor 740 may have the discrimination sufficient to precisely recognize frosting.

For example, when the design is performed considering the above condition, a temperature difference before and after heat-emission of the heating element 741 of the frosting sensor 740 may be additionally obtained as ±4.0° C. or more, in comparison when the design is performed such that the fluid inlet part 730 does not protrude without considering the condition. Accordingly, it may be additionally determined that at least one of whether or not ice remains after the defrosting operation, in addition to whether or not frost clogging occurs and whether or not initial frosting occurs.

As another example, the protruding length Li of the fluid inlet part 730 may be configured to be satisfied with a condition of 1.0D≤Li≤2.0D with respect to the flow path depth D in the guide flow path 713.

When the protruding length Li of the fluid inlet part 730 is designed to be satisfied with the condition, a material property (e.g., temperature difference) detected by the frosting sensor 740 may have the discrimination sufficient to precisely recognize frosting.

For example, when the design is performed considering the above condition, a temperature difference before and after heat-emission of the heating element 741 of the frosting sensor 740 may be additionally obtained as ±4.0° C. or more, in comparison when the design is performed such that the fluid inlet part 730 does not protrude without considering the condition. Accordingly, it may be additionally determined that at least one of whether or not ice remains after the defrosting operation, in addition to whether or not frost clogging occurs and whether or not initial frosting occurs.

As another example, the protruding length Li of the fluid inlet part 730 may be configured to be satisfied with a condition of 1.0D≤Li≤1.5D with respect to the flow path depth D in the guide flow path 713.

When the protruding length Li of the fluid inlet part 730 is designed to be satisfied with the condition, a material property (e.g., temperature difference) detected by the frosting sensor 740 may have the discrimination sufficient to precisely recognize frosting.

For example, when the design is performed considering the above condition, a temperature difference before and after heat-emission of the heating element 741 of the frosting sensor 740 may be additionally obtained as ±4.5° C. or more, in comparison when the design is performed such that the fluid inlet part 730 does not protrude without considering the condition. Accordingly, the logic temperature ΔHt to about 36° C. may be obtained.

The logic temperature ΔHt may be used to additionally confirm at least one of whether or not ice remains after the defrosting operation, confirmation of initial temperature after defrosting, and internal clogging of the guide flow path 713 in addition to whether or not frost clogging occurs and whether or not initial frosting occurs.

The comparative table in FIG. 32 shows a temperature change amount and an operation logic that may be performed by the temperature change amount, in designing the protruding length Li of the fluid inlet part 730 considering the flow path depth D in the guide flow path 713.

Accordingly, whether or not the logic temperature reaches a difference value between the first reference difference value and the second reference difference value may be precisely determined and a variety of information that is differently configured with the first reference difference value and the second reference difference value may be identified.

As described above, in the refrigerator according to the second embodiment of the present disclosure, the protruding length L of the fluid inlet part 730 is designed considering the flow path depth D of the guide flow path 713, so that the discrimination that is sufficient to precisely determine clogging of the guide flow path 713 and determine additional information about frosting may be obtained.

Next, the present disclosure may have a structure of a third embodiment to improve the discrimination for frosting detection.

In the third embodiment of the present disclosure, the protruding length Li of the fluid inlet part 730 may be designed considering the flow path height H1 (referring to FIG. 33) provided by the flow path of the fluid provided between the inlet duct 42*a* (first duct) and the bottom of the inner casing 11*a*.

In other words, considering that the protruding length Li of the fluid inlet part 730 is provided to perform a function as the flow path resistance to a flow of the fluid passing through the flow path, the flow path height H1 of the flow path may be considered together.

As an example, the protruding length Li of the fluid inlet part 730 may be configured to be satisfied with a condition of H1−H1 5/15≤Li≤H1+H1 10/15 with respect to the flow path height H1 formed by the flow path of the fluid provided between the inlet duct 42*a* and the bottom of the inner casing 11*a*.

With the protruding length Li of the fluid inlet part 730 designed by being satisfied with the condition, the fluid passing through the flow path may be induced such that a flow rate thereof flowing toward a side with the second evaporator 22 is larger than a flow rate flowing into the guide flow path 713 via the fluid inlet 711. In other words, with the satisfaction of the condition, only about 2% of the fluid passing through the flow path is introduced into the guide flow path 713, and about 98% of the fluid passes through the second evaporator 22.

Specifically, during non-frosting of the second evaporator 22 (when ice is not sufficient to perform defrosting operation), the flow rate of the fluid flowing into the guide flow path 713 may be minimized.

As another example, in order to improve the discrimination obtained by the protruding length Li of the fluid inlet part 730, the protruding length Li of the fluid inlet part 730 may be configured to be satisfied with a condition of H1−H1 5/15≤Li≤H1+H1 5/15 with respect to the flow path height H1.

As described above, in the refrigerator according to the third embodiment of the present disclosure, the protruding length of the fluid inlet part 730 is designed considering the height of the flow path of the fluid flowing toward cooling source, so that the discrimination that is sufficient to precisely determine clogging of the guide flow path 713 and determine additional information about frosting may be obtained.

Next, the present disclosure may have a structure of a fourth embodiment for the frosting sensor to be precisely coupled to the guide flow path.

In a fourth embodiment of the present disclosure, installation grooves 714 (referring to FIG. 34) may be formed by being recessed on opposite lateral wall surfaces in the guide flow path 713 of the frosting detection duct 710 and opposite ends of the frosting sensor 740 may be installed in the installation grooves 714.

The installation grooves 714 may be formed such that the opposite ends of the frosting sensor 740 are inserted from the rear side of the guide flow path 713 (open rear surface) toward the bottom surface in the guide flow path 713.

Preferably, the installation grooves 714 may be located at a position (position at ⅔ of distance from fluid inlet to fluid outlet) where a flow of the fluid introduced via the fluid inlet 711 and flowing toward the fluid outlet 712 is stabilized.

The installation grooves 714 may be formed at a depth sufficient for the frosting sensor 740 to be located at a regular position thereof. In other words, when the frosting sensor 740 is inserted to reach an end in the installation grooves 714, the frosting sensor 740 is placed in the regular position thereof. At this point, the regular position means a position where a front surface of the frosting sensor 740 is spaced apart from the bottom surface of the guide flow path 713 by at least 1.5 mm or more and is spaced apart from the open rear surface of the guide flow path 713 by at least 1.5 mm or more. In other words, considering that water may not smoothly drain via a gap less than 1.5 mm and stays in the guide flow path 713, the minimum gap (1.5 mm) that may be sufficient for water to drain is preferably provided between the frosting sensor 740 and the bottom surface of the guide flow path 713 and between the frosting sensor 740 and the flow path cover 720, which will be described later. To this end, the insertion depth D of the guide flow path 713 constituting the frosting detection duct 710 may be configured to be satisfied with a condition of (1.5 mm2)+T≤D with respect to the thickness T of the frosting sensor 740. At this point, the insertion depth D and the thickness T are as shown in FIG. 35.

Accordingly, it is possible to prevent freezing of the frosting sensor 740 due to when water does not drain via the gap and stay.

A separation preventing protrusion 715 may be formed by protruding on the inner portion of the installation grooves 714 so that when the frosting sensor 740 is located at the regular position, the separation preventing protrusion 715 may block a part of a rear surface of the frosting sensor 740. In other words, as shown in FIGS. 36 and 37, the frosting sensor 740 in the installation grooves 714 is prevented from being unintentionally separated from the regular position, by the separation preventing protrusion 715. At this point, the separation preventing protrusion 715 may be formed to protrude by a distance that is sufficient for the frosting sensor 740 to be smoothly installed in the installation grooves 714. In other words, it is preferable to prevent an operation of forcibly inserting the frosting sensor 740 into the installation grooves 714 to be performed with difficulty due to the excessive protruding distance of the separation preventing protrusion 715.

Next, the present disclosure may have a structure of a fifth embodiment for precise coupling of the frosting sensor 740.

FIGS. 38 to 41 are views each showing a state of each part related to the fifth embodiment.

In the fifth embodiment of the present disclosure, a protrusion end 744*a* may be formed by protruding on a front surface of the sensor housing 744 (surface facing bottom surface in guide flow path) (surface facing upper portion, referring to FIG. 38).

The protrusion end 744*a* may be formed to protrude toward the inside of the guide flow path 713 while having a width smaller than the front surface of the sensor housing 744.

The protrusion end 744*a* may be provided to allow a worker to recognize a longitudinal direction of the sensor housing 744. In other words, the protrusion end 744*a* is for a protruding direction of the protrusion end 744*a* to be referenced in a process in which the worker installs the frosting sensor 740 to the guide flow path 713.

Insertion grooves 718 having the same shapes as the protrusion end 744*a* are additionally formed in the installation grooves 714 formed on the opposite lateral wall surfaces of the guide flow path 713 and the protrusion end 744*a* may be configured to be partially inserted into the insertion grooves 718.

In other words, the protrusion end 744*a* may be engaged by formation of the insertion grooves 718, thereby preventing shaking of the frosting sensor 740, and when the frosting sensor 740 is installed while front and rear surfaces are upside down, the frosting sensor 740 may be separated from the regular position in the installation grooves 714 by the depth of the insertion grooves 718 (or protruding height of protrusion end).

Furthermore, at least one portion of the flow path cover 720 may be formed to be in contact with the frosting sensor 740 installed in the guide flow path 713.

For example, contact protrusions 722 (referring to FIGS. 42 and 43) may be formed in the flow path cover 720 and the contact protrusions 722 may be partially inserted into the installation grooves 714 of the guide flow path 713. The contact protrusions 722 may be formed to protrude forward from opposite lateral portions of a front surface of the flow path cover 720. Accordingly, when the flow path cover 720 is covered with the frosting detection duct 710, the contact protrusions 722 may be in contact with the frosting sensor 740 installed at the regular position in the installation grooves 714.

When the frosting sensor 740 is installed with the front and rear surfaces upside down, the frosting sensor 740 may be separated from the regular position in the installation grooves 714 by the depth of the insertion groove 718 (or protruding height of protrusion end). Accordingly, the contact protrusions 722 inserted into the installation grooves 714 prevent the flow path cover 720 from being placed on the placing step 42*c* of the fan grille 42. The above-described structure is a shown in FIG. 44. Accordingly, the worker may confirm whether or not the flow path cover 720 is precisely coupled to the frosting detection duct 710 to recognize whether or not the frosting sensor 740 is precisely installed.

Next, the present disclosure may have a structure of a sixth embodiment for the flow path cover 720 to be precisely coupled to the guide flow path 713.

In the sixth embodiment of the present disclosure, a coupling part may be provided at least either one of an upper end and the lower end of the flow path cover 720, and the coupling part is provided for coupling of the flow path cover 720 to the frosting detection duct 710.

As an example, first coupling parts 721 may be formed on an upper end of the flow path cover 720.

The upper end of the flow path cover 720 may be coupled to the guide flow path 713 by the first coupling parts 721.

As shown in FIGS. 45 to 48, the first coupling parts 721 are formed to protrude upward from opposite lateral portions of the upper end of the flow path cover 720 into curved shapes, and are installed to penetrate coupling holes 717*c* (referring to FIGS. 49 to 52) formed at opposite lateral portions of the fluid outlet part 717.

As another embodiment, a second coupling part 731*a* may be formed at the lower end of the flow path cover 720. This structure is as shown in FIG. 53.

The second coupling part 731*a* may serve to couple the lower portion of the flow path cover 720 to the frosting detection duct 710.

The second coupling part 731*a* may be formed at the fluid inlet part 730 formed at the lower end of the flow path cover 720. Specifically, the second coupling part 731*a* may be formed into at least one or more hook structures that are protruding forward from a front surface of the front wall 731 constituting the fluid inlet part 730.

At this point, fitting grooves 713*a* may be formed on the bottom surface in the guide flow path 713 so that the second coupling parts 731*a* of the hook structure are fitted into the fitting grooves 713*a*. This structure is as shown in FIG. 54.

A front surface of each of the second coupling parts 731*a* is formed to be curved and bent to allow the second coupling part 731*a* to be easily inserted into the fitting grooves 713*a* and to prevent the second coupling part 731*a* from being unintentionally separated when being inserted into the fitting grooves 713*a*.

Next, the present disclosure has a structure of a seventh embodiment to prevent water from entering the guide flow path.

In the seventh embodiment of the present disclosure, a mounting protrusion 717*a* may be formed in the fluid outlet part 717 to prevent water from being introduced into the guide flow path. This structure is as shown in FIGS. 49 to 52.

The mounting protrusion 717*a* may be formed to protrude downward from a portion where a fluid is introduced into the fluid outlet part 717 to be inserted into the guide flow path 713 formed in the fan grille 42.

In other words, with the mounting protrusion 717*a* of the fluid outlet part 717 formed to be inserted into the guide flow path 713, when the defrosting water or condensate water is introduced into the fluid outlet 712, the water does not stay in a connected portion between the fluid outlet part 717 and the guide flow path 713 and may flow smoothly.

Furthermore, a blocking protrusion 717*b* may be formed on a portion of a rear surface of the shroud 43, the portion being located above the fluid outlet part 717 (above fluid outlet).

Specifically, the blocking protrusion 717*b* may be formed to block an upper portion of the fluid outlet 712.

In other words, with the blocking protrusion 717*b* provided, water flowing along the rear surface of the shroud 43 is prevented from being introduced into the fluid outlet 712.

The blocking protrusion 717*b* may have an upward convex curved structure (referring to the accompanying drawings), may have an upward convex inclined structure, or may also have a simple linear structure.

Therefore, according to the seventh embodiment of the present disclosure, flowing of water into the guide flow path 713 may be prevented.

Next, the present disclosure may have a structure of an eighth embodiment to prevent the fluid outlet 712 of the frosting detection duct 710 from being blocked due to water freezing.

According to the eighth embodiment of the present disclosure, the frosting detecting device may have inclined surfaces 733*a* formed on circumferential wall surfaces of the fluid inlet part 730. The shape is as shown in FIGS. 57 and 58.

The inclined surfaces 733*a* may be formed to be inclined inward in a downward direction, and with the inclined surfaces 733*a* provided, water such as condensate water generated on the lateral walls 733 of the fluid inlet part 730 may flow down without being gathered at this portion.

In other words, as water is not formed on the fluid inlet part 730, water freezing is prevented, and the open lower surface of the fluid inlet part 730, or the inlet slot 734 may be prevented from being clogged by the water freezing.

The inclined surfaces 733*a* may be formed on the two lateral walls 733.

Next, the present disclosure may have a structure of a ninth embodiment for a signal line 745 of the frosting sensor 740 to be stably led.

In the ninth embodiment of the present disclosure, a leading guide groove 716 may be formed in the guide flow path 713. This structure is as shown in FIGS. 49, 52, 55, 56, and 59.

The leading guide groove 716 may be formed in either one of the two installation grooves 714 formed on the opposite lateral wall surfaces in the guide flow path 713. The leading guide groove 716 may be formed from either installation groove 714 of the guide flow path 713 in a transverse direction.

The leading guide groove 716 may be formed to be gradually inclined in a direction from the inside of the installation groove 714 toward the surface of the fan grille 42. At this point, the inside of the installation grooves 714 may be a portion through which when the frosting sensor 740 is fully inserted into the installation grooves 714, the signal line 745 of the frosting sensor 740 is taken out.

Furthermore, the signal line 745 connected to the frosting sensor 740 may be lead out of the guide flow path 713 via the leading guide groove 716.

At this point, considering that the leading guide groove 716 has the inclined shape, without sharply bending of the signal line 745, the signal line may be lead from the frosting sensor 740 out of the frosting detection duct 710.

The signal line 745 may be installed to be horizontally led out of the frosting detection duct 710 to reach the rear surface of a guide duct 43*b* formed in the shroud 43, and then be vertically bent along the guide duct 43*b* to be lead upward. This structure is as shown in FIG. 60.

The signal line 745 may be partially adhered on a surface of the guide duct 43*b* by using an adhesive tape. At this point, an adhered portion of the signal line 745 may include at least either one of a bent portion and an end portion of the signal line 745.

As described above, the frosting detecting device of various shapes may be provided to the refrigerator of the present disclosure.

The invention claimed is:

1. A refrigerator comprising:

a casing providing a storage compartment;

an evaporator to cool a fluid supplied to the storage compartment;

a fan grille arranged between the storage compartment and the evaporator;

a shroud arranged between the fan grille and the evaporator and coupled to the fan grille;

a frosting detecting device to detect an amount of frost or ice generated on the evaporator, an inlet duct formed at a lower portion of the fan grille and guiding air from the storage compartment to evaporator;

wherein the inlet duct is positioned to be spaced apart above a bottom surface of the casing and provides a flow path such that the fluid flows between the inlet duct and the bottom surface of the casing toward the evaporator, wherein the frosting detecting device comprises:

a frosting detection duct through which a portion of the fluid flows, the frosting detection duct having openings of upper and lower surfaces, wherein the frosting detection duct comprises:

a guide flow path formed by recessing a surface of the fan grille facing the evaporator, a flow path cover covering the guide flow path to separate the guide flow path from the evaporator, and a fluid inlet part provided on a lower end of the flow path cover and having peripheral wall surfaces and openings of upper and lower surfaces; and a frosting sensor to measure a material property of the portion of the fluid passing through the frosting detection duct, wherein the fluid inlet part protrudes toward a flow path of the fluid guided between the inlet duct and the bottom surface of the casing, the fluid inlet part has an inlet that opens toward the bottom surface of the casing, and a slot that opens rearward, wherein the inlet of the fluid inlet part is formed on the bottom surface of the fluid inlet part, and the slot of the fluid inlet part is formed on a rear surface of a lower end of the fluid inlet part, wherein a slot length Ls of the slot is configured to satisfy a condition of $0.2Li \leq Ls \leq 1.0Li$ with respect to a protruding length Li of the fluid inlet part.

2. The refrigerator of claim 1, wherein an opening sectional area G1 of a fluid inlet of the frosting detection duct is configured to satisfy a condition of $0.8G2 \leq G1 \leq 1.3G2$ on the basis of an opening sectional area G2 of the inlet slot.

3. The refrigerator of claim 1, wherein a protruding length Li of the fluid inlet part is configured to satisfy a condition of $0.5D \leq Li \leq 2.0D$ with respect to a flow path depth D of the frosting detection duct.

4. The refrigerator of claim 1, wherein a protruding length Li of the fluid inlet part is configured to satisfy a condition of $H1-H15/15 \leq Li \leq H1+H15/15$ with respect to a flow path height H1 of a fluid flow path between the inlet duct and the bottom surface of the casing.

5. The refrigerator of claim 1, wherein a flow resistor is provided between the fluid inlet part of the frosting detection duct and the flow path of the fluid guided by the inlet duct toward the evaporator.

6. A refrigerator comprising:

a casing providing a storage compartment;

an evaporator to cool a fluid supplied to the storage compartment;

a fan grille arranged between the storage compartment and the evaporator;

a shroud arranged between the fan grille and the evaporator and coupled to the fan grille;

a frosting detecting device to detect an amount of frost or ice generated on the evaporator, an inlet duct formed at a lower portion of the fan grille and guiding air from the storage compartment to evaporator;

wherein the inlet duct is positioned to be spaced apart above a bottom surface of the casing and provides a flow path such that the fluid flows between the inlet duct and the bottom surface of the casing toward the evaporator, wherein the frosting detecting device comprises:

a frosting detection duct through which a portion of the fluid flows, the frosting detection duct having openings of upper and lower surfaces, wherein the frosting detection duct comprises:

a flow path cover covering the guide flow path to separate the guide flow path from the evaporator, and a fluid inlet part provided at a lower end of the flow path cover and having peripheral wall surfaces and openings of an upper and lower surfaces; and a frosting sensor to measure a material property of the portion of the fluid passing through the frosting detection duct, wherein a fluid inlet part protrudes toward a flow path of the fluid guided between the inlet duct and the bottom surface of the casing, fluid inlet part has an inlet that opens toward the bottom surface of the casing, and a slot that opens rearward, wherein the inlet of the fluid inlet part is formed on the bottom surface of the fluid inlet part, and the slot of the fluid inlet part is formed a rear surface of a lower end of the fluid inlet part, wherein an inclined surface is formed on an opposite lateral wall surface of the fluid inlet part and the inclined surface is inclined inward in a downward direction.

7. The refrigerator of claim 1, wherein the frosting detection duct comprises a fluid outlet part at the shroud and having an open portion to discharge the portion of the fluid passing through the frosting detection duct.

8. The refrigerator of claim 7, wherein a part of the fluid outlet part at the shroud is formed to protrude from the shroud and be disposed at a guide flow path formed at the fan grille.

9. The refrigerator of claim 8, wherein the open portion of the fluid outlet part, through which the portion of the fluid is discharged, is exposed toward an rear wall of the casing.

10. The refrigerator of claim 1, wherein one portion of the flow path cover is in contact with the frosting sensor.

11. The refrigerator of claim 1, wherein the frosting sensor is disposed in a direction perpendicular to a flow direction of the fluid inside the the frosting detection duct and having opposite ends inserted into installation grooves formed on opposite lateral wall surfaces in the frosting detection duct, and the flow path cover includes contact protrusions that insert into the installation grooves.

12. The refrigerator of claim 3, wherein, with respect to a thickness T of the frosting sensor, an insertion depth D of the guide flow path of the frosting detection duct is configured to satisfy a condition of $(1.5\ mm*2)+T \leq D$.

13. The refrigerator of claim 1, wherein in the frosting sensor, a protrusion end is formed by protruding on an outer surface of the frosting sensor toward a front surface the frosting detection duct, and installation grooves are formed on opposite lateral wall surfaces of the frosting detection duct, into which ends of the frosting sensor are received, and insertion grooves corresponding to a shape of the protrusion end are disposed at inner surfaces of the installation grooves to receive the protrusion end.

* * * * *